US005712436A

United States Patent [19]

Sakama et al.

[11] Patent Number: 5,712,436

[45] Date of Patent: Jan. 27, 1998

[54] AUTOMATIC ACCOMPANIMENT APPARATUS EMPLOYING MODIFICATION OF ACCOMPANIMENT PATTERN FOR AN AUTOMATIC PERFORMANCE

[75] Inventors: Masao Sakama; Yutaka Tohgi; Eiichiro Aoki; Shigehiko Mizuno; Hiroyuki Ohba; Maki Kamiya; Hironori Osakabe, all of Hamamatsu, Japan

[73] Assignee: Yamaha Corporation, Japan

[21] Appl. No.: 505,585

[22] Filed: Jul. 21, 1995

[30] Foreign Application Priority Data

| | | | |
|---|---|---|---|
| Jul. 25, 1994 | [JP] | Japan | 6-192283 |
| Jul. 25, 1994 | [JP] | Japan | 6-192827 |
| Aug. 22, 1994 | [JP] | Japan | 6-220924 |
| Sep. 20, 1994 | [JP] | Japan | 6-251385 |

[51] Int. Cl.[6] ..... G10H 1/36; G10H 7/00

[52] U.S. Cl. ..... 84/610; 84/614; 84/634

[58] Field of Search ..... 84/609, 610, 634, 84/614, 615, 650, 653

[56] References Cited

U.S. PATENT DOCUMENTS

| | | | |
|---|---|---|---|
| 4,685,370 | 8/1987 | Okuda et al. | 84/1.03 |
| 4,889,026 | 12/1989 | Abe | 84/611 |
| 5,164,531 | 11/1992 | Imaizumi et al. | 84/634 |
| 5,208,416 | 5/1993 | Hayakawa et al. | 84/634 |
| 5,406,020 | 4/1995 | Imaizumi | 84/634 X |
| 5,457,282 | 10/1995 | Miyamoto et al. | 84/634 |
| 5,502,275 | 3/1996 | Kondo et al. | 84/637 X |
| 5,508,471 | 4/1996 | Shimada | 84/610 |

FOREIGN PATENT DOCUMENTS

| | | |
|---|---|---|
| 2-131292 | 5/1990 | Japan . |
| 5-73036 | 3/1993 | Japan . |

*Primary Examiner*—William M. Shoop, Jr.
*Assistant Examiner*—Jeffrey W. Donels
*Attorney, Agent, or Firm*—Graham & James LLP

[57] ABSTRACT

A normal automatic accompaniment performance is executed in accordance with an accompaniment pattern read out from a pattern memory. When a special performance is designated such as an intro, fill-in or ending performance, a modification suitable for the special performance is applied to a accompaniment pattern read out from the memory, so that the special performance is inserted in accordance with the thus-modified accompaniment pattern. At that time, the pattern may be modified by desired modifier data describing a manner of modifying the pattern. The pattern modification can be diversified by setting an individual modification condition to each musical instrument part of the accompaniment pattern in correspondence to the designated modifier. A memory is provided for storing a number of modifier data, and a further arrangement is provided for freely editing the modifier data stored in the memory. A still further arrangement is provided for dislaying the accompaniment pattern in the pre-modification state and the accompaniment pattern in the post-modification state for a visual comparison therebetween. There are also provided various methods to designated a desired modifier as well as various pattern modifying methods.

46 Claims, 34 Drawing Sheets

| ROCK MUSIC PATTERN TABLE | | |
|---|---|---|
| ADDRESS | HEAD ADDRESS | COMPLEXITY |
| 1 | A − 1 | 5 |
| 2 | A − 2 | 7 |
| 3 | A − 3 | 10 |
| 4 | C − 1 | 11 |
| 5 | A − 4 | 16 |
| 6 | C − 2 | 20 |
| ⋮ | ⋮ | ⋮ |
| n | A − n | 95 |

| DISCO MUSIC PATTERN TABLE | | |
|---|---|---|
| ADDRESS | HEAD ADDRESS | COMPLEXITY |
| 1 | B − 1 | 10 |
| 2 | B − 2 | 14 |
| 3 | C − 1 | 22 |
| 4 | B − 3 | 25 |
| 5 | C − 2 | 26 |
| 6 | C − 3 | 30 |
| ⋮ | ⋮ | ⋮ |
| n | B − n | 91 |

| COMPONENT | SELECTED PATTERN |
|---|---|
| BD+SD | 80 |
| Tom | 20 |
| HH | 45 |
| CY | — |
| ⋮ | |

Search-template = ((0 480 960 1440)(0 240 360 480)(20 20 20 20)): Replace-template = ((0 160 320)(001)(011))

Search-template = ((0 480 960 1440)(0 240 360 480)(20 20 20 20)); Replace-template = ((0 160 320)(001)(011))
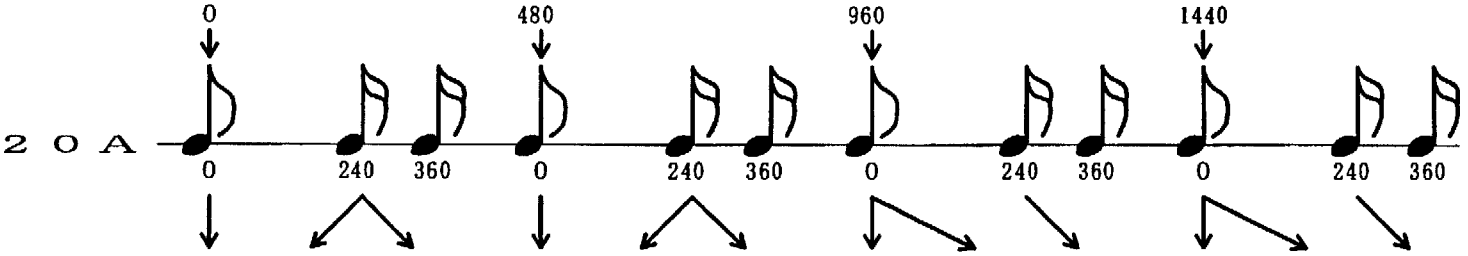
FIG. 20A
FIG. 20B
Search-template = ((0 480 960 1440)(0 240 360 480)(20 20 20 20)); Replace-template = ((0 160 320)(001)(***))
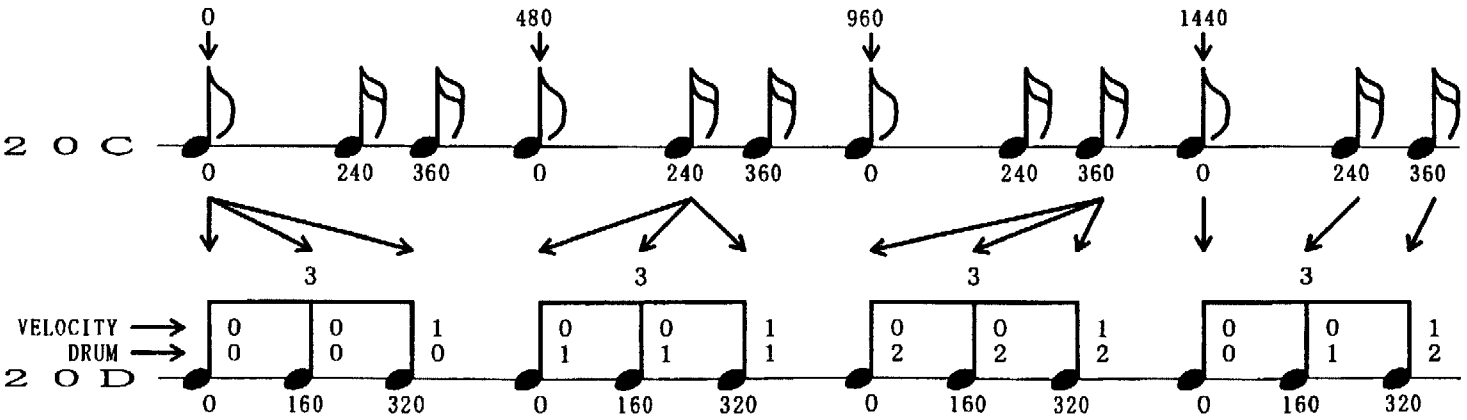
FIG. 20C
FIG. 20D

MODIFICATION CONDITION TABLE

| INSTRUMENT (GROUP) | FLAG AREA | MODIFIED-PLACE INDICATING AREA | | | |
|---|---|---|---|---|---|
| INSTRU. A | 0 | | | | |
| INSTRU. B | 1 | | | | |
| INSTRU. C | 1 | | | | |
| INSTRU. D | 0 | | | | |
| INSTRU. E | 1 | | | | |

ENTIRE PATTERN

MODIFIER MACRO TABLE

| | NUMBER OF MEASURE | 1ST MEASURE | 2ND MEASURE | 3RD MEASURE | 4TH MEASURE |
|---|---|---|---|---|---|
| MACRO 1 | 4 | MODI. A+C | —— | MODI. B | MODI. E |
| MACRO 2 | 2 | MODI. B | MODI. C+D | —— | —— |
| MACRO 3 | 1 | MODI. D+A | —— | —— | —— |
| MACRO 4 | 2 | MODI. C | MODI. B | —— | —— |
| ⋮ | ⋮ | ⋮ | ⋮ | ⋮ | ⋮ |
| MACRO N | 3 | MODI. B | MODI. A+C | MODI. E | —— |

MACRO ALLOCATION TABLE

| MACRO SWITCH | 1 | 2 | 3 | 4 |
|---|---|---|---|---|
| MACRO NO. | 1 | 2 | 4 | 5 |

AUTOMATIC ACCOMPANIMENT APPARATUS EMPLOYING MODIFICATION OF ACCOMPANIMENT PATTERN FOR AN AUTOMATIC PERFORMANCE

BACKGROUND OF THE INVENTION

The present invention generally relates to an automatic accompaniment device which is applicable to automatic rhythm performance and other forms of automatic accompaniment, and more particularly to such a device which is capable of making and changing accompaniment patterns with utmost ease.

For providing automatic accompaniment patterns desired by users, the prior art automatic accompaniment devices typically depend on an approach of selecting any of plural accompaniment patterns that are stored in memory in advance. However, this approach has the disadvantage that only a limited number of accompaniment patterns can be selected. Namely, in this type of prior art automatic accompaniment devices, the number of accompaniment patterns that can be stored in memory is so limited that it is only allowed to merely select as close patterns as possible to what the user actually desires. Thus, more often than not, accompaniment patterns can not be provided which are truly satisfactory to the user. In particular, those prior automatic accompaniment devices capable of executing intro, fill-in and ending performances are designed to merely select from a limited number of prestored accompaniment patterns.

So, as an approach for freely making automatic accompaniment patterns in accordance with the user's desire, it has been proposed that desired accompaniments patterns are sampled or formed and stored into memory by the user manually playing a keyboard of electronic musical instrument etc. in an arbitrary manner. In this way, automatic accompaniment can be performed by reading out the accompaniment patterns stored in the memory. Nevertheless, this approach also has the problem that it is difficult, if not impossible, to make proper accompaniment patterns unless the user has enough musical knowledge and performance skill. Besides, even where the user has enough knowledge and performance skill, it often takes a considerable amount of time and labor to make accompaniment patterns, and this renders it very difficult to make accompaniment patterns as desired by the user.

U.S. Pat. No. 4,685,370 discloses a solution for facilitating the rhythm performance pattern making. According to the disclosure, plural patterns are stored in advance for each percussive tone source in such a manner that a desired pattern is selected for each of the tone source, so that a desired rhythm performance pattern as a whole can be provided by a combination of the selected patterns for the respective percussive tone sources. But, with this disclosed technique, it is necessary to make separate selections of the percussive tone source and pattern, which is very troublesome and time-consuming. The disclosed technique also has the problem of poor operability and is not satisfactory in that variation of performance patterns provided by the combination of the stored patterns is quite limited. Further, since selection can be made only from the stored patterns, it is not possible to create accompaniment patterns freely at the user's will. In particular, where there are provided, for each accompaniment pattern, intro, fill-in and ending performances which are considered indispensable for an automatic performance, the data storage amount unavoidably becomes enormous.

SUMMARY OF THE INVENTION

Therefore, it is an object of the present invention to provide an automatic accompaniment device which is capable of achieving intro, fill-in and ending performances full of variety, without a need to store a large quantity of accompaniment patterns in advance.

It is another object of the present invention to provide an automatic accompaniment device which is capable of making and changing accompaniment patterns with utmost ease no matter how complex the accompaniment patterns may be.

To achieve the above-mentioned object, the present invention provides an automatic accompaniment device which comprises an accompaniment pattern storage section storing an accompaniment pattern, a readout section for reading out the accompaniment pattern from the accompaniment pattern storage section, a special performance designation section for designating a special performance, the special performance being at least one performance among intro, fill-in and ending performances, a pattern modification section for applying, to the accompaniment pattern read out by the readout section, a modification corresponding to the special performance designated by the special performance designation section, a progression control section for controlling progression of an automatic accompaniment performance in accordance with the designated special performance, and an accompaniment tone generation section for generating automatic accompaniment tone on the basis of the read-out accompaniment pattern and the accompaniment pattern modified by the pattern modification section.

According to the invention thus arranged, a normal performance is executed in accordance with the accompaniment pattern read out from the accompaniment pattern storage section. However, when a special performance is designated by the special performance designation section, a modification suitable for the special performance is applied to the accompaniment pattern read out from the accompaniment pattern storage section, and then an automatic performance corresponding to the designated special performance is executed on the basis of the modified accompaniment pattern. Namely, depending on the kind of the designated special performance, the accompaniment pattern read out from the accompaniment pattern storage section is modified into a pattern suitable for, for example, an intro, fill-in or ending performance. A progression control section controls the progression of the automatic accompaniment performance in accordance with the kind of the designated special performance so as to carry on the special performance such as an intro, fill-in or ending performance. Such features eliminate a need to previously store a large quantity of accompaniment patterns for the special performance, thus permitting a special performance full of variety with a simplified structure.

To achieve the above-mentioned object, an automatic accompaniment device according to the second aspect of the invention comprises an accompaniment pattern storage section storing an accompaniment pattern, a readout section for reading out the accompaniment pattern from the accompaniment pattern storage section, a special performance designation section for designating a special performance, the special performance being one of intro, fill-in and ending performances, a modifier supply section for supplying modifier data describing a manner of modifying the accompaniment pattern, a pattern modification section for applying, to the accompaniment pattern read out by the readout section, a modification based on the modifier data supplied by the modifier supply section, a progression control section for controlling progression of an automatic accompaniment performance in accordance with the special performance designated by the special performance designation section, and an accompaniment tone generation section for generating automatic accompaniment tone on the basis of the read-out accompaniment pattern and the accompaniment pattern modified by the pattern modification section.

Similarly to the above-mentioned, the invention thus arranged eliminates a need to previously store a large quantity of accompaniment patterns for the special performance, thus permitting a special performance full of variety with a simplified structure. Further, because the pattern variation is performed on the basis of desired modifier data, it is allowed to achieve diversified accompaniment patterns for the special performance by freely modifying a specific accompaniment pattern for the special performance.

To achieve the above-mentioned object, an automatic accompaniment device according to the third aspect of the invention comprises an accompaniment pattern storage section storing an accompaniment pattern in correspondence to plural musical instrument parts, a readout section for reading out the accompaniment pattern from the accompaniment pattern storage section, a modifier supply section for supplying modifier data describing a manner of modifying the accompaniment pattern, a modification condition data supply section for supplying modification condition data for each of the musical instrument parts in correspondence to the modifier data supplied by the modifier supply section, and a modification section for, for each of the musical instrument parts, modifying the accompaniment pattern read out by the readout section in accordance with the modifier data supplied by the modifier supply section and the modification condition data supplied for each of the musical instrument parts by the modification condition data supply section.

According to the invention thus arranged, desired modifier data is provided which describes a manner of modifying the accompaniment pattern, and modification condition data for each of the musical instrument parts is also provided in correspondence to the modifier data, so that the accompaniment pattern read out by the readout section is modified, for each of the musical instrument parts, in accordance with the modifier data and modification condition data. For example, where there are snare drum and bus drum as the musical instrument parts, the modification condition data corresponding to given modifier data may set such a condition that a modification is applied to snare drum but not to bus drum, while the modification condition data corresponding to another modifier data may set such a condition that a modification is applied to bass drum but not to snare drum. Thus, when performing a accompaniment pattern modification based on a desired modifier, a variety of different accompaniment patterns can be made with a simple structure by setting an individual modification condition for each of the musical instrument parts, thereby permitting an automatic accompaniment performance full of variety. In an alternative arrangement, modification condition data may be provided for each group of plural musical instrument parts, rather than for each musical instrument part.

To achieve the above-mentioned object, an automatic accompaniment device according to the fourth aspect of the invention comprises an accompaniment pattern storage section storing an accompaniment pattern, a readout section for reading out the accompaniment pattern from the accompaniment pattern storage section, a modifier supply section for supplying modifier data describing a manner of modifying the accompaniment pattern, a modification section for modifying a partial time range of the accompaniment pattern read out by the readout section in accordance with a predetermined algorithm corresponding to the modifier data supplied by the modifier supply section. According to the invention thus arranged, in the case where the accompaniment pattern comprises four measures, such control can, for example, be performed that modifications are applied only a limited time area of the second and third measures (i.e., pattern section) while no modification is applied to the other time area of the first and fourth measures. Thus, it is allowed to readily make a variety of accompaniment patterns and to thereby achieve an automatic accompaniment performance full of variety with a simplified structure.

To achieve the above-mentioned object, an automatic accompaniment device according to another aspect of the invention comprises an accompaniment pattern storage section storing an accompaniment pattern, a readout section for reading out the accompaniment pattern from the accompaniment pattern storage section, a modifier supply section for supplying a combination of plural modifier data each describing a manner of modifying the accompaniment pattern, and a modification section for modifying the accompaniment pattern read out by the readout section in accordance with a predetermined algorithm corresponding to the plural modifier data supplied by the modifier supply section. According to the invention thus arranged, the accompaniment pattern is modified in accordance with a variable combination of plural modifiers, so that the manner to modify the accompaniment pattern can be diversified. Thus, it is allowed to readily make a variety of accompaniment patterns and to thereby achieve an automatic accompaniment performance full of variety with a simplified structure.

To achieve the above-mentioned object, an automatic accompaniment device according to still another aspect of the invention comprises an accompaniment pattern storage section storing an accompaniment pattern, a readout section for reading out the accompaniment pattern from the accompaniment pattern storage section, a modifier data storage section for storing modifier data each describing a manner of modifying the accompaniment pattern, a modifier supply section for selectively supplying the modifier data from the modifier data storage section, a modification section for modifying the accompaniment pattern read out by the readout section in accordance with a predetermined algorithm corresponding to the modifier data supplied by the modifier supply section, and an editing section for editing the modifier data stored in the modifier data storage section. Because of the provision of the editing section, the user can make any modifier data that fits his or her taste and, by modifying the accompaniment pattern by use of the thus-made modifier data, also can achieve an automatic accompaniment performance full of variety with a simplified structure.

To achieve the above-mentioned object, an automatic accompaniment device according to still another aspect of the invention comprises a storage section storing accompaniment pattern data, a designation section for designating a modifier indicative of a modification to be applied to the accompaniment pattern, a modification section for executing a modifying algorithm corresponding to the modifier designated by the designation section, so as to modify the accompaniment pattern data, a display section for displaying the contents of the accompaniment pattern, a display control section for controlling the contents of the accompaniment pattern to be displayed on the display section in such a manner to indicate how the accompaniment pattern is changed by being modified by the modification section, and an accompaniment section for performing an automatic accompaniment performance in accordance with the accompaniment pattern modified by the modification section.

According to the invention thus arranged, the user designates a modifier to modify the accompaniment pattern.

The modification section modifies the accompaniment pattern stored in the storage section in accordance with a modifying algorithm corresponding to the designated modifier. In this way, the stored accompaniment pattern is modified into an accompaniment pattern corresponding to the designated modifier. Then, the accompaniment section performs an automatic accompaniment performance in accordance with the accompaniment pattern modified by the modification section. On the display section are displayed the contents of the accompaniment pattern so that it is shown to the user how the accompaniment pattern is changed by being modified by the modification section (i.e., between the pre-modification state and the post-modification state).

To achieve the above-mentioned object, an automatic accompaniment device according to still another aspect of the invention comprises a storage section storing accompaniment pattern data, a designation section for designating a modifier indicative of a modification to be applied to the accompaniment pattern, a modification section for executing a modifying algorithm corresponding to the modifier designated by the designation section so as to modify the accompaniment pattern data, the modifying algorithm comprising plural modification elements, a display section for displaying the modification elements of the modifying algorithm corresponding to the designated modifier, and an accompaniment section for performing an automatic accompaniment performance in accordance with the accompaniment pattern modified by the modification section.

According to the invention thus arranged, the user designates a modifier to modify the accompaniment pattern. The modification section modifies the accompaniment pattern stored in the storage section in accordance with a modifying algorithm corresponding to the designated modifier. In this way, the stored accompaniment pattern is modified into an accompaniment pattern corresponding to the designated modifier. Then, the accompaniment section performs an automatic accompaniment performance in accordance with the accompaniment pattern modified by the modification section. Here, the modifying algorithm corresponding to the designated modifier comprises plural modification elements, and the display section displays any of the modification elements of the algorithm which has been used for the modification.

To achieve the above-mentioned object, an automatic accompaniment device according to still another aspect of the invention comprises a storage section storing accompaniment pattern data, plural designating operating members provided in correspondence to modifiers indicative of modifications to be applied to the accompaniment pattern, a designation section for designating any of the modifiers in response to operation of any of the operating members, wherein when one of the operating members is operated singly, the designation section designates any of the modifiers which corresponds to the operated operating member, but when two or more the operating members are operated substantially simultaneously, the designation section designate any of the modifiers other than the modifiers corresponding to the operated operating members, a modification section for executing a modifying algorithm corresponding to the modifier designated by the designation section, and an accompaniment section for performing an automatic accompaniment performance in accordance with the accompaniment pattern modified by the modification section.

According to the invention thus arranged, the accompaniment pattern is modified in accordance with a modifying algorithm corresponding to the designated modifier. When one of the operating members is operated singly, any of the modifiers which corresponds to the operated operating member is designated, whereas when two or more the operating members are operated substantially simultaneously, any of the modifiers other than, i.e., different from the modifiers corresponding to the operated operating members is designated.

An automatic accompaniment device according to still another aspect of the invention comprises a storage section storing accompaniment pattern data, a designation section for designating any of plural modifiers indicative of modifications to be applied to the accompaniment pattern, each of the modifiers being set in pair with another modifier which is opposite in nature thereto, a modification section for executing a modifying algorithm corresponding to the modifier designated by the designation section so as to modify the accompaniment pattern, a determination section for determining whether the currently-designated modifier is opposite in nature to the last-designated modifier, an undo section for, when the determination section determines that the currently-designated modifier is opposite in nature to the last-designated modifier, restoring the accompaniment pattern before modification based on the last-designated modifier, and an accompaniment section for performing an automatic accompaniment performance in accordance with the accompaniment pattern modified by the modification section or with the accompaniment pattern restored by the undo section.

According to the invention thus arranged, the accompaniment pattern is modified in accordance with a modifying algorithm corresponding to the designated modifier. Each of the modifiers is set in pair with another modifier which is opposite in nature to the modifier. When the currently-designated modifier is opposite in nature to the last-designated modifier, the accompaniment pattern before modification by the last-designated modifier is restored.

An automatic accompaniment device according to still another aspect of the invention comprises a storage section storing accompaniment pattern data, plural designating operating members provided in correspondence to modifiers indicative of modifications to be applied to the accompaniment pattern, a designation section for designating any of the modifiers in response to activation of any of the operating members, wherein when two or more the operating members are operated substantially simultaneously, the designation section treats the operation of only one of the operating members as effective, a modification section for executing a modifying algorithm corresponding to the modifier designated by the designation section so as to modify the accompaniment pattern, and an accompaniment section for performing an automatic accompaniment performance in accordance with the accompaniment pattern modified by the modification section.

According to the invention thus arranged, the accompaniment pattern is modified in accordance with a modifying algorithm corresponding to the designated modifier. When two or more the operating members are operated substantially simultaneously, the operation of only one of the operating members is treated as effective, and a modifier is determined on the basis of the operation of the operating members which has been treated as effective.

An automatic accompaniment device according to yet another aspect of the invention comprises a storage section storing accompaniment pattern data, a designation section for designating a modifier indicative of a modification to be applied to the accompaniment pattern, a modification section for executing a modifying algorithm corresponding to the modifier designated by the designation section, a mode setting section for setting first and second modes, a modification timing control section for controlling modification timing of the modification section in such a manner that when the first mode is set by the mode setting section, a modification process is performed within a same measure where the modifier is designated by the designation section, but when the second mode is set by the mode setting section, a modification process is performed at the head of a measure next to the measure where the modifier is designated by the designation section, and an accompaniment section for performing an automatic accompaniment performance in accordance with the accompaniment pattern modified by the modification section.

According to the invention thus arranged, the accompaniment pattern is modified in accordance with a modifying algorithm corresponding to the designated modifier. The modification timing is controlled in such a manner that when the first mode is set by the mode setting section, the modification process is performed within a same measure where the modifier is designated. But, when the second mode is set by the mode setting section, the modification process is performed at the head of a measure next to the measure where the modifier is designated.

An automatic accompaniment device according to yet another aspect of the invention comprises a storage section storing accompaniment pattern data, a designation section for designating a modifier indicative of a modification to be applied to the accompaniment pattern, a modification section for executing a modifying algorithm corresponding to the modifier designated by the designation section, a modification timing control section for controlling modification timing of the modification section in such a manner that when the modifier is designated by the designation section earlier than predetermined timing within a specific measure, a modification process is performed in the specific measure, but when the modifier is designated by the designation section later than predetermined timing within a specific measure, a modification process is performed at the head of a measure next to the specific measure, and an accompaniment section for performing an automatic accompaniment performance in accordance with the accompaniment pattern modified by the modification section.

According to the invention thus arranged, the accompaniment pattern is modified in accordance with a modifying algorithm corresponding to the designated modifier. The modification timing is controlled in such a manner that when the modifier is designated by the designation section earlier than predetermined timing within a specific measure, the modification process is performed in the specific measure, but when the modifier is designated by the designation section later than predetermined timing within a specific measure, the modification process is performed at the head of a measure next to the specific measure.

An automatic accompaniment device according to yet another aspect of the invention comprises a storage section storing accompaniment pattern data, a designation section for designating a modifier indicative of a modification to be applied to the accompaniment pattern, a modification section for, in response to designation by the designation section, executing a modifying algorithm corresponding to the modifier designated by the designation section so as to modify the accompaniment pattern, wherein when it is detected that the designating operating member is in an operated state at predetermined timing, the modification section performs a modification at the predetermined timing, and an accompaniment section for performing an automatic accompaniment performance in accordance with the accompaniment pattern modified by the modification section.

According to the invention thus arranged, the accompaniment pattern is modified in accordance with a modifying algorithm corresponding to the designated modifier. The modification process is performed at the same timing when the operating member is operated to designate the modifier. When it is detected that the designating operating member is in an operated state at predetermined timing other after the operation timing of the operating member, the modification process is performed also at this predetermined timing.

The preferred embodiments of the present invention will be described in detail below with reference to the accompanying drawings.

BRIEF DESCRIPTION OF THE DRAWINGS

In the drawings:

FIGS. 20A to 20D are conceptual diagrams showing a manner in which the drum sound and velocity of a current pattern are replaced in the transformer process;

DETAILED DESCRIPTION OF THE PREFERRED EMBODIMENTS

Figure 1:
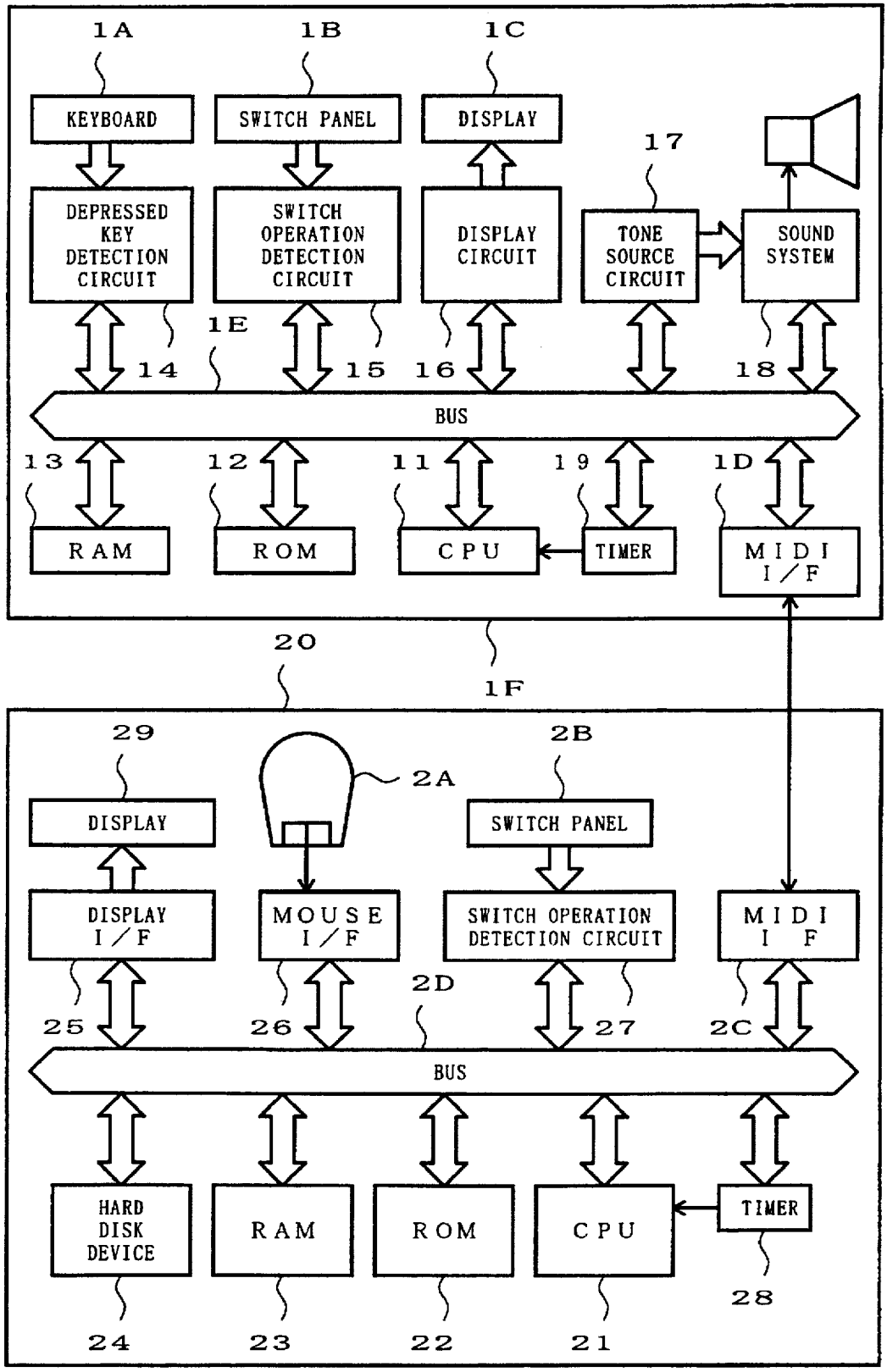
FIG. 1 is a hardware block diagram illustrating the detailed structure of an electronic musical instrument containing a sequencer-type automatic performance device, and a personal computer for editing accompaniment patterns, as well as the connection between the electronic musical instrument and the personal computer.

FIG. 1 is a hardware block diagram illustrating the detailed structure of an electronic musical instrument 1F containing a keyboard and a tone source circuit, and a personal computer 20 for editing accompaniment patterns and providing data based on the accompaniment patterns to the electronic musical instrument 1F, as well as the connection between the electronic musical instrument 1F and the personal computer 20.

First, the detailed structure of the electronic musical instrument 1F will be described below.

A microprocessor unit (CPU) 11 controls the entire operation of the electronic musical instrument 1F. To this CPU 11 are connected, via a bus 1E, a ROM 12, a RAM 13, a depressed key detection circuit 14, a switch operation detection circuit 15, a display circuit 16, a tone source circuit 17, a sound system 18, a timer 19 and a MIDI interface (I/F) 1D.

Here, the description will be made in relation to such a specific electronic musical instrument in which depressed key detection, transmission/reception of performance data (note data), tone generation processing etc. are carried out via the CPU 11. But, it should be noted that the present invention is also applicable to another type of electronic musical instrument in which there are separately provided a module comprising the depressed key detection circuit 14 and a module comprising the tone source circuit 17, and in which data exchange between the two modules is performed via MIDI interfaces.

The ROM 12, which is a read-only memory, stores therein various programs and data that are utilized by the CPU 11.

The RAM 13 is provided in predetermined address areas of a random access memory for use as registers and flags for temporarily storing various data which are produced as the CPU 11 executes the programs.

A keyboard 1A has a plurality of keys for designating the pitch of tone to be generated and key switches provided in corresponding relations to the keys. If necessary, the keyboard may also include key-touch detection means such as a key depression velocity or force detection device. The keyboard is employed here just because it is a fundamental performance operator which is easy for music players to manipulate, but any other suitable performance operator such as drum pads or the like may of course be employed.

The depressed key detection circuit 14, which comprises a circuit including a plurality of key switches corresponding to the keys on the keyboard, outputs key-on event data upon detection of a newly depressed key and key-off event data upon detection of a newly released key. The depressed key detection circuit 14 also generates key touch data by determining the key depression velocity or force and outputs the generated touch data as velocity data. Each of the key-on and key-off data and key touch data is expressed in accordance with the MIDI standard and contains data indicative of a key code and a channel to be assigned to generate a tone.

A switch panel 1B comprises a variety of operators, i.e., operating members for selecting, setting and controlling the color, volume, effect etc. of tone to be generated. The switch panel 1B is of any conventionally-known structure and will not be described further.

The switch operation detection circuit 15 detects the operational state of each operating member on the switch panel 1B and supplies, via the bus 1E, the CPU 11 with switch data corresponding to the detected operational state.

The display circuit 16 shows on a display section 1C various information such as the controlling state of the CPU 11 and the contents of currently set data. The display section 1C comprises, for example, a liquid crystal display (LCD), and its operation is controlled by the display circuit 16.

The tone source circuit 17 has a plurality of tone generation channels, by means of which it is capable of generating plural tones simultaneously. The tone source circuit 17 receives performance data (data based on the MIDI standard) supplied via the bus 1E, and on the basis of the received data, it can generate tone signals through selectively assigned tone generation channels. As will be later described, the tone source circuit 17 of the electronic musical instrument 1F is constructed in such manner to be able to generate tone signals of various kinds of drum sound.

Any tone signal generation method may be used in the tone source circuit 17 depending on the application. For example, any conventionally known tone signal generation method may be used such as: the memory readout method where tone waveform sample value data stored in a waveform memory are sequentially read out in accordance with address data that change in correspondence to the pitch of tone to be generated; the FM method where tone waveform sample value data are obtained by performing predetermined frequency modulation operations using the above-mentioned address data as phase angle parameter data; or the AM method where tone waveform sample value data are obtained by performing predetermined amplitude modulation operations using the above-mentioned address data as phase angle parameter.

The tone signal generated by the tone source circuit 17 is audibly reproduced through the sound system 18 which comprises an amplifier and a speaker (both not shown).

The timer 19 generates clock pulses which are used for counting time intervals etc. Each of the clock pulses is applied to the CPU 11 as an interrupt command, in response to which the CPU 11 carries out various processing as will be later described in detail.

A MIDI interface (I/F) ID interconnects the bus 1E of the electronic musical instrument 1F and a MIDI interface (I/F) 2C of the personal computer 20. The MIDI interface 2C in turn interconnects a bus 2D of the personal computer 20 and the above-mentioned MIDI interface 2C. Accordingly, the bus 1E of the electronic musical instrument 19 and the bus 2D of the personal computer 20 are interconnected via the two MIDI interfaces 1D and 2C, so that data exchange based on the MIDI standard can be done bidirectionally.

Next, the structure of the personal computer 20 will be described in detail.

A microprocessor unit (CPU) 21 controls the entire operation of the personal computer 20. To this CPU 21 are connected, via the bus 2D, a ROM 22, a RAM 23, a hard disk device 24, a display interface (I/F) 25, a mouth interface (MOUSE I/F) 26, a switch operation detection circuit 27, a timer 28 and the above-mentioned MIDI interface 2C.

The ROM 22, which is a read-only memory, stores therein a variety of data such as various programs and data and various signs and characters.

Figure 3:
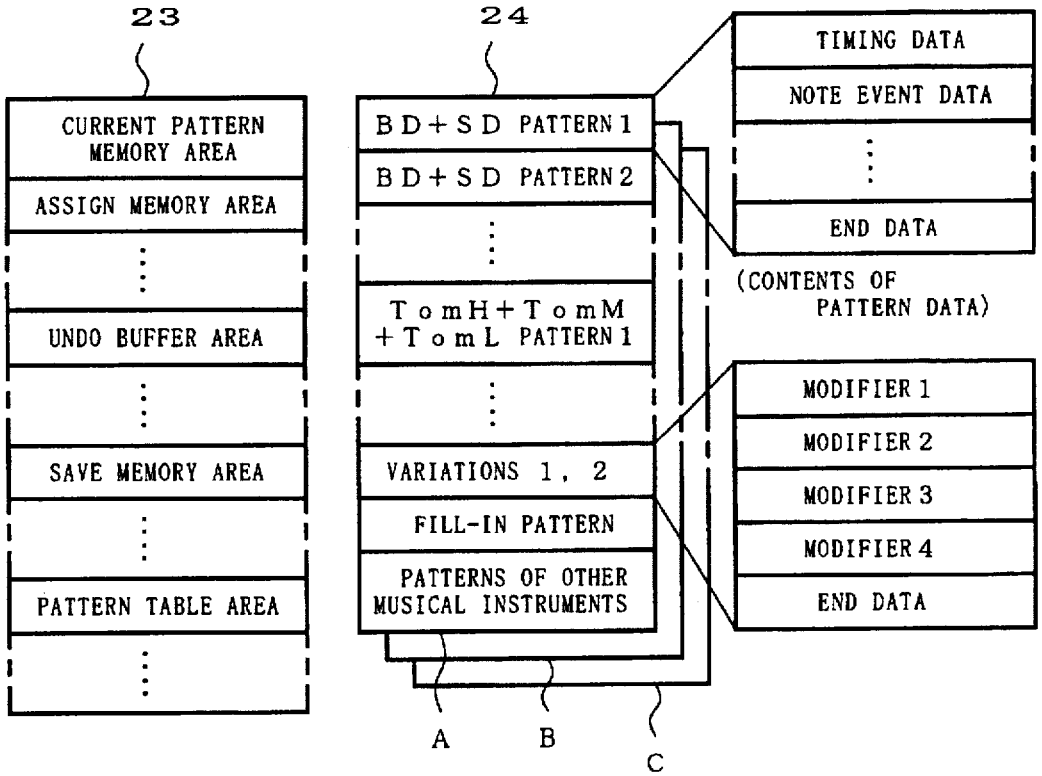
FIG. 3 illustrates the data storage formats in a RAM and a hard disk device of the personal computer shown in FIG. 1.

The RAM 23, which is an random access memory (RAM), temporarily stores various data produced as the CPU 21 executes the programs. As shown in FIG. 3, predetermined areas of the RAM 23 in this embodiment are assigned as a current pattern memory area, an assign memory area, an undo buffer area, a save memory area and a pattern table area.

The current pattern memory area is used for storing each rhythm pattern which is read out during an automatic accompaniment (current pattern). The assign memory area is used for storing each rhythm pattern which is newly made by edit processing or transformer process as will be described later in detail. The undo buffer area is used for temporarily storing each rhythm pattern which is changed or transformed by the transformer process. The save memory area is used for saving the current pattern when a fill-in is inserted, or for temporarily storing a rhythm pattern of a previously existing component when some rhythm pattern component is newly read out from a predetermined data base.

The pattern table area is provided for storing data that represent the addresses and degrees of complexity of rhythm patterns stored in the data base (hard disk device 24), using the degrees of complexity as addresses. In more specific terms, this pattern table area is an area for storing an address conversion table that is looked up to convert, into addresses of the data base, the serial addresses of the rhythm patterns that have been rearranged in accordance with the degrees of complexity, i.e., in such order where less complex patterns assumes smaller address values.

The hard disk device 24, which is an external storage device of the personal computer 20, has a storage capacity somewhere between dozens of megabytes (MB) and hundreds of megabytes. In this embodiment, the hard disk device 24 which is used as the data base of rhythm patterns is divided into three banks A, B, C for storing three different styles (categories) of patterns.

In this embodiment, bank A stores a plurality of rhythm patterns corresponding to drum sound components dedicated to rock music, bank B stores a plurality of rhythm patterns corresponding to drum sound components dedicated to disco music, and bank C stores a plurality of rhythm patterns corresponding to drum sound components common to rock and disco music. Head addresses to uniquely identify the individual rhythm patterns stored in the banks are sequentially stored in the above-mentioned pattern table area by using, as addresses, the degrees of complexity in such a manner that less complex patterns assumes smaller address values.

For instance, in the case of a component of bus drum (BD) and snare drum (SD), plural patterns comprising (BD+SD)

pattern 1, (BD+SD) pattern 2, . . . are stored in such a manner that they become progressively complex as their pattern numbers increase. Similarly, in the case of a component of tom tom high, tom tom middle and tom tom low (Tom H, Tom M, Tom L), plural patterns comprising (Tom H+Tom M+Tom L) pattern 1, (Tom H+Tom M+Tom L) pattern 2, . . . are stored in such a manner that they become progressively complex as their pattern numbers increase.

Figures 4, 5A, 5B:
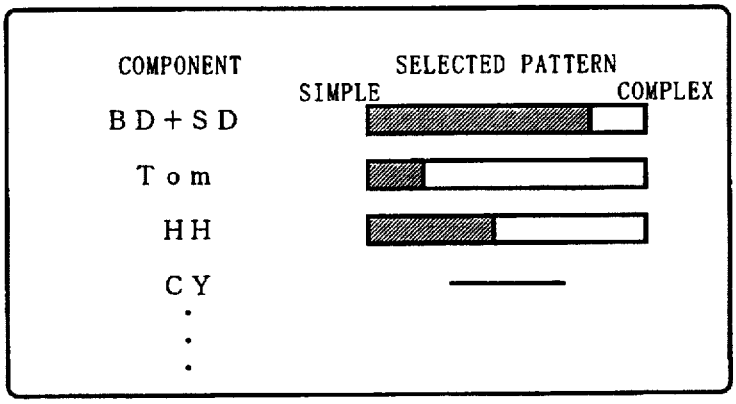
FIG. 4 illustrates the contents of an address conversion table stored in a pattern table area.
FIG. 5A is a diagram showing an example of video information presented on a display.
FIG. 5B is a diagram showing another example of video information presented on the display.

FIG. 4 shows the contents of the address conversion table stored in the pattern table area, in which are illustrated a rock music pattern table and a disco music pattern table.

The rock music pattern table stores head addresses A-1, A-2, A-3, C-1, A-4, C-2, . . . , A-n for uniquely identifying individual ones of the plural rhythm patterns contained in banks A and C, using, as addresses, the serial numbers 1, 2, 3, . . . , n corresponding to the degrees of complexity of the rhythm patterns. Similarly, the disco music pattern table stores head addresses B-1, B-2, C-1, B-3, C-2, C-3, . . . , B-n for uniquely identifying individual ones of the plural rhythm patterns contained in banks B and C, using, as addresses, the serial numbers 1, 2, 3, . . . , n corresponding to the degrees of complexity of the rhythm patterns.

Here, the prefix "A", "B" or "C" of each head address specifies any one of the banks where the corresponding rhythm pattern is stored. That is, the head addresses A-1, A-2, A-3, A-4 and A-n specify bank A, the head addresses B-1, B-2, B-3 and B-n specify bank B, and the head addresses C-1, C-2 and C-3 specify bank C.

This embodiment employs the degrees of complexity represented in values ranging from "0" to "100" that are obtained by converting the complexity of each rhythm pattern in accordance with predetermined rules. The predetermined rules may for example be determined directly on the basis of the number of notes contained in the rhythm pattern, the number in the rhythm pattern of such timing where note event data exists, a difference between the numbers of notes contained in the former and latter halves of the rhythm pattern, or the number of event occurrences at specific timing (such as first or third beat, or eighth-note upbeat), or on the basis of a combination of some of the above-mentioned factors arbitrarily selected by the user, or in collective consideration of all these factors. In a modified example, the rhythm patterns may be rearranged in any appropriate order as desired by the user.

In FIG. 4, at address "1" of the rock music pattern table, there is shown that a rhythm pattern dedicated to rock music and having the smallest degree of complexity of "5" is stored at head address "A-1" of the data base. Similarly, at address "2" is shown that a rhythm pattern dedicated to rock music and having the degree of complexity "7" is stored at address "A-2" of the data base; at address "3" is shown that a rhythm pattern dedicated to rock music and having the degree of complexity of "10" is stored at address "A-3" of the data base; at address "4" is shown that a rhythm pattern common to rock music and disco music and having the degree of complexity of "11" is stored at address "C-1" of the data base; at address "5" is shown that a rhythm pattern dedicated to rock music and having the degree of complexity of "16" is stored at address "A-4" of the data base; at address "6" is shown that a rhythm pattern common to rock music and disco music and having the degree of complexity of "20" is stored at address "C-2" of the data base; and at address "n" is shown that a rhythm pattern dedicated to rock music and having the greatest degree of complexity of "95" is stored at address "A-n" of the data base.

Further, in FIG. 4, at address "1" of the disco music pattern table, there is shown that a rhythm pattern dedicated to disco music and having the smallest degree of complexity of "10" is stored at head address "B-1" of the data base. Similarly, at address "2" is shown that a rhythm pattern dedicated to disco music and having the degree of complexity "14" is stored at address "B-2" of the data base; at address "3" is shown that a rhythm pattern common to rock music and disco music and having the degree of complexity of "22" is stored at address "C-1" of the data base; at address "4" is shown that a rhythm pattern dedicated to disco music and having the degree of complexity of "25" is stored at address "B-3" of the data base; at address "5" is shown that a rhythm pattern common to rock music and disco music and having the degree of complexity of "26" is stored at address "C-2" of the data base; at address "6" is shown that a rhythm pattern common to rock music and disco music and having the degree of complexity of "30" is stored at address "C-3" of the data base; and at address "n" is shown that a rhythm pattern dedicated to disco music and having the greatest degree of complexity of "91" is stored at address "B-n" of the data base.

Because the rhythm patterns in bank C are common to rock and disco music, these patterns are present in both of the rock and disco music tables. For example, in the pattern table of FIG. 4, the rhythm patterns of head addresses "C-1" and "C-2" are contained in both of the rock and disco music tables. The reason why the rhythm patterns common to rock music and disco music are different in degree of complexity between rock music and disco music is that the predetermined rules applied in determining the degree of complexity differ between the rock and disk music pattern tables as earlier mentioned.

Each of the banks A, B, C also stores fill-in patterns in preparation for real time performance and patterns of other musical instruments as shown in FIG. 3, and thus, if desired, performance can be made by temporarily inserting such a fill-in pattern in place of a current pattern.

Each of the rhythm patterns in the banks A, B, C, as shown in FIG. 3, comprises a set of performance data stored on a relative time basis, and each of the performance data is a combination of timing data indicative of the timing of an event and note event data indicative of the sort of the event. In this embodiment, the note event data is a three-byte data stored in a format corresponding to a MIDI note-on message. The timing data is represented in terms of the number of clock pulses between adjacent note events. In the hard disk device 24, there are also stored, as variation patterns 1 and 2, two kinds of sequence data for selectively instructing modifiers for rhythm pattern transformation. That is, as shown in FIG. 3, variations 1 and 2 comprise sequential data including modifiers 1–4 stored in sequence.

Although not specifically shown in the drawings, a cache memory (RAM) having a capacity of about several megabytes may be provided in order to substantially reduce the time required for accessing the hard disk device 24, or a DMA (Direct Memory Access) device may be provided in order to reduce the burden involved in data exchange between the RAM 23 and the hard disk device 24.

A display 29, which comprises a conventional CRT, LCD or the like, received data processed within the personal computer 20 via a display interface (I/F) and visually presents the input data in video form on its screen.

FIG. 5 shows examples of video information presented on the display 29. In order to indicate which of the components is being currently selected and of which degree of complexity the selected component is, the display 29 shows, on a section denoted as "selected pattern", the degree of complexity of each individual rhythm pattern of the selected component. Accordingly, the display indicates that such a component whose degree of complexity is displayed in the section "selected pattern" is being currently selected and that other components whose degrees of complexity are not shown in the section "selected pattern" are not being currently selected.

For instance, the illustrated example of FIG. 5A shows that a rhythm pattern having the degree of complexity "80" is being selected with respect to component BD+SD comprised of bus drum (BD) and snare drum (SD). It also shows that a rhythm pattern having the degree of complexity "20" is being selected with respect to tom tom component Tom and a rhythm pattern having the degree of complexity "45" is being selected with respect to high hat component HH, but it shows that no rhythm pattern is being selected for cymbal component CY by not indicating any degree of complexity. In a similar manner to the above-mentioned, whether or not any given component is being selected will be readily seen by checking whether or not the degree of complexity of that component is indicated in the "selected pattern" section on the display. In addition, from indication of the degree of complexity in the "selected pattern" section on the display, it will be readily recognized at which relative level of complexity the corresponding rhythm pattern is located.

Although indicated by numerical values in the illustrated example of FIG. 5A, the degrees of complexity may be indicated in graphic representation such as a bar graph shown in FIG. 5B. By thus indicating the degrees of complexity in graphic representation, it is possible to readily know if any given component is being currently selected and also sensuously recognize the relative positioning of the component's degree of complexity.

The relative positioning of the rhythm patterns may be determined in terms of any other factor (e.g., degree of furiousness or "groove") than the above-mentioned degree of complexity, or may be indicated in multidimensions such as two or three dimensions by combining these factors. In the case of the multidimensional indication, graphic representation such as a radar chart will be useful.

A mouse 2A is a kind of pointing device for inputting desired coordinate points to the personal computer 20, and the output of the mouse 2A is supplied to the CPU 21 via a mouse interface (MOUSE I/F) 26 and the bus 2D.

A switch panel 2B is in the form of a keyboard for inputting programs and data to the personal computer 20 and is provided with ten-keys and function keys.

A switch operation detection circuit 27 detects the operational state of each key on the switch panel 2B and provides, via the bus 2D, the CPU 21 with key operation data corresponding to the detected operational state.

A timer 28 counts time intervals and provides operation clock pulses for the entire personal computer 20. By counting the clock pulses, the personal computer 20 counts a predetermined time and, upon counting-up of the predetermined time carries out timer interrupt processing.

According to this embodiment, in addition to the mouse 2A and switch panel 2B of the personal computer 20, the keys on the keyboard of the electronic musical instrument 1F can work as an operating member for selecting, setting and controlling the functions of the personal computer 20. This is achieved by transmitting a note number corresponding to the key depression state on the keyboard over to the CPU 21 of the personal computer 20 via the MIDI interfaces 1D and 2C.

Figure 6:
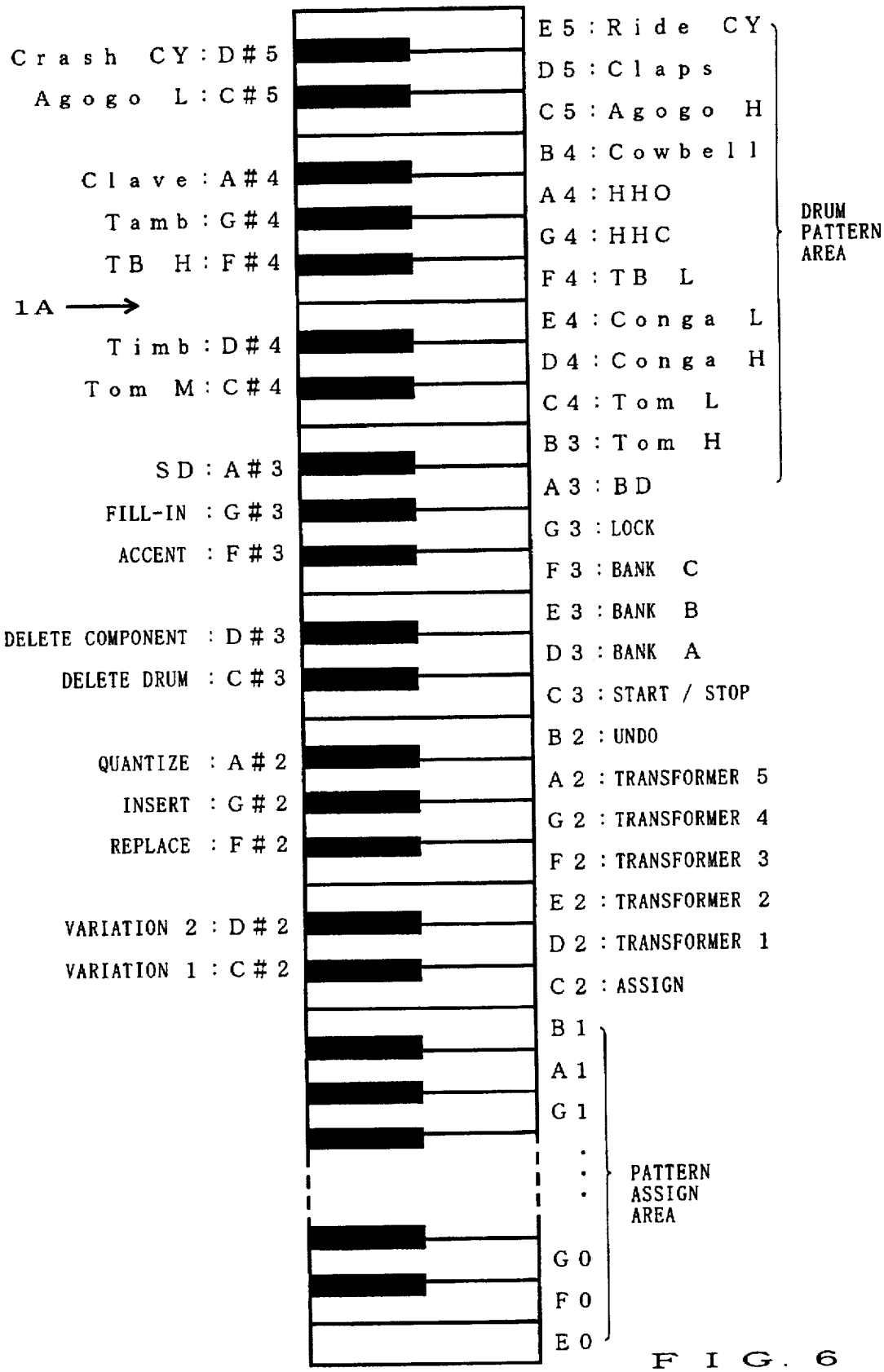
FIG. 6 is a diagram illustrating an example of various functions assigned to a keyboard of FIG. 1.

FIG. 6 illustrates an example of various functions assigned to the individual keys on the keyboard.

In the illustrated example, the keyboard, which has a total of 61 keys, is divided into a pattern assign area, an operating member area and a drum pattern area. The keys of note numbers E0–B1 form the pattern assign area, the keys of note numbers C2–G#3 form the operating member area, and the keys of note numbers A3–E5 form the drum pattern area.

The keys of note numbers E0–B1 generate addresses which correspond to an assign memory area for storing each rhythm pattern that has been made by the edit or transformer processes as a new rhythm pattern. Namely, the assign memory area in the RAM 23 is composed of an assign memory administration subarea having 20 addresses and pattern storage subareas capable of storing 20 patterns, and the addresses of the assign memory administration subarea correspond to note numbers E0–B1. For instance, note number E0 corresponds to the first address in the assign memory administration subarea, and similarly note numbers F#0–B1 correspond to the third to twentieth address in the subarea. In each of the addresses in the assign memory administration subarea, there is stored the value of head address of the corresponding pattern storage subarea.

The keys of note numbers C2–G#3 function as various kinds of operating members for executing the edit and transformer processes. Therefore, note numbers C2–G#3 by themselves constitute key operation data indicating the operating member functions assigned to these keys.

More specifically, the key of note number C2 corresponds to an assign key; the keys of note numbers D2, E2, F2, G2 and A2 correspond to transformer keys for designating transformers 1–5; the key of note number B2 to an undo designation key; and the key of note number C3 to a start/stop key. Further, the keys of note numbers D3, E3 and F3 correspond to bank keys for designating banks A–C; the key of note number G3 to a pattern-establishing lock key; the keys of note numbers C#2 and D#2 to variation keys for designating variations 1 and 2; the key of note number F#2 to a replace input key; the key of note number G#2 to an insert input key; and the key of note number A#2 to a quantize processing designation key. Furthermore, the key of note number C#3 corresponds to a delete drum instruction key; the key of note number D#3 to a delete component instruction key; the key of note number F#3 to an accent input key; and the key of note number G#3 to a fill-in designation key.

The detail of the processing performed in response to the actuation of these keys will be described later.

The keys of note numbers A3–E5 in the drum pattern area of the keyboard function as drum sound designation keys. Therefore, the note numbers A3–E5 by themselves constitute drum sound data indicative of the kind of drum sounds assigned to these keys.

More specifically, the key of note number A3 corresponds to a sound of bus drum (BD); the key of note number A#3 to a sound of snare drum (SD); the key of note number B3 to a sound of tom tom high (Tom H); the key of note number C4 to a sound of tom tom low (Tom L); the key of note number C#4 to a sound of tom tom middle (Tom M); the key of note number D4 to a sound of conga high (Conga H); and the key of note number E4 to a sound of conga low (Conga L). Further, the key of note number D#4 corresponds to a sound of timbales (Timb); the key of note number F4 to a sound of temple block (i.e., wooden drum used in temples) low (TB L); the key of note number F#4 to a sound of temple block high (TB H); the key of note number G4 to a sound of closed high hat cymbals (HHC); the key of note number A4 to a sound of open high hat cymbals (HHO); the key of note number G#4 to a sound of tambourine (Tamb); the key of note number A#4 to a sound of claves (Clave); and the key of note number B4 to a sound of cowbell (Cowbell). Furthermore, the key of note number C5 to a sound of agogo high (Agogo H); the key of note number C#5 to a sound of agogo low (Agogo L); the key of note number D5 to a sound of hand claps (Claps); the key of note number D#5 to a sound of crash cymbals (Crash CY); and the key of note number E5 to a sound of ride cymbals (Ride CY).

Each of the drum sounds can be designated independently of the others, but, in this embodiment, it is used as a component with any of other drum sounds selected to realize a desired form of performance. Accordingly, some components may comprise only one of the drum sounds and other components may comprise a plurality of the drum sounds. In the case of a component comprising a plurality of the drum sounds, it is necessary that a certain common characteristic (musical relevancy) be present between the drum sounds constituting the component. For instance, such a component is formed by each of the following combinations: bus drum (BD) and snare drum (SD); tom tom high (Tom H), tom tom middle (Tom M) and tom tom low (Tom L); conga high (Conga H), conga low (Conga L) and timbales (Timb); temple block high (TB H) and temple block low (TB L); open high hat cymbals (HHO) and closed high hat cymbals (HHC); and agogo high (Agogo H) and agogo low (Agogo L). Therefore, in this example, each of the drum sounds of tambourine (Tamb), claves (Clave), cowbell (cowbell), hand claps (Claps), crash cymbals (Crash CY) and ride cymbals (Ride CY) forms a component by itself.

Alternatively, any other components may of course be formed by combinations such as: tambourine (Tamb) and claves (Clave); cowbell (Cowbell) and hand claps (Claps); and crash cymbals (Crash CY) and ride cymbals (Ride CY) etc.

Figure 2:
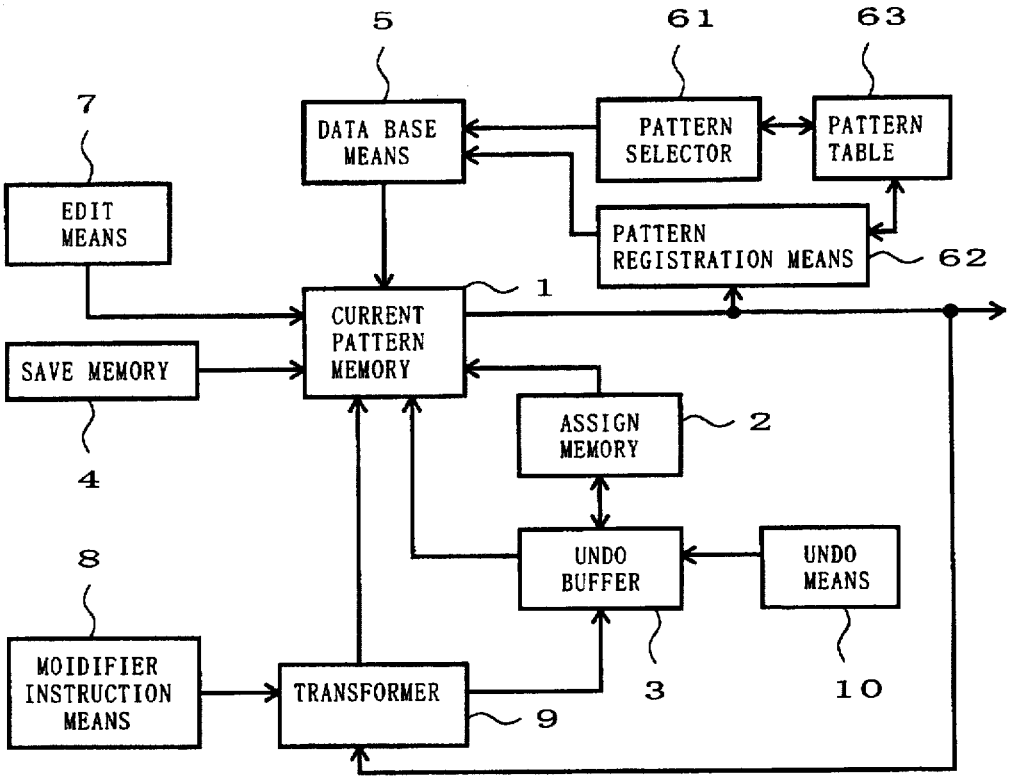
FIG. 2 is a functional block diagram illustrating a case where the electronic musical instrument and personal computer together function as an accompaniment pattern making device.

FIG. 2 is a functional block diagram illustrating in the case where the electronic musical instrument 1F and personal computer 20 shown in FIG. 1 cooperatively work as an accompaniment pattern making device.

The operation of the accompaniment pattern making device of FIG. 2 centers around a current pattern memory 1. The personal computer 20 carries out the automatic performance processing by sequentially reading out rhythm patterns from the current pattern memory 1.

The current pattern memory 1, assign memory 2, undo buffer 3 and save memory 4 in FIG. 2 correspond to predetermined areas in the RAM 23 shown in FIG. 3.

A data base means 5 corresponds to the hard disk device 24 of FIG. 1 and has many rhythm pattern data stored therein as shown in FIG. 3.

A pattern selector 61 corresponds to the drum sound designating keys A3, A#3, B3, . . . , E5 in the drum pattern area and the bank designating keys of note numbers D3, E3 and F3.

Thus, once a desired component within the data base is selected by means of the pattern selector 61, the accompaniment pattern making device reads out the corresponding rhythm pattern data from the data base means 5 and passes the read-out data to the current pattern memory 1. In this embodiment, the selection of a desired component is made by the operation of the pattern selector 61, i.e., keyboard, and a component is designated which corresponds to the note number generated by the operation of the keyboard. Each component has plural rhythm patterns as previously mentioned, and, in this embodiment, a selection as to which rhythm pattern of the designated component is to be read out is made depending on the magnitude of velocity data resulting from the keyboard operation.

Namely, as previously mentioned, the head addresses of the individual rhythm pattern data forming the banks A, B and C within the data base 5 are sequentially recorded in the pattern table 63, using as serial addresses corresponding to the degrees of rhythm pattern complexity. Therefore, by relating velocity data generated in response to actuation of the pattern selector 61 to the addresses of the pattern table 63, the head address of rhythm pattern data which differs in degree of complexity depending on the magnitude of the velocity data value can be supplied to the pattern selector 61. The pattern selector 61 reads out rhythm pattern data stored at the address in the data base means 5 designated by the head address, and passes the read-out data to the current pattern memory 1. The rhythm pattern data thus passed from the base means 5 is stored in the current pattern memory 1 as a current pattern, and the current pattern will be subjected to various modifications by edit means 7 and a transformer 9.

The edit means 7 corresponds to the replace input key of note number F#2, insert input key of note number G#2, quantize processing designation key of note number A#2, delete drum instruction key of note number C#3, delete component instruction key of note number D#3 and accent input key of note number F#3 which are all provided on the keyboard shown in FIG. 2.

Throughout the specification, the term "replace input" is used to mean replacing original note event data of the current pattern with new note event data and then storing only the new note event data. The term "insert input" is used to mean additionally storing new note event data to original note event data of the current pattern. The term "quantize" is used to mean fitting the timing of a note event to predetermined reference timing. Further, the term "accent" is used to mean re-accenting any of the drum sounds of the current pattern which corresponds to a depressed key on the keyboard. The term "delete drum" is used to mean deleting only any of the drum sounds of the current pattern which corresponds to a depressed key on the keyboard. Furthermore, the term "delete component" is used to mean deleting every one of the drum sounds of the current pattern which forms a component corresponding to a depressed key on the keyboard.

A modifier instruction means 8 corresponds to the transformer designation keys of note numbers D2, E2, F2, G2, A2 on the keyboard of FIG. 1.

The transformer 9 corresponds to transformer programs stored in the ROM 22 of FIG. 1. The contents of the current pattern are transformed in accordance with a modifier instructed by the modifier instruction means 8 corresponding to the transformer instruction keys. By only instructing such a modifier, the transformer 9 is caused to form a pattern having a desired image.

An undo means 10 corresponds to the undo key of note number B2 on the keyboard of FIG. 1.

The pattern modified by the transformer 9 is stored in the undo buffer 3, so that if a desired pattern has not been obtained as the result of modification, the original pattern can be retrieved. Namely, because all modified patterns are sequentially stored into the undo buffer 3 in the order in which they have been modified, the original pattern can be retrieved by sequentially reading backwardly the undo buffer 3.

In this way, the current pattern having been formed by modification or addition of a new pattern can be stored into the assign memory 2, and the pattern stored in the assign memory 2 can be read out at any time by actuating any of the keys in the pattern assign area on the keyboard.

A pattern registration means 62 corresponds to a pattern registering operator on the switch panel of FIG. 1.

The pattern registration means 62 registers the current pattern contained in the current pattern memory 1, which has been subjected to various modifications by the edit means 7 and transformer 9, into the data base means 5 as new rhythm pattern data. At this time, the pattern registration means 62 detects the degree of complexity of the rhythm pattern data newly registered in the data base means and rearrange the order of the data within pattern table 63 in accordance with the detected degree of complexity, to thereby renew the pattern table 63.

The pattern table rearrangement will be explained assuming a case where a tom tom rhythm pattern Tom having the degree of complexity "20" as shown in FIG. 5 is newly registered in the disco music pattern table of bank B in the data base means 5. First, the pattern registration means 62 registers the tom tom rhythm pattern Tom into address "B-n1" of the data base means 5 and detects the degree of complexity of the rhythm pattern Tom. Since the degree of complexity of the rhythm pattern Tom is "20", the pattern registration means 62 moves each of the head addresses "C-1, B-3, C-2, C-3, . . . , B-n" at and after address "3" of the disco music pattern table backward by one address, and then newly registers the head address of the tom tom rhythm pattern Tom into address "3" of the table.

Now, various processing carried out by the CPU 11 of the electronic musical instrument 1F of FIG. 1 will be described with reference to FIG. 7.

Figure 7A:
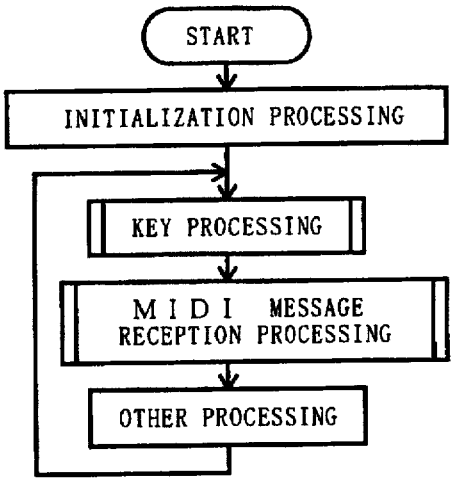
FIG. 7A is a flowchart illustrating an example of a main routine carried out by a CPU of the electronic musical instrument of FIG. 1.

In FIG. 7A, there is illustrated an example of main routine carried out by the CPU 11.

First, upon power-on, the CPU 11 starts executing processing in accordance with control programs stored in the ROM 12. In initialization processing, various registers and flags provided within the RAM 13 are initialized. After that, the CPU 11 repetitively carries out key processing, MIDI massage reception processing and other processing in response to occurrences of respective events.

Figure 7B:
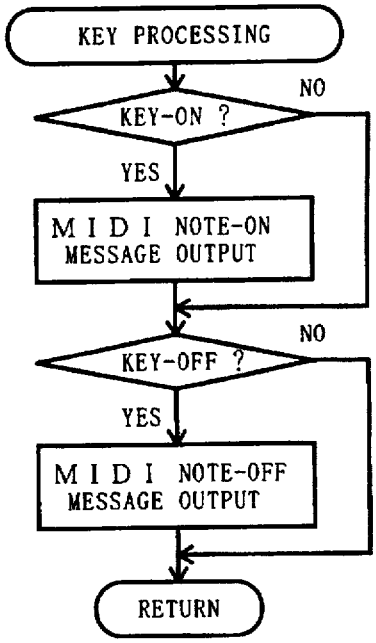
FIG. 7B is a flowchart illustrating a detailed example of key processing of FIG. 7A.

FIG. 7B illustrates the detail of the key processing of FIG. 7A.

In the key processing, it is determined whether the operational state of the keyboard is a key-on state or a key-off state. Then, depending on the determination result, a MIDI note-on or note-off message is supplied via the MIDI interfaces 1D and 2C to the personal computer 20. This embodiment is designed in such a manner that, even when the keyboard is operated, processing in the electronic musical instrument itself, i.e, processing in the tone source circuit 17 is not triggered; thus, the tone source circuit 17 does not start its tone generation processing at the time of this key processing.

Figure 7C:
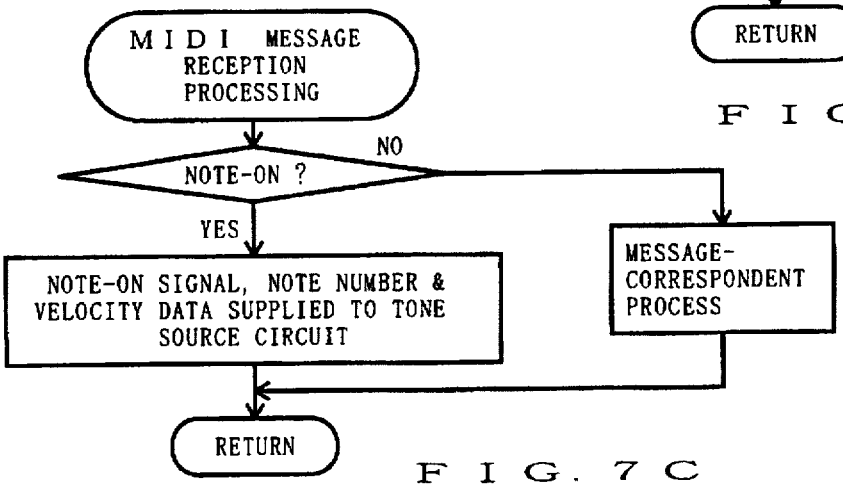
FIG. 7C is a flowchart illustrating a detailed example of MIDI message reception processing of FIG. 7A.

FIG. 7C illustrates the detail of the MIDI message reception processing of FIG. 7A.

The MIDI message reception processing is carried out each time a MIDI message is received from the personal computer 20 via the MIDI interfaces 2C and 1D. In this MIDI message reception processing, it is determined whether the received MIDI message is a note-on message or not. If the received message is a note-on message (i.e., the determination result is YES), the note-on signal, note number, velocity data and note-on signal are supplied to the tone source circuit 17, so as to cause the circuit 17 to generate a tone. If, on the other hand, the received MIDI is a note-off message (NO), the program returns to the main routine of FIG. 7A after performing a message-correspondent process corresponding to the received MIDI message.

In the other processing of FIG. 7A, various other processes than the above-mentioned are executed which include such operations responsive to the actuation of other operating members on the switch panel 1B.

Next, various processing carried out by the CPU 21 in the personal computer 20 of FIG. 1 will be described with reference to FIGS. 8 to 17.

Figure 8A:
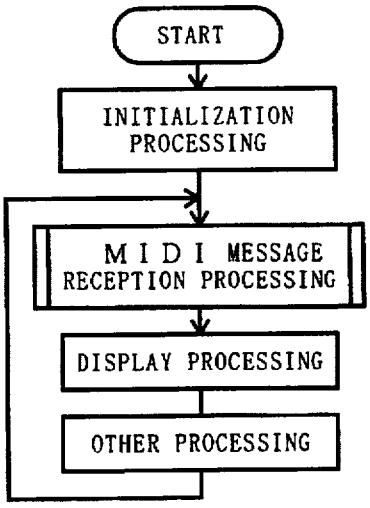
FIG. 8A is a flowchart illustrating an example of a main routine carried out by a CPU of the personal computer of FIG. 1.

In FIG. 8A, there is illustrated an example of main routine carried out by the CPU 21.

First, upon power-on, the CPU 21 starts executing processing in accordance with the control programs stored in the ROM 22. In initialization processing, various registers and flags provided within the RAM 23 are initialized. After that, the CPU 21 carries out MIDI massage processing, display processing and other processing.

Figure 8B:
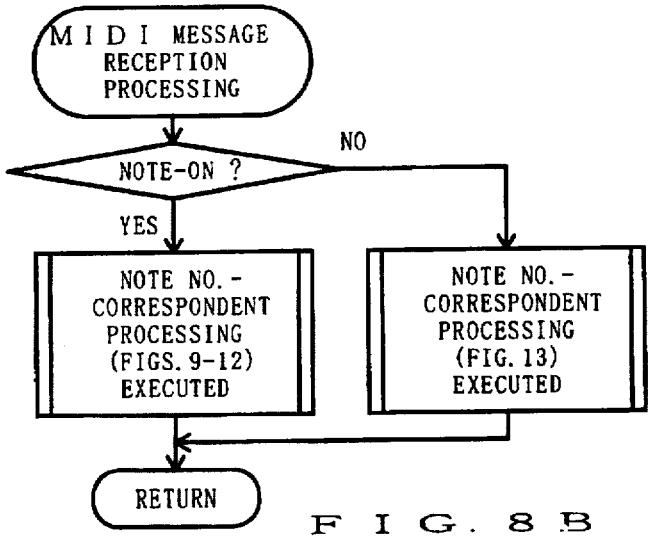
FIG. 8B is a flowchart illustrating a detailed example of the MIDI message reception processing of FIG. 8A.

FIG. 8B illustrates the detail of the MIDI message reception processing of FIG. 8A.

This MIDI message reception processing is carried out each time a MIDI message is received from the electronic musical instrument 1F via the MIDI interfaces 1D and 2C. In this processing, it is determined whether the received MIDI message is a note-on message or not. If the received message is a note-on message (YES), processing as shown in FIGS. 7A to 10 is carried out which corresponds to the key-on note number (processing of FIGS. 9 to 12 to be detailed later). If, on the other hand, the determination is in the negative (NO), processing as shown in FIGS. 1 and 11B is carried out which corresponds to the key-off note number (processing of FIG. 13 to be later detailed).

Figure 21:
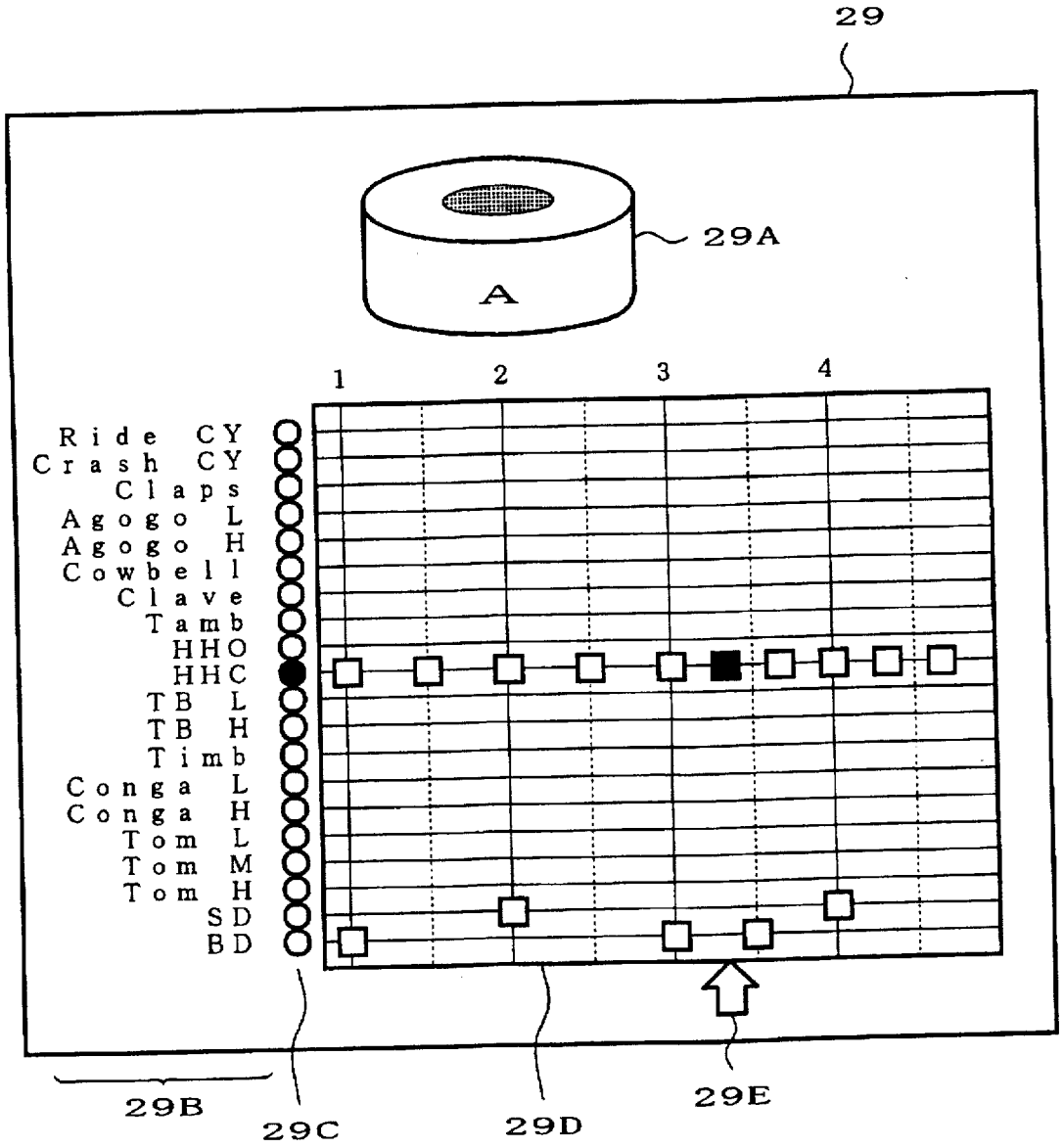
FIG. 21 is a diagram illustrating an example of video information shown on a display of FIG. 1.

In the display processing, such an operation is carried out for showing on the display 29 which of the banks in the data base means 5 is being processed and showing on the display 29 the kind of drum sound being performed and also showing which part of the current pattern is being performed. That is, video information as shown in FIGS. 5 and 21 isdisplayed on the screen.

Figure 17:
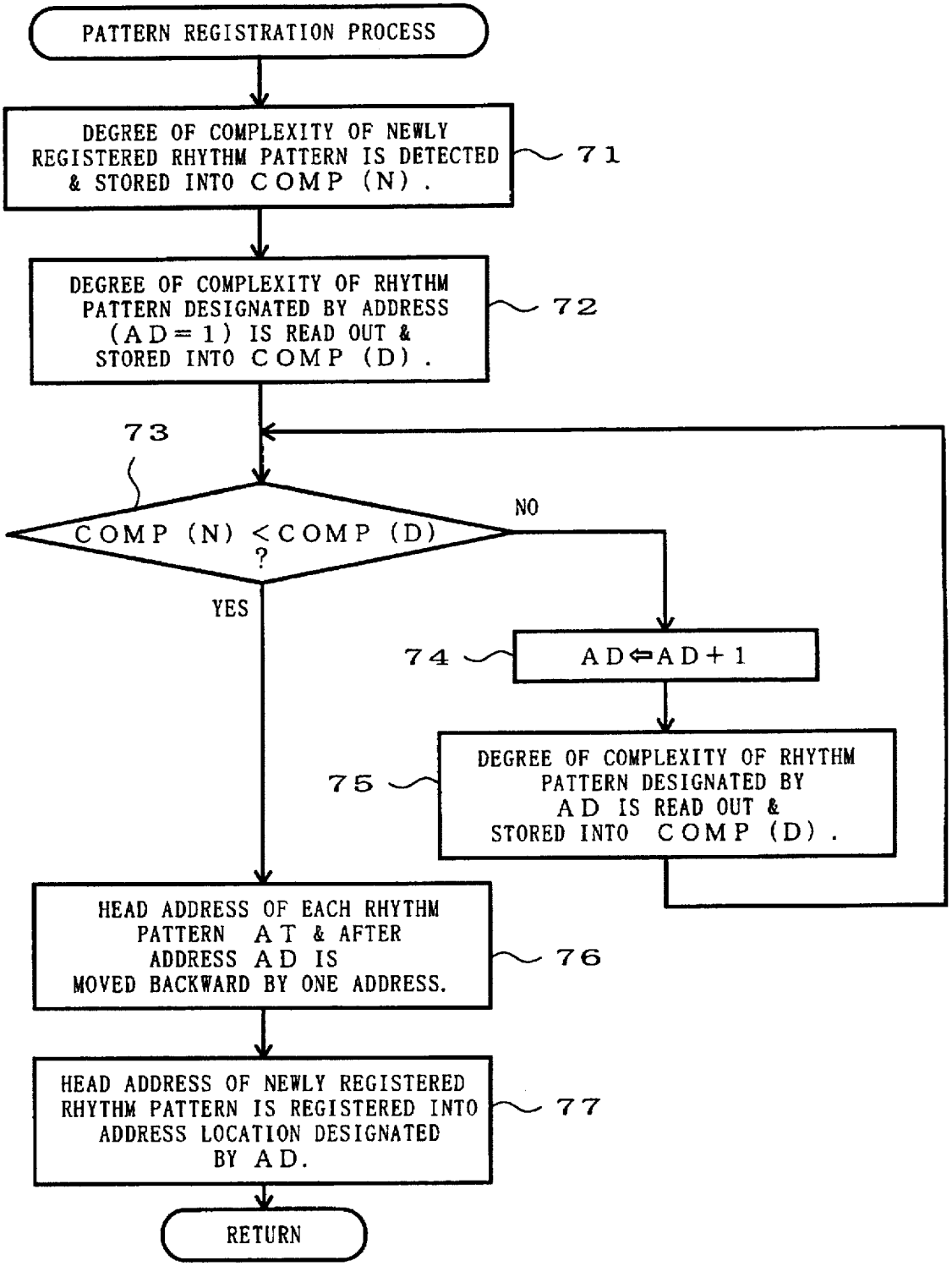
FIG. 17 is a flowchart illustrating a detailed example of a pattern registration process contained in other processing of FIG. 8, which is carried out by the CPU of the personal computer of FIG. 1.

In the other processing are performed operations based on the actuation of any of the other operators on the switch panel 2B and various other operations. In particular, pattern registration processing of FIG. 17 is performed in response to actuation of the pattern registration operator on the switch panel 2B, as will be later described in detail.

FIGS. 9 to 12 illustrate the detail of note-number-correspondent processing of FIG. 8B which is carried out in such a case where the received MIDI message is a note-on message.

Figure 9A:
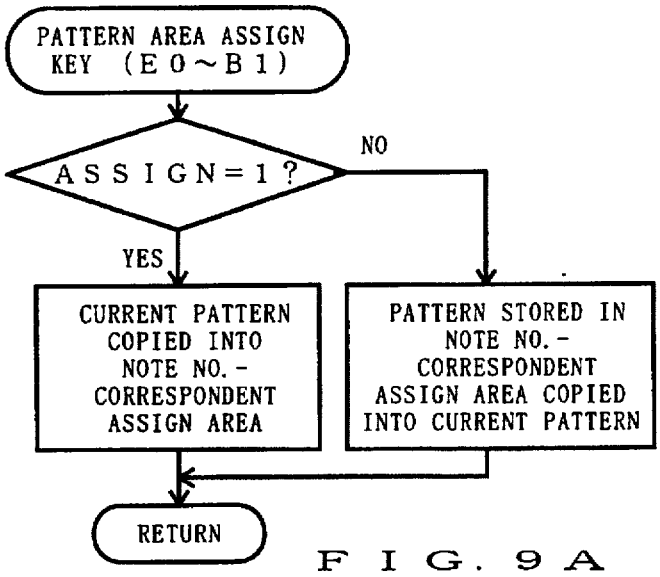
FIG. 9A is a flowchart illustrating a detailed example of the MIDI message reception processing of FIG. 8B which is carried out in such a case where a received MIDI message is a note-on message corresponding to any of pattern assign area keys of note numbers E0 to B1.

FIG. 9A shows pattern assign area key processing that is carried out when a MIDI message containing any of note numbers E0 to B1 is received from the electronic musical instrument 1F, in response to actuation of the pattern assign are keys corresponding to note numbers E0 to B1.

In this pattern assign area key processing, it is first determined whether assign flag ASSIGN is at high level "1", and then processing is carried out depending on the determination result.

Figure 9B:
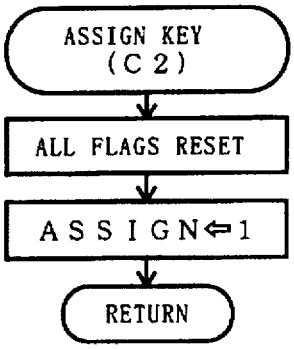
FIG. 9B is a flowchart illustrating a detailed example of the MIDI message reception processing of FIG. 8B which is carried out in such a case where the received MIDI message is a note-on message corresponding to an assign key of note number C2.

More specifically, the assign flag ASSIN is set to high level "1" by assign key processing of FIG. 9B when key-on operation has been made of the assign key (key of note number C2), but the flag ASSIGN is set to low level "0" by processing of FIG. 1 if key-off operation has been made of the assign key. Accordingly, if it has been ascertained that the assign flag ASSIGN is at high level "1" (the determination result is YES), this means that one of the keys in the pattern assign area and the assign key have been depressed simultaneously, and thus, the current pattern in the current pattern memory 1 is copied into the assign memory area of the assign memory 2 which corresponds to the note number, and then the program returns to the main routine.

If, on the other hand, it has been ascertained that the assign flag ASSIGN is at low level "0" (the determination result is NO), this means that one of the keys in the pattern assign area alone has been operated, and thus, the rhythm pattern stored in the assign memory area of the assign memory 2 which corresponds to the note number of the operated key is copied into the current pattern memory 1.

Namely, if any of the keys in the pattern assign area has been actuated while the assign key is depressed, the rhythm pattern data then stored in the current pattern memory 1 is registered for the operated key in the pattern assign area. If, however, only any of the keys in the pattern assign area has been operated singly, the rhythm pattern previously registered for that key is read into the current pattern memory 1.

Processing shown in FIG. 9B is assign key processing that is carried out when actuation has been made of the assign key on the keyboard which corresponds to note number C2 and a MIDI message containing such note number C2 has been received from the electronic musical instrument 1F.

In this assign key processing, all associated flags are reset to low level "0", the assign flag ASSIGN is set to "1", and then the program returns to the main routine.

Figure 9C:
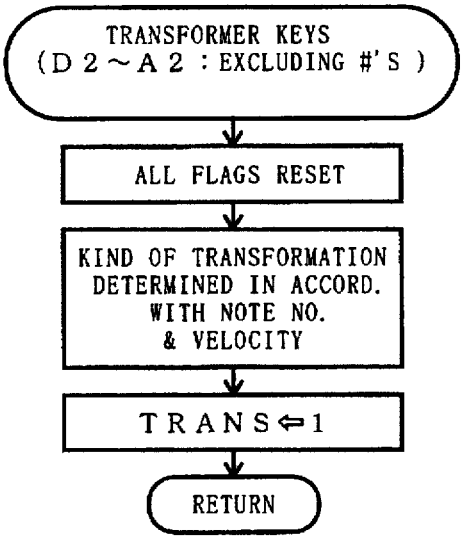
FIG. 9C is a flowchart illustrating a detailed example of the processing of FIG. 8B which is carried out in such a case where the received MIDI message is a note-on message corresponding to any of transformer keys of note numbers D2 to A2 (excluding #'s)

Processing shown in FIG. 9C is transformer key processing that is carried out when actuation has been made of any of the transformer keys on the keyboard which correspond to any of note numbers D2–A2 (excluding #'s) and a MIDI message containing any of note numbers D2–A2 (excluding #'s) has been received from the electronic musical instrument 1F.

The fact that a MIDI message containing any of note numbers D2–A2 (excluding #'s) has been received from the electronic musical instrument 1F means that some kind of transformer modifier has been instructed. Therefore, in this transformer key processing, all associated flags are reset to low level "0" and the kind of transformer modifier is determined on the basis of the note number and velocity data. After that, transformer flag TRANS is set to "1", and then the program returns to the main routine.

In this embodiment, two modifiers are allotted to each of transformers 1–5, and either one of the two allotted modifiers is selected depending on the magnitude of velocity data. For instance, modifiers "Complex" and "Simple" representing complexing and simplifying processing respectively are allotted to transformer 1, "Hard" and "Soft" representing hardening and softening processing are allotted to transformer 2, and "Energetic" and "Calm" representing energizing and calming processing are allotted to transformer 3. Further, "Mechanical" and "Graceful" representing mechanizing and gracing processing are allotted to transformer 4, and "Stuttering" and "Floating" representing stuttering and floating processing are allotted to transformer 5.

For each of transformers 1–5, the first-said modifier is selected when the magnitude of velocity data is equal to or smaller than a predetermined value, and the second-said modifier is selected when the magnitude of velocity data is greater than the predetermined value.

Figure 16A:
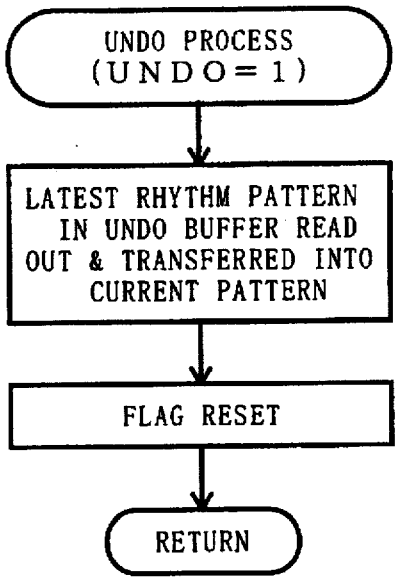
FIG. 16A is a flowchart illustrating a detailed example of an undo process which is performed in second flag-correspondent processing (step 43) of FIG. 14.
Figure 16B:
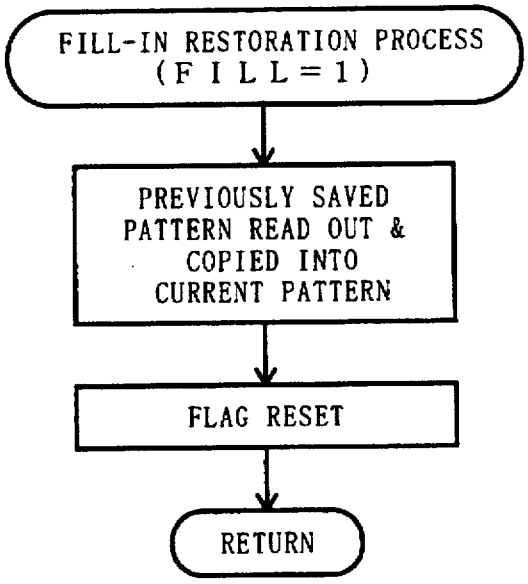
FIG. 16B is a flowchart illustrating a detailed example of a fill-in restoration process which is performed in the second flag-correspondent processing of FIG. 14.
Figure 16C:
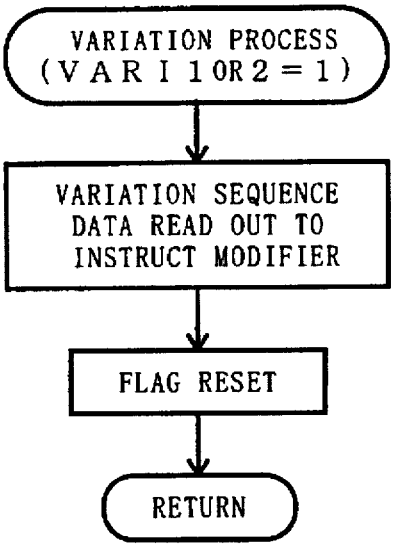
FIG. 16C is a flowchart illustrating a detailed example of a variation process which is performed in the second flag-correspondent processing of FIG. 14.
Figure 16D:
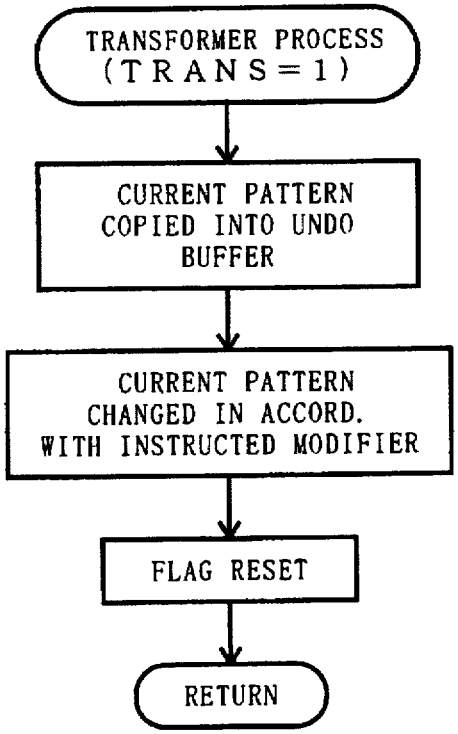
FIG. 16D is a flowchart illustrating a detailed example of a transformer process which is performed in the second flag-correspondent processing of FIG. 14.

When the transformer flag TRANS is at high level "1", transformer 9 executes transformer key processing of FIG. 16D to change the contents of the current pattern in accordance with the selected modifier.

Each of the processing represented by the above-mentioned modifiers will be described below.

The complexing processing (Complex) is done in either of the following two styles. In the first style, the complexing processing is achieved by searching through the data base means 5 for a triplet note pattern corresponding to a preselected pattern prototype called "template" and then adding the searched-out note pattern to the current pattern. In the second style, the complexing processing is achieved by randomly extracting from the data base means 5 such drum sound which constitutes a non-crash component and then adding the extracted drum sound to the current pattern.

The simplifying processing (Simple) is done in any of the following three styles. In the first style, the simplifying processing is achieved by searching through the data base means 5 for a rhythm pattern which is closer to a basic rhythm pattern than that of bus drum (BD) and snare drum (SD) of the current pattern, and then replacing the current pattern with the searched-out rhythm pattern. In the second style, the simplifying processing is achieved by searching through the data base means 5 for a rhythm pattern which is closer to a basic rhythm pattern than that of high hat (HHC, HHO) in the current pattern, and then replacing the current pattern with the searched-out rhythm pattern. In the third style, the simplifying processing is achieved by removing, from the current pattern, rhythm pattern of a component comprising drum sounds other than those of the above-mentioned bus drum (BD), snare drum (SD) or high hat (HHC, HHO).

The hardening processing (Hard) is done in either of the following two styles. In the first style, the processing is achieved by uniformly increasing the value of all the velocity data of the rhythm pattern in the current pattern. In the second style, the processing is achieved by changing the drum sounds in the current pattern from those of a softening component to those of a hardening component.

Here, among such drum sounds forming the hardening component are bus drum (BD), snare drum (SD), tom tom (Tom H, Tom M, Tom L), cowbell (Cowbell), agogo (Agogo H, Agogo L), hand claps (Claps) and crash cymbals (Crash CY), while among such drum sound forming the softening component are claves (Clave), tambourine (Tamb), high hat (HHC, HHO), ride cymbals (CY), conga (Conga H, Conga L), wood block and shaker. Wood block and shaker are listed here just by way of example as the softening component forming drum sound, although they are not actually allotted to the keyboard in this embodiment.

The softening processing (Soft) is done in either of the following two styles. In the first style, the processing is achieved by uniformly decreasing the value of all the velocity data of the rhythm pattern in the current pattern. In the second style, the processing is achieved by changing the drum sounds in the current pattern from those of a hardening component to those of a softening component.

Further, the energizing processing (Energetic) is done in any of the following three styles. In the first style, the processing is achieved by increasing the number of template-based note patterns within the current pattern. In the second style, the processing is achieved by causing the tempo speed to approach about "120". In the third style, the processing is achieved by causing the rhythm pattern in the current pattern to approach a triplet rhythm pattern on the basis of the template (shuffling process).

The calming processing (Calm) is done in any of the following three styles. In the first style, the processing is achieved by decreasing the number of template-based note patterns within the current pattern. In the second style, the processing is achieved by causing the tempo speed to approach an approximate value of "60". In the third style, the processing is achieved by causing the rhythm pattern in the current pattern to approach a non-triplet rhythm pattern on the basis of the template (non-shuffling process).

Furthermore, the mechanizing processing (Mechanical) is done in any of the following four styles. In the first style, the processing is achieved by quantizing the rhythm pattern in the current pattern to within a resolution of sixteenth note. In the second style, the processing is achieved by, on the basis of a template for bus drum (BD) or snare drum (SD), quantizing the rhythm pattern in the current pattern to within a resolution of eighth note. In the third style, the processing is achieved by changing the drum sounds in the current pattern from those of a softening component to those of a hardening component. In the fourth style, the processing is achieved by compressing the velocity data to a value centering around "90".

Furthermore, the gracing processing (Graceful) is done in any of the following four styles. In the first style, the processing is achieved by extending the velocity data in opposite directions about a value of 64. In the second style, the processing is achieved by adding triplet note pattern to the current pattern on the basis of a template. In the third style, the processing is achieved by changing the drum sounds in the current pattern from those of a hardening component to those of a softening component. In the fourth style, the processing is achieved by applying flutter (decorative sound) to the drum sound in the current pattern.

Moreover, the stuttering processing (Stuttering) is done in either of the following two styles. In the first style, the processing is achieved by, on the basis of a template, replacing downbeat in the rhythm pattern of the current pattern with upbeat (syncopation process). In the second style, the processing is achieved by adding triplet note pattern to the current pattern on the basis of a template.

Finally, the floating processing (Floating) is done in any of the following five styles. In the first style, the processing is achieved by, on the basis of a template, replacing upbeat in the rhythm pattern of the current pattern with downbeat (non-syncopation process). In the second style, the processing is achieved by, on the basis of a template, decreasing the number of triplet note patterns in the current pattern. In the third style, the processing is achieved by, on the basis of a template, adding 12/8-triplet rhythm pattern to the current pattern. In the fourth style, the processing is achieved by changing the drum sounds in the current pattern from those of a hardening component to those of a softening component. In the fifth style, the processing is achieved by causing the tempo speed to approach to an approximate value of "120".

Figure 9D:
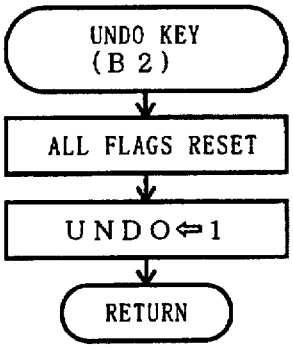
FIG. 9D is a flowchart illustrating a detailed example of the processing of FIG. 8B which is carried out in such a case where the received MIDI message is a note-on message corresponding to an undo key of note number B2.

The processing of FIG. 9D is undo key processing which is carried out when actuation has been made of the undo key corresponding to note number B2 on the keyboard and thus a MIDI message containing such note number B2 has been received from the electronic musical instrument In the undo key processing, all associated flags are first reset to low level "0" and then undo flag UNDO is set to "1", after which the program returns to the main routine.

When the undo flag UNDO is at high level "1", the undo means 10 executes an undo process as shown in FIG. 16A to read out one of the previous rhythm patterns and then copy the read-out rhythm pattern into the current pattern. In this way, if the pattern changed by the transformer 9 is not satisfactory, any desired previous rhythm pattern can be restored. Namely, because in this embodiment the undo buffer 3 sequentially stores a total of 20 rhythm patterns, it is possible to restore any desired previous pattern by reading backwardly the buffer 3 in response to actuation of the undo key.

Figure 9F:
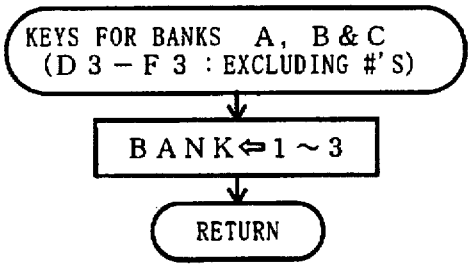
FIG. 9F is a flowchart illustrating a detailed example of the processing of FIG. 8B which is carried out in such a case where the received MIDI message is a note-on message corresponding to any of bank keys of note numbers D3 to F3 (excluding #'s)
Figure 9E:
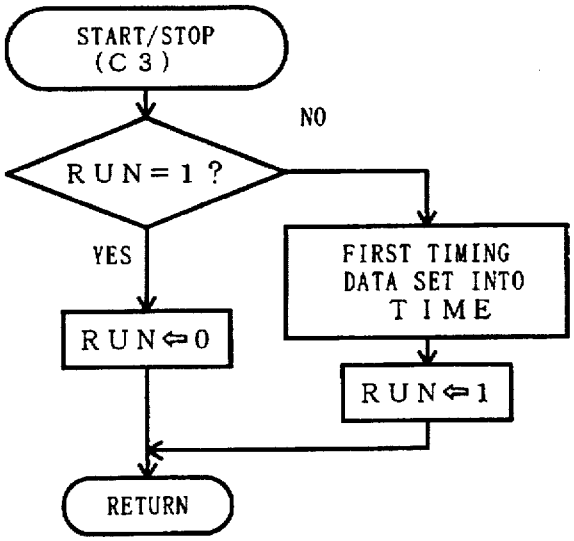
FIG. 9E is a flowchart illustrating a detailed example of the processing of FIG. 9B which is carried out in such a case where the received MIDI message is a note-on message corresponding to a start/stop key of note number C3.

Processing of FIG. 9E is start/stop key processing which is carried out when actuation has been made of the start/stop key corresponding to note number C3 on the keyboard and thus a MIDI message containing such note number C3 has been received from the electronic musical instrument 1F.

In this start/stop key processing, it is determined whether run state flag RUN is at high level "1", and different processing is executed depending on the determination result. The run state flag RUN indicates whether the current pattern is being read out from the current pattern memory 1.

Therefore, if it has been ascertained that the run state flag RUN is at high level "1" (YES), the flag RUN is set to low level "0" to stop reading, and then the program returns to the main routine. If it has been ascertained that the run state flag RUN is at low level "0" (NO), the first timing data in the current pattern memory 1 is set into timing register TIME to start reading and the run state flag RUN is set to high level "1", and then the program returns to the main routine. In response to this, current patterns are sequentially read out from the current pattern memory 1 by timer interrupt processing of FIG. 14.

The processing of FIG. 9F is bank key processing which is carried out when actuation has been made of one of the bank keys for banks A–C corresponding to note numbers D3–F3 (excluding #'s) on the keyboard and thus a MIDI message containing any of note numbers D3–F3 (excluding #'s) has been received from the electronic musical instrument 1F.

In this bank key processing, one of the values "1", "2" and "3" is stored into bank register BANK, and then the program returns to the main routine. According to the embodiment, "1" is stored when actuation has been made of the bank key for bank A corresponding note number D3, "2" is stored when actuation has been made of the bank key for bank B corresponding note number E3, and "3" is stored when actuation has been made of the bank key for bank C corresponding note number F3. In this manner, bank switching in the data base means 5 is effected depending on the bank key actuated. Then, when a component has been designated later, a specific rhythm pattern is read out from that bank and stored into the current pattern memory 1.

Figure 10A:
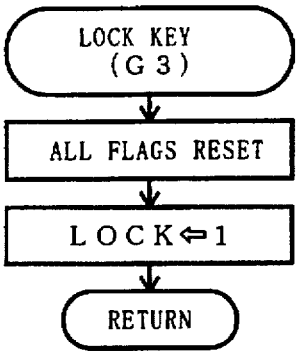
FIG. 10A is a flowchart illustrating a detailed example of the processing of FIG. 8B which is carried out in such a case where the received MIDI message is a note-on message corresponding to a lock key of note number G3.

FIG. 10A illustrates lock key processing which is carried out when actuation has been made of the lock key corresponding to note number G3 on the keyboard and thus a MIDI message containing that note number G3 has been received from the electronic musical instrument 1F.

In this lock key processing, all associated flags are reset to low level "0" and lock flag LOCK is set to high level "1", after which the program returns to the main routine.

The rhythm pattern read out from the data base means 5 is normally available or effective only when any of the keys in the drum pattern area is being operated, but by actuating this lock key, the contents of the rhythm pattern are made effective or locked so that the rhythm pattern remains available even after the key in the drum pattern area is released.

Figure 10B:
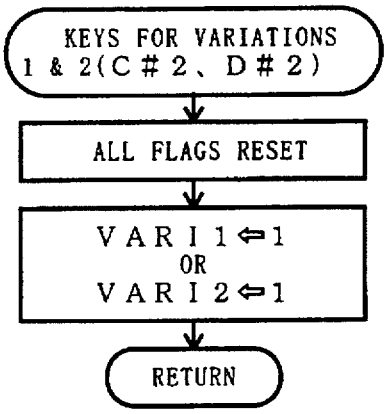
FIG. 10B is a flowchart illustrating a detailed example of the processing of FIG. 8B which is carried out in such a case where the received MIDI message is a note-on message corresponding to any of variation keys of note numbers C#2 and D#2.

FIG. 10B illustrates variation key processing which is carried out when actuation has been made of any of the keys for variations 1 and 2 corresponding to note numbers C#2 and D#2 on the keyboard and thus a MIDI message containing any of such note numbers C#2 and D#2 has been received from the electronic musical instrument 1F.

In this variation key processing, all associated flags are first reset to low level "0" and then variation flags VAR1 and VAR12 are set to high level "1", after which the program returns to the main routine. This causes a variation pattern (modifier sequence of FIG. 3) to be read out when the current pattern readout has advanced to a measure bar.

Figure 10C:
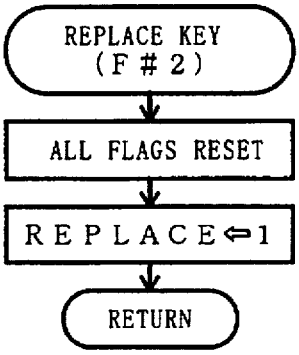
FIG. 10C is a flowchart illustrating a detailed example of the processing of FIG. 8B which is carried out in such a case where the received MIDI message is a note-on message corresponding to a replace key of note number F#2.

FIG. 10C illustrates replace key processing which is carried out when actuation has been made of the replace key corresponding to note number F#2 on the keyboard and thus a MIDI message containing such note number F#2 has been received from the electronic musical instrument 1F.

In this replace key processing, all associated flags are first reset to low level "0" and then replace flag REPLACE is set to high level "1", after which the program returns to the main routine. Consequently, when any of the keys in the drum pattern area has been actuated while the replace key is being depressed, processing of FIG. 11D is executed such that the corresponding drum sound is newly input to the position of the key operation timing, replacing the preceding corresponding drum sound.

Figure 10D:
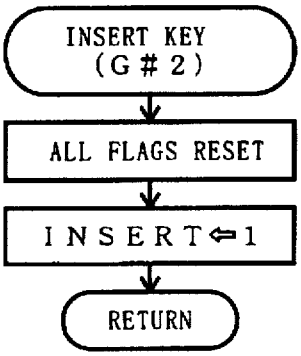
FIG. 10D is a flowchart illustrating a detailed example of the processing of FIG. 8B which is carried out in such a case where the received MIDI message is a note-on message corresponding to an insert key of note number G#2.

FIG. 10D illustrates insert key processing which is carried out when actuation has been made of the insert key corresponding to note number G#2 on the keyboard and thus a MIDI message containing such note number G#2 has been received from the electronic musical instrument 1F.

In this insert key processing, all associated flags are reset to low level "0" and then insert flag INSERT is set to high level "1", after which the program returns to the main routine. Consequently, when any of the keys in the drum pattern area has been actuated while the replace key is depressed,the corresponding drum sound is newly input to the position of the key operation timing. Thus, the new drum sound is added without the preceding drum sound being eliminated.

Figure 10E:
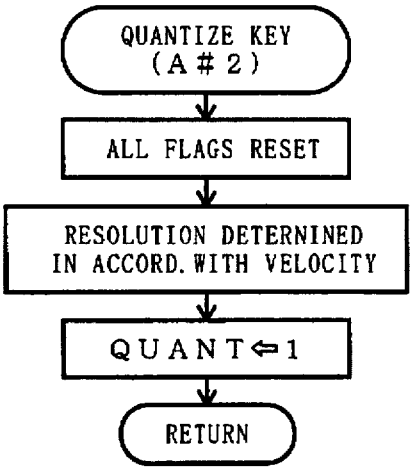
FIG. 10E is a flowchart illustrating a detailed example of the processing of FIG. 8B which is carried out in such a case where the received MIDI message is a note-on message corresponding to a quantize key of note number A#2.

FIG. 10E illustrates quantize key processing which is carried out when actuation has been made of the quantize key corresponding to note number A#2 on the keyboard and thus a MIDI message containing such note number A#2 has been received from the electronic musical instrument 1F. In this quantize key processing, all associated flags are reset to low level "0", a quantizing resolution is determined on the basis of a then-detected velocity data magnitude, and then quantize flag QUANT is set to high level "1". After that, the program returns to the main routine.

Consequently, once the current pattern readout has advanced to a measure line, a quantizing process is applied, in reading out rhythm patterns after the next measure line, to the data readout timing, without the data themselves being rewritten. Such processing is called quantize processing.

Figure 10F:
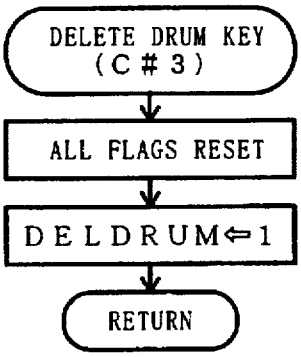
FIG. 10F is a flowchart illustrating a detailed example of the processing of FIG. 8B which is carried out in such a case where the received MIDI message is a note-on message corresponding to a delete drum key of note number C#3.

FIG. 10F illustrates delete drum key processing which is carried out when actuation has been made of the delete drum key corresponding to note number C#3 on the keyboard 1A and thus a MIDI message containing such note number C#3 has been received from the electronic musical instrument 1F.

In this delete drum key processing, all associated flags are reset to low level "0" and then delete drum flag DELDRUM is set to high level "1", after which the program returns to the main routine. Consequently, once a note-on message of, for example, note number C4 has been detected later, the drum sound corresponding to note number C4 (Tom Tom L) is eliminated from the current pattern.

Figure 11A:
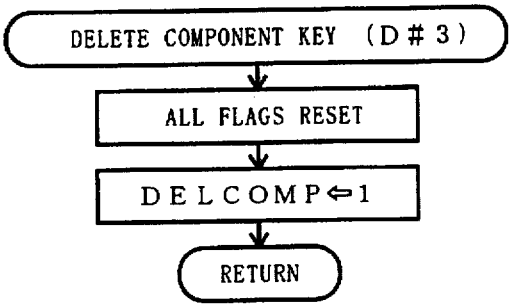
FIG. 11A is a flowchart illustrating a detailed example of the processing of FIG. 8B which is carried out in such a case where the received MIDI message is a note-on message corresponding to a delete component key of note number D#3.
Figure 11B:
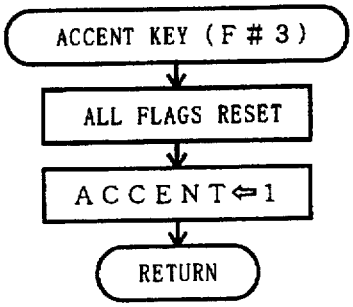
FIG. 11B is a flowchart illustrating a detailed example of the processing of FIG. 8B which is carried out in such a case where the received MIDI message is a note-on message corresponding to an accent key of note number F#3.

FIG. 11A illustrates delete component key processing which is carried out when actuation has been made of the delete component key corresponding to note number D#3 on the keyboard 1A and thus a MIDI message containing note number D#3 has been received from the electronic musical instrument 1F.

In this delete component key processing, all associated flags are reset to low level "0" and then delete component flag DELCOMP is set to high level "1", after which the program returns to the main routine. Consequently, once a note-on message of, for example, note number C4 has been detected later, all drum sounds of each component containing tom tom low (Tom L)) note number C4 (Tom Tom High (Tom H), tom tom middle (Tom M)) and tom tom low (Tom L)) are eliminated from the current pattern.

FIG. 11B illustrates accent key processing which is carried out when actuation has been made of the accent key corresponding to note number F#3 on the keyboard 1A and thus a MIDI message containing note number F#3 has been received from the electronic musical instrument 1F.

In this accent key processing, all associated flags are reset to low level "0" and then accent flag ACCENT is set to high level "1", after which the program returns to the main routine. Consequently, once a note-on message of, for example, note number C4 has been detected later and a note event of the same note number has been read out before a corresponding note-off message of the note number is detected, the velocity of the note event is rewritten into the note-on velocity of C4.

Figure 11C:
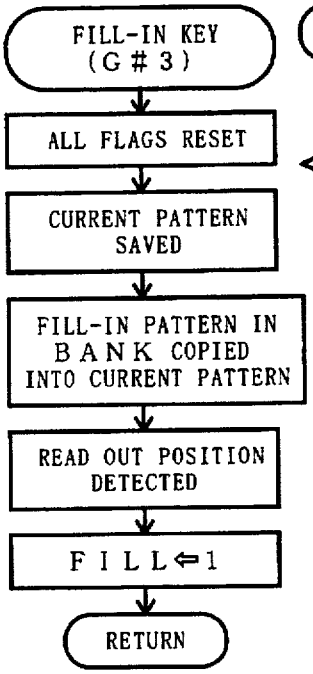
FIG. 11C is a flowchart illustrating a detailed example of the processing of FIG. 8B which is carried out in such a case where the received MIDI message is a note-on message corresponding to a fill-in key of note number G#3.
Figure 11D:
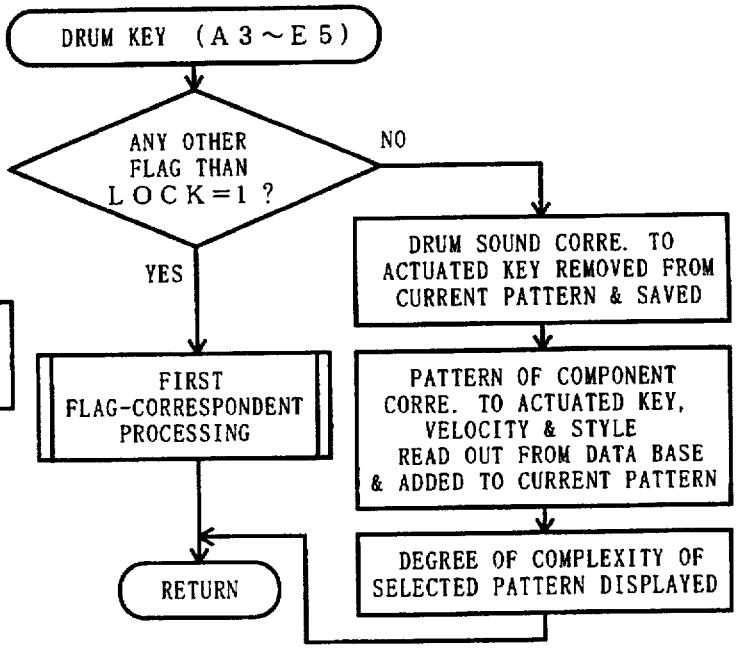
FIG. 11D is a flowchart illustrating a detailed example of the processing of FIG. 8B which is carried out in such a case where the received MIDI message is a note-on message corresponding to any of drum keys of note numbers A3 to E5.

FIG. 11C illustrates fill-in key processing which is carried out when actuation has been made of the fill-in key corresponding to note number G#3 on the keyboard 1A and thus a MIDI message containing note number G#3 has been received from the electronic musical instrument 1F.

In this fill-in key processing, all associated flags are reset to low level "0" and then the current pattern in the current pattern memory 1 is temporarily saved into the save memory 4. Subsequently, a fill-in pattern in the corresponding bank A, B, C in the data base means 5 is copied into the current pattern memory 1, and detection is made of its readout position (position in the pattern corresponding to the timing within the current measure). After that, fill-in flag FILL is set to high level "1", and then the program returns to the main routine. Consequently, the fill-in pattern is performed from the time of actuation of the fill-in key corresponding to note number G#3 through to the end of the measure.

FIG. 11D illustrates drum key processing which is carried out when actuation has been made of any of the keys in the drum pattern area corresponding to note numbers A3–E5 on the keyboard 1A and thus a MIDI message containing any of these note numbers A3–E5 has been received from the electronic musical instrument 1F.

In this drum key processing, it is determined whether any of the flags other than the lock flag LOCK (the replace flag REPLACE, insert flag INSERT, delete drum flag DELDRUM and delete component flag DELCOMP) is at high level "1", and different processing is executed depending on the determination result.

Namely, if the note number is one of A3–E5, this represents designation of a drum sound (single sound) or of a component. So, if it has been ascertained that any of the flags other than the lock flag LOCK is at high level "1" (YES), first flag-correspondent processing corresponding to the high level flag is carried out, and then the CPU returns to the main routine. The first flag-correspondent processing is illustrated in detail in FIG. 12.

It, on the other hand, it has been ascertained that none of the flags other than the lock flag LOCK is at high level "1"

(NO), one or more drum sounds of the component corresponding to the actuated drum pattern area key (note number) are removed from the current pattern and temporarily stored into the save memory 4. Then, rhythm pattern of the component corresponding to the actuated key (note number), velocity data and bank is read out from the data base means 5 and added to the current pattern.

The degree of complexity of the selected rhythm pattern is presented on the display as shown in FIG. 5.

Consequently, only by actuating one of the keys corresponding to A3–E5, it is allowed to selectively add the rhythm pattern of the component corresponding to the note number, in accordance with the magnitude of velocity data. Since, as previously mentioned, the pattern table 63 sequentially stores the head addresses of the rhythm patterns in such a manner that the pattern become more complex as the velocity value becomes greater as shown in FIG. 4, it is possible to finely select the kind of rhythm pattern.

FIG. 12 illustrates the detail of the first flag-correspondent processing which is carried out when any of the flags other than the lock flag LOCK, i.e., the replace flag REPLACE, insert flag INSERT, delete drum flag DELDRUM and delete component flag DELCOMP is at high level "1". The first flag-correspondent processing includes a replace process, insert process, delete drum process and delete drum process.

Figure 12A:
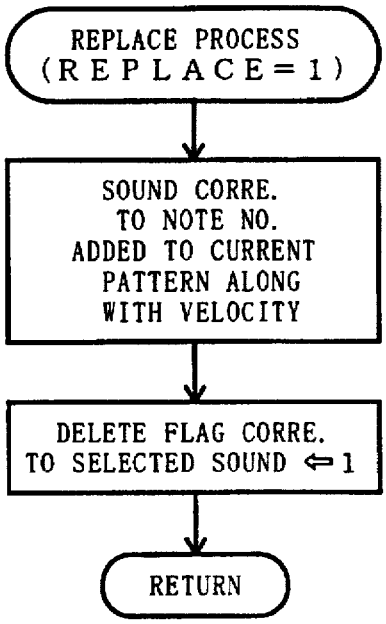
FIG. 12A is a flowchart illustrating a detailed example of a replace process which is performed in first flag-correspondent processing of FIG. 11D.

More specifically, FIG. 12A illustrates the replace process which is carried out when any of the keys in the drum pattern area has been actuated while the replace key corresponding to note number F#2 on the keyboard 1A is in the depressed, i.e., ON state. Namely, during the time when the replace key is in the depressed state, the replace flag REPLACE is set at high level "1" as the result of the replace key processing of FIG. 10C, and accordingly, it is ascertained in the drum key processing of FIG. 11D that the replace flag REPLACE other than the lock flag LOCK is at high level "1" Such an ascertainment in the drum key processing triggers this replace process.

In this replace process, the selected drum sound corresponding to the actuated key is added to the current pattern along with the associated velocity data. Subsequently, the delete flag corresponding to the selected drum sound is set to high level "1", and then the program returns to the drum key processing of FIG. 11D. The drum sound for which delete flag has thus been set to high level "1" is removed from the current pattern in step 56 of FIG. 15.

Figure 12B:
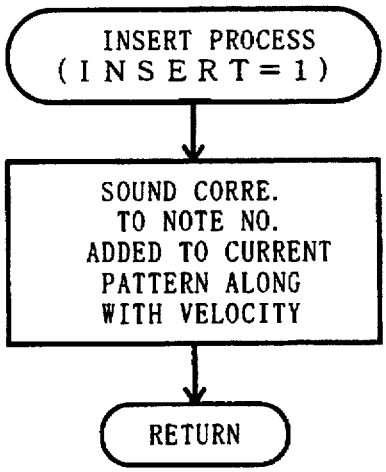
FIG. 12B is a flowchart illustrating a detailed example of an insert process which is performed in the first flag-correspondent processing of FIG. 11D.

FIG. 12B illustrates the insert process which is carried out when any of the keys in the drum pattern area has been actuated while the insert key corresponding to note number G#2 on the keyboard 1A is in the depressed state. Namely, during the time when the insert key is in the depressed state, the insert flag INSERT is set at high level "1" as the result of the insert key processing of FIG. 10D, and accordingly, it is ascertained in the drum key processing of FIG. 10D that the insert flag INSERT other than the lock flag LOCK is at high level "1". Such an ascertainment in the drum key processing triggers the insert process.

In this insert process, the selected drum sound corresponding to the actuated key is added to the current pattern along with the associated velocity data, and then the program returns to the drum key processing of FIG. 11D.

Figure 12C:
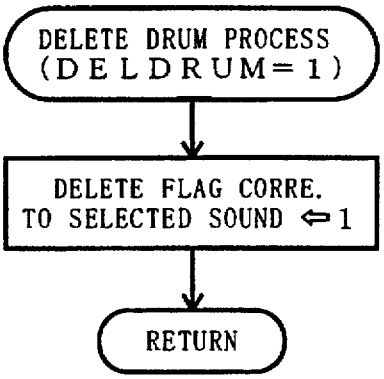
FIG. 12C is a flowchart illustrating a detailed example of a delete drum process which is performed in the first flag-correspondent processing of FIG. 11D.

FIG. 12C illustrates the delete drum process which is carried out when any of the keys in the drum pattern area has been actuated while the delete drum key corresponding to note number C#3 on the keyboard 1A is in the depressed state. Namely, during the time when the delete drum key is in the depressed state, the delete drum flag DELDRUM is set at high level "1" as the result of the delete drum key processing of FIG. 10F, and accordingly, it is ascertained in the drum key processing of FIG. 11D that the delete drum flag DELDRUM other than the lock flag LOCK is at high level "1". Such an ascertainment in the drum key processing triggers the delete drum process.

In this delete drum process, the delete flag corresponding to the selected drum sound is set to high level "1", and then the program returns to the drum key processing of FIG. 11D. The selected drum sound for which delete flag has thus been set to high level "1" is removed from the current pattern in step 54 of FIG. 15.

Figure 12D:
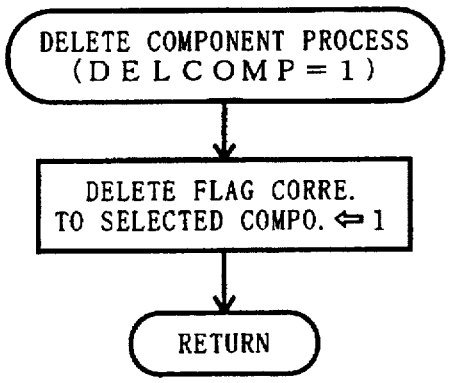
FIG. 12D is a flowchart illustrating a detailed example of a delete component process which is performed in the first flag-correspondent processing of FIG. 11D.

FIG. 12D illustrates the delete drum process which is carried out when any of the keys in the drum pattern area has been actuated to select a drum sound while the delete component key corresponding to note number D#3 on the keyboard 1A is in the depressed state. Namely, during the time when the delete component key is in the depressed state, the delete component flag DELCOMP is set at high level "1" as the result of the delete component key processing of FIG. 11A, and accordingly, it is ascertained in the drum key processing of FIG. 11D that the delete component flag DELCOMP other than the lock flag LOCK is at high level "1". Such an ascertainment in the drum key processing triggers the delete drum process.

In this delete drum process, the delete flag corresponding to a component containing the selected drum sound is set to high level "1", and then the program returns to the drum key processing of FIG. 11D. The drum sound forming the component for which delete flag has thus been set to high level "1" is removed from the current pattern in step 56 of FIG. 15.

FIG. 13 illustrates in detail the note number-correspondent processing of FIG. 8B which is carried out in such a case where a received MIDI message is a note-off message.

Figure 13A:
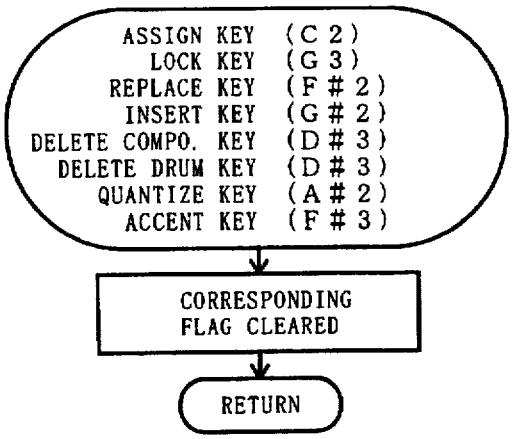
FIG. 13A is a flowchart illustrating a detailed example of the processing of FIG. 8B which is carried out in such a case where the received MIDI message is a note-off message corresponding to any of note numbers C2, G3, F#2, G#2, A#2, C#3, D#3 and F#3.

More specifically, in FIG. 13A, when actuation has been made of the assign key corresponding to note number C2 on the keyboard 1A, lock key corresponding to note number G3, replace key corresponding to note number F#2, insert key corresponding to note number G#2, quantize key corresponding to note number A#2, delete drum key corresponding to note number C#3, delete component key corresponding to note number D#3, or accent key corresponding to note number F#3, and thus a MIDI message containing such note number C2, G3, F#3, G#2, A#2, C#3, D#3 or F#3 has been received from the musical instrument 1F, the flag is cleared which has been set to high level "1" in one of the key processing of FIGS. 9 to 11 corresponding to the above-mentioned note numbers.

Figure 13B:
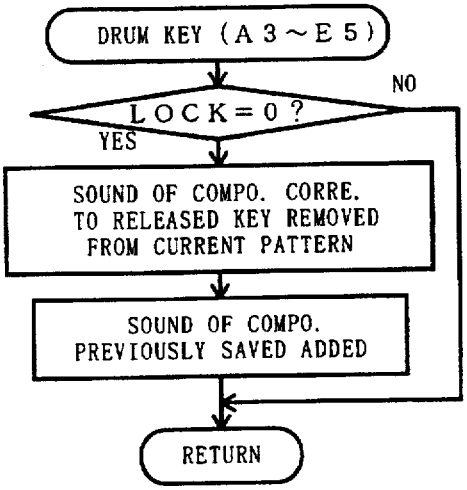
FIG. 13B is a flowchart illustrating a detailed example of the processing of FIG. 8B which is carried out in such a case where the received MIDI message is a note-off message corresponding to any of note numbers A3 to E5.

The processing of FIG. 13B is drum key processing which is executed when any of the drum pattern area keys corresponding to note numbers A3–E5 has been released or deactuated and thus a MIDI message containing a note-off message of any of note numbers A3–E5 has been received from the electronic musical instrument 1F.

In this drum key processing, it is first determined whether or not the lock flag LOCK is at low level "0". The CPU 21 executes the following operations if the determination result is YES, but if the result is NO, it returns to the main routine of FIG. 8A in order to make a rhythm pattern being read out from the data base means 5 effective.

If the lock flag LOCK is at low level "0", the drum sound (single sound) or component drum sounds corresponding to the released key are removed from the current pattern, and the component drum sounds previously saved in the processing of FIG. 11D are restored into the current pattern.

Figure 14:
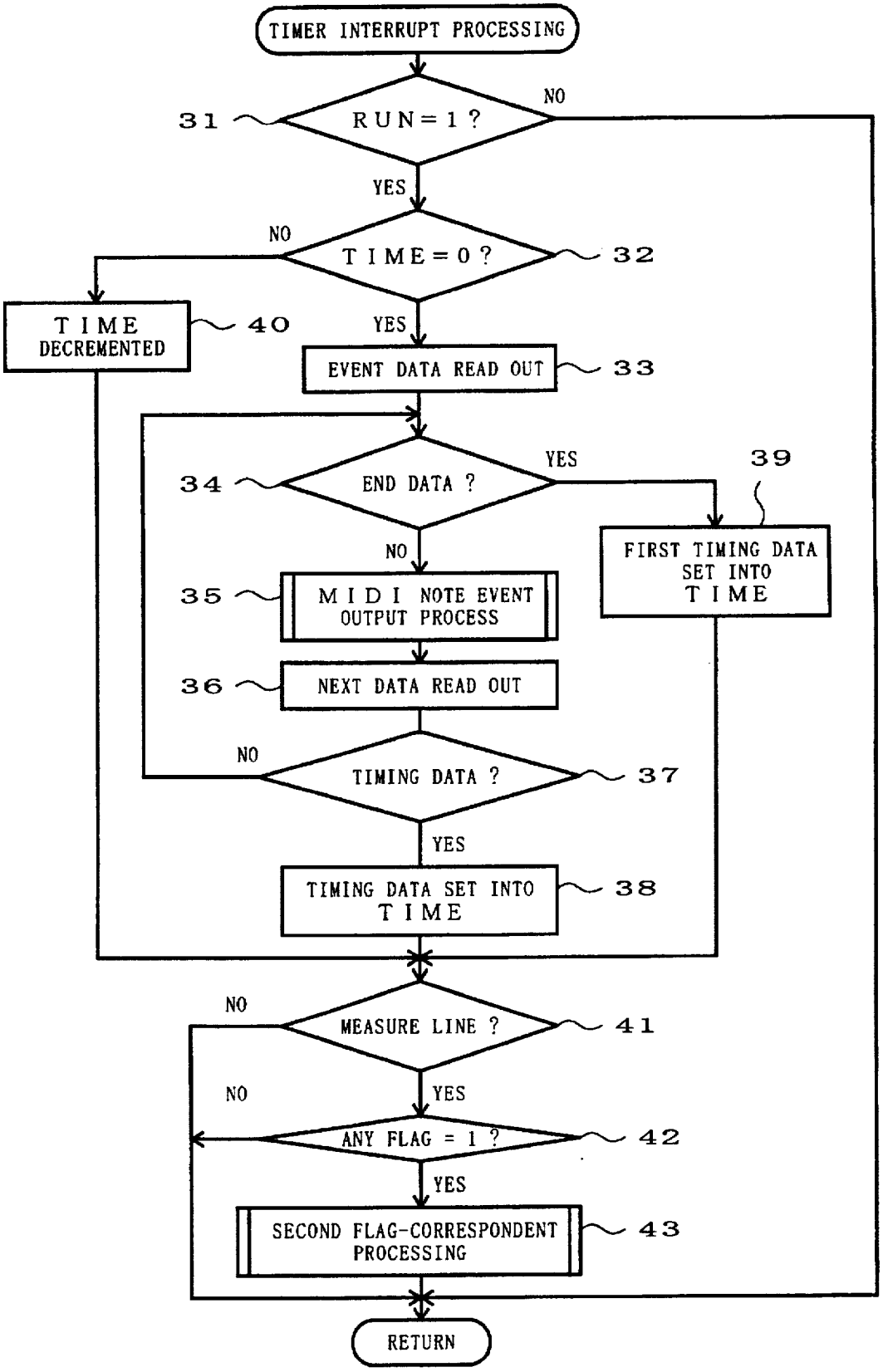
FIG. 14 is a flowchart of timer interrupt processing which is carried out at an interrupt frequency of 24 times per quarter note.

FIG. 14 is a flowchart of timer interrupt processing which is carried out at a frequency of, for example, 480 times per quarter note. This timer interrupt processing is conducted in accordance with the tempo at which current pattern is read out from the current pattern memory 1; that is, the interrupt period can be varied with the readout tempo. The timer interrupt processing is carried out in the following sequence.

Step 31: It is determined whether or not the run state flag RUN is at high level "1". If the flag RUN is at high level "1" (YES), the program goes to next step 32; otherwise (NO), the program returns to the main routine.

Step 32: It is determined whether or not the value of time register TIME storing the timing data is "0", i.e., the time to a next note event has passed. If the value is "0" (YES) meaning that the time to the next note has passed, the program goes to next step 33. But if the value is not "0" (NO) meaning that the time to the next note event has not passed, the program goes to step 40.

Step 33: Because of the ascertainment in the above-mentioned step 32 that the time to the next note event has passed, this step reads out event data corresponding to the timing.

Step 34: It is determined whether or not the event data read out in the above-mentioned step 33 is end data. The program goes to step 39 if the read-out data is end data, but it goes to step 35 if the read-out data is other than end data.

Step 35: Because of the ascertainment in step 43 that the event data read out in step 33 is other than end data, a MIDI note event (MIDI message) is output to the electronic musical instrument 1F via the MIDI interfaces 2C and 1D as will be described in detail later.

Step 36: Data next to the event data having been read out in step 33 is read out.

Step 37: It is determined whether or not the data read out in step 36 is timing data. The program goes to step 38 if the determination result is YES, but otherwise it goes back to step 34. Therefore, if the data read out in step 36 is end data, YES determination is obtained in step 34 and then step 39 is taken, but if the read out data is event data, steps 35 and 36 are taken.

Step 38: The read-out timing data is set into the time register TIME.

Step 39: Because of the ascertainment in step 34 that the read-out data is end data, the first timing data of the rhythm pattern is set into the time register TIME, and the program goes to step 41.

Step 40: Because of the ascertainment in step 32 that the time has not passed, the time register TIME is decremented only by one, and then the program goes to step 41.

Step 41: It is determined whether or not the readout timing within a measure (counted by an unillustrated counter) corresponds to the timing of a measure line. The program goes to step 41 if the determination result is YES, but it returns to the main routine if the result is NO.

Step 42: It is determined whether or not any of the flags is at high level "1". If any of the flags is at high level "1" (YES), step 43 is taken, but if NO, the processing returns to the main routine.

Step 43: Because it has been ascertained in step 42 that any of the flags is at high level "1", second flag-correspondent processing corresponding to the flag at high level "1" is executed, and then the program returns to the main routine. The detail of the second flag-correspondent processing will be described later in connection with FIG. 16.

Figure 15:
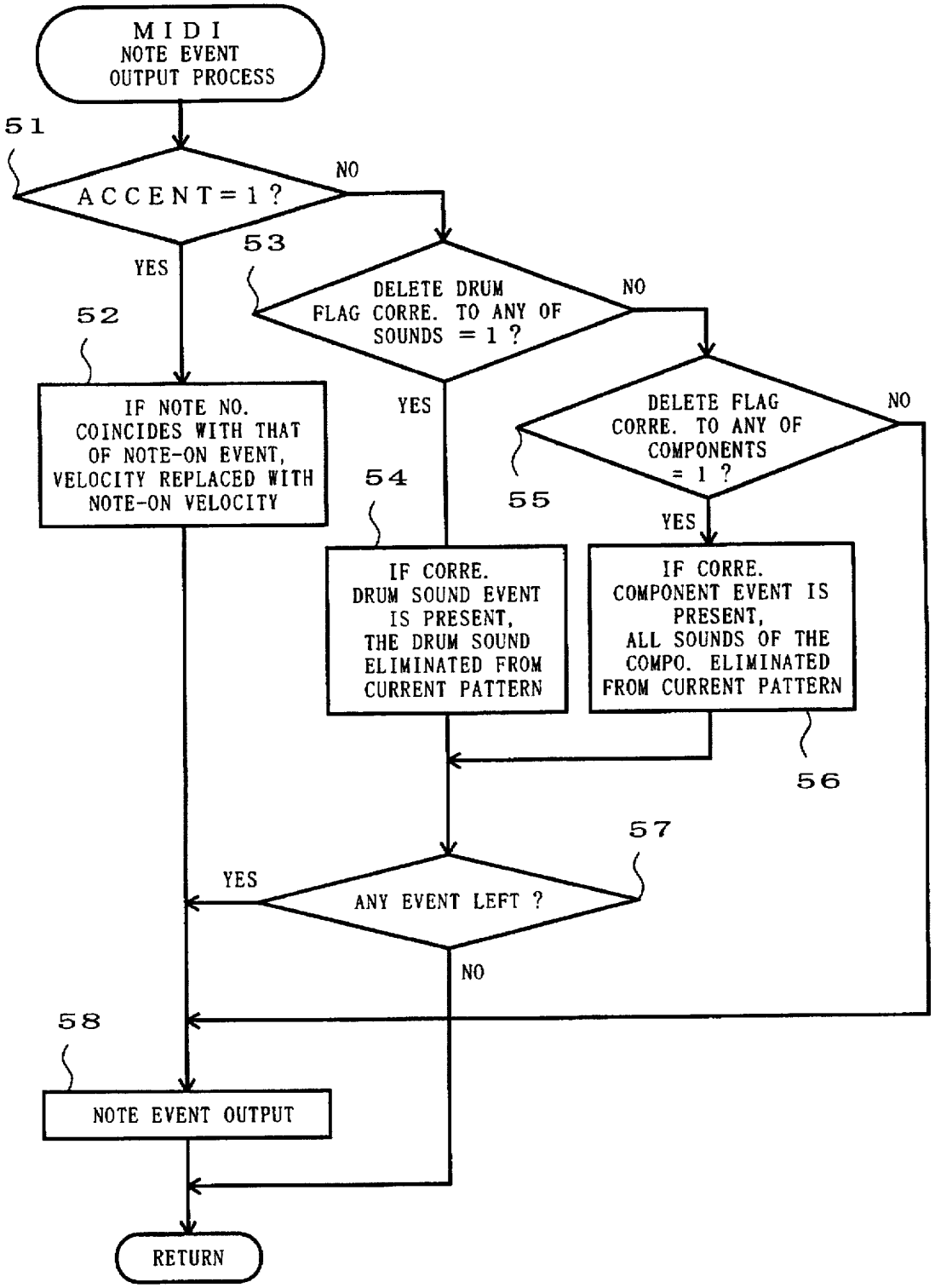
FIG. 15 is a flowchart illustrating a detailed example of a MIDI note event output process (step 35) of FIG. 14.

FIG. 15 is a flowchart illustrating the detail of the MIDI note event output process shown in step 35 of FIG. 14.

In this MIDI note event output process, if any of the accent flag ACCENT, delete drum flag DELDRUM and delete component flag DELCOMP is at high level "1", specific processing corresponding to the high level flag is carried out. Otherwise, the note event output process is carried out which corresponds to the rhythm pattern in the current pattern memory 1. This processing is executed in the following sequence.

Step 51: It is determined whether or not the accent key corresponding to note number F#3 on the keyboard 1A has been actuated or depressed and thus the accent flag ACCENT is at high level "1". If YES, next step 52 is taken, but if NO, step 53 is taken.

Step 52: If the note number of the read-out note event coincides with the note number of the received note event (note-on event), the velocity of the read-out note event is replaced with that of the received note-on message.

Step 53: It is determined whether or not the delete drum key corresponding to note number C#3 on the keyboard 1A has been depressed and thus the delete drum flag DELDRUM corresponding to any of the drum sounds has been set to high level "1". If the determination result is YES, step 54 is taken, but if NO, step 55 is taken.

Step 54: If event of the drum sound corresponding to the received note number is present among the events read out from the current pattern memory 1, the drum sound is eliminated from the read-out current pattern events.

Step 55: It is determined whether or not the delete component key corresponding to note number D#3 on the keyboard 1A has been depressed and thus the delete component flag DELCOMP corresponding to any of the components has been set to high level "1". If the determination result is YES, step 56 is taken, but if NO, step 59 is taken.

Step 56: If event of the drum sounds forming the component corresponding to the received note number is present among the current pattern events read out from the current pattern memory 1, all the drum sounds of the component are eliminated from the read-out current pattern events.

Step 57: It is determined whether or not there is still any event left in the read-out current pattern after the drum sound elimination in steps 54 and 56 above. The program goes to step 58 if the determination result is YES, but if NO, it returns to the main routine and then goes to step 36 of FIG. 14.

Step 58: Each note event which has undergone the accent processing in step 52 or which has been left uneliminated in step 52 or which has not undergone the operations in steps 52, 54, 56 is output to the electronic musical instrument 1F via the MIDI interfaces 2C and 1D.

FIG. 16 illustrates the detail of the second flag-correspondent processing of step 43 in FIG. 14.

The second flag-correspondent processing is carried out when any of the undo flag UNDO, fill-in flag FILL-IN, variation flags VARI1, VARI2 and transformer flag TRANS is at high level "1".

FIG. 16A illustrates an undo process included in the second flag-correspondent processing which is carried out when the undo flag UNDO is set at high level "1" (UNDO=1) in response to depression or actuation of the undo key corresponding to note number B2 on the keyboard 1A.

In this undo process, the latest rhythm pattern stored in the undo buffer 3 is read out and transferred into the current pattern memory 1 as a current pattern, and then the undo flag UNDO is reset to low level "0".

FIG. 16B illustrates a fill-in restoration process which is carried out when the fill-in flag FILL is set at high level "1" (FILL=1) in response to depression of the fill-in key corresponding to note number G#3 on the keyboard 1A.

In this fill-in restoration process, rhythm pattern having been previously saved in the save memory 4 is read out and copied into the current pattern memory 1 as a current pattern, and then the fill-in flag FILL is reset to low level "0".

FIG. 16C illustrates a variation process which is carried out when either of the variation flags VARI1 or VARI2 is set at high level "1" (VARI1 or VARI2=1) in response to depression of the variation key corresponding to note number D#2 or C#2 on the keyboard 1A.

In this variation process, because variation is being instructed, a next (or first) modifier is read out from the modifier variation sequence of FIG. 3 and instructed to the transformer 9. For instance, in the case where the modifier variation sequence contains data covering four measures, the variation process is repetitively executed to complete four times of such modifier readout, with one modifier read out per execution. When four times of the modifier readout have been completed, the variation flag VARI1 or VARI2 is reset to low level "0".

FIG. 16D illustrates a transformer process which is carried out when the transformer flag TRANS is set at high level "1" (TRANS=1) in response to depression of any of the transformer keys corresponding to note numbers D2, E2, F2, G2, A2 on the keyboard 1A.

In this transformer process, the current pattern in the current pattern memory 1 is copied into the undo buffer 3, and then, as will be described in detail below, specific operations are executed for changing the contents of the current pattern in accordance with the instructed modifier. After that the transformer flag TRANS is reset to low level "0".

FIG. 17 shows the detail of a pattern registration process included in the other processing of FIG. 8 performed by the CPU 21 of the personal computer 20. When new rhythm pattern data in the current pattern memory 1 is to be registered into the data base mens 5, this pattern registration process detects the degree of complexity of the rhythm pattern data, determines at which level in the pattern table 63 the detected degree of complexity is located, and registers the rhythm pattern data at that level, so as to rewrite the pattern table 63.

Step 71: A detection is made of the degree of complexity of the rhythm pattern to be newly registered, and the detected degree of complexity is stored into newly registered complexity register COMP(N).

Step 72: The degree of complexity of the rhythm pattern designated by address register AD (=1) is read out from the pattern table of FIG. 2 and stored into already registered complexity COMP(D). The address register AD is provided for storing addresses of the pattern table shown in FIG. 4.

Step 73: A determination is made as to whether the degree of complexity stored in the newly registered complexity register COMP(N) is smaller than the degree of complexity stored in the already registered complexity register COMP (D). If so, the CPU 21 proceeds to step 76; otherwise, the CPU branches to step 74.

Step 74: The address register AD is incremented by one.

Step 75: The degree of complexity of the rhythm pattern designated by the address register AD is read out from the pattern tables and stored into the already registered complexity COMP(D), and the CPU 21 loops back to step 73.

That is, the operations of steps 73 to 75 detect to which address of the current pattern table 63 the complexity of the rhythm pattern to be newly registered corresponds.

Step 76: Because it has been determined in previous step 73 that the degree of complexity stored in the newly registered complexity register COMP(N) is smaller than the degree of complexity stored in the already registered complexity register COMP(D), this step moves, backward by one address, the head address of each of the rhythm patterns at and after the address designated by the address register AD and records each of the patterns as thus moved.

Step 77: The head address and complexity of the newly registered rhythm pattern is registered into the address location of the table designated by the address register AD.

FIGS. 18 to 20 show by way of example arithmetic operations for changing the current pattern by the transformer process.

The pattern changing transformer process shown in FIGS. 18 to 20 searches a note pattern to be changed on the basis of a search template (Search-template) and changes the searched-out note pattern into a predetermined note pattern on the basis of a replace template (Replace-template). In other words, a note pattern corresponding to the search template is replaced with a triplet-type rhythm pattern corresponding to the replace plate.

In the illustrated example, the search template has a data format of Search-template=(offset data) (search data) (error range data), while the replace template has a data format of Replace-template=(replace data) (velocity selection data) (drum sound selection data).

The search data and replace data each contain a rhythm pattern expressed in timing data. It is assumed in this embodiment that the values of timing data corresponding to a quarter note, eighth note, sixteenth note and thirty-second note are "480", "240" and "120" and "60", respectively. Thus, search data (0 240 360 480) of the search template shown in FIG. 18 represents a rhythm pattern equivalent to one quarter note which is composed of one eighth note and two sixteenth notes, while replace data (0 160 320) of the replace template represents a triplet note type pattern equivalent to one quarter note.

In FIG. 18, the search template is expressed as "Search-template=((0 480 960 1440) (0 240 360 480) (20 20 20 20))", and the replace template is expressed as "Replace-template=((0 160 320) (001) (011))".

The offset data (0 480 960 1440) if the search template indicates an offset amount to be applied when a rhythm pattern represented by the search data is searched through the current pattern, i.e., it is indicative of the location in the current pattern of the rhythm pattern represented by the search data. The error range data (20 20 20 20) indicates an allowance range of the search data. Accordingly, the searched-out rhythm pattern, even if it is not in accurate coincidence with the search data (0 240 360 480), can be suitably replaced with replacement data as long as it falls within the range defined by the search data plus allowance range data (0±20 240±20 360±20 480±20)=(460 to 20 220 to 260 340 to 380 460 to 20).

The replace data (0 160 320) of the replace template indicates a replacing rhythm note pattern.

Further, the velocity selection data indicates which of the velocities of the respective notes in the search data is to be used as the velocity of the replace data. More specifically, velocity selection data "0" indicates the velocity of the first data (eighth note) in the search data, velocity selection data "1" indicates the velocity of the second data (first sixteenth note), and velocity selection data "2" indicates the velocity of the third data (second sixteenth note). The data order in the velocity selection data corresponds to that in the replace data.

Namely, in the case where the velocity data is "001", the velocity of the first data (eighth) in the search data is replaced with the first and second data (first and second notes of triplet) in the replace data, and the velocity of the second data (sixteenth note) in the search data is replaced with the third data (third note of triplet).

Further, the drum sound selection data indicates which of the drum sounds of the respective notes in the search data is to be used as the drum sound of the replace data. More specifically, drum sound selection data "0" indicates the drum sound of the first data (eighth note) in the search data, drum sound selection data "1" indicates the drum sound of the second data (first sixteenth note), and drum sound selection data "2" indicates the drum sound of the third data (second triplet note). The data order in the drum selection data corresponds to that in the replace data.

Namely, in the case where the drum sound selection data is "011", the drum sound of the first data (eighth note) in the search data is replaced with that of the first data (first note of triplet) in the replace data, and the drum sound of the second data (sixteenth note) in the search data is replaced with those of the second and third data (second and third notes of triplet) in the replace data.

Figures 18A, 18B, 18C, 18D, 18E:
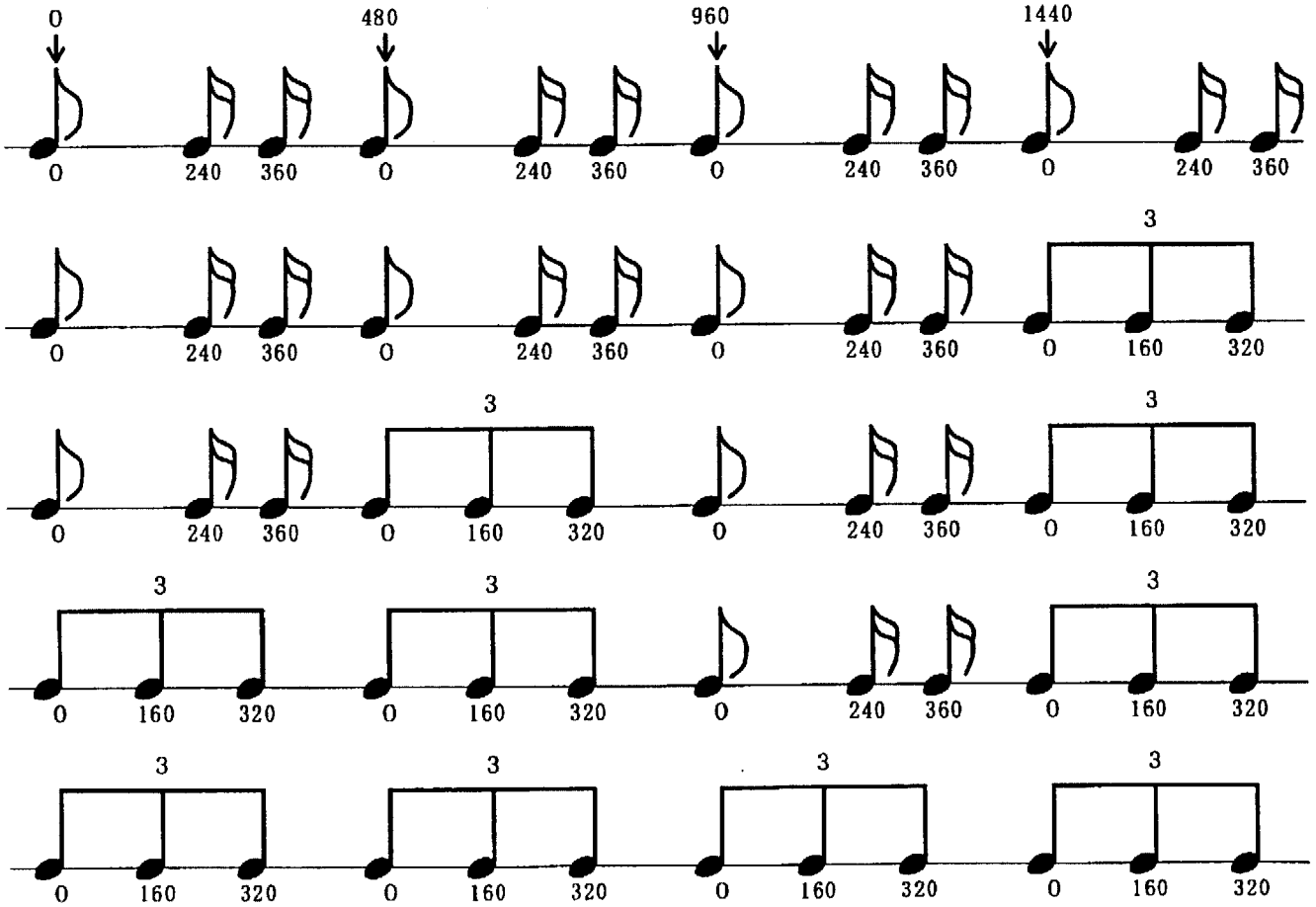
FIGS. 18A to 18E are diagrams explaining an example of arithmetic operations for changing the contents of a current pattern by the transformer process.

FIGS. 18A to 18E shows a manner in which the current pattern of FIG. 18A is sequentially transformer-processed as shown by FIGS. 18 B–E in accordance with the search template ((0 480 960 1440) (0 240 360 480) (20 20 20 20)) and replace template ((0 160 320) (001) (011)).

First, in the current pattern of FIG. 18A, there are quarter-note-equivalent note patterns which start from the locations indicated by the offset data (0 480 960 1440) and correspond to the search data (0 240 360), and thus any one of the note patterns is replaced in a random fashion. In the illustrated example, the fourth rhythm pattern corresponding to the search data (0 240 360) is replaced with a triplet indicated by the replace data (0 160 320), as shown in FIG. 18B. After that, the second rhythm pattern is replaced with a triplet as shown in FIG. 18C, and then the first rhythm pattern is replaced with a triplet as seen in FIG. 18D. Finally, the third rhythm pattern is replaced a triplet as shown in FIG. 18E. In this way, the rhythm pattern of FIG. 18A is ultimately transformed into a triplet rhythm pattern as shown in FIG. 18E.

Figures 19A, 19B, 19C, 19D:
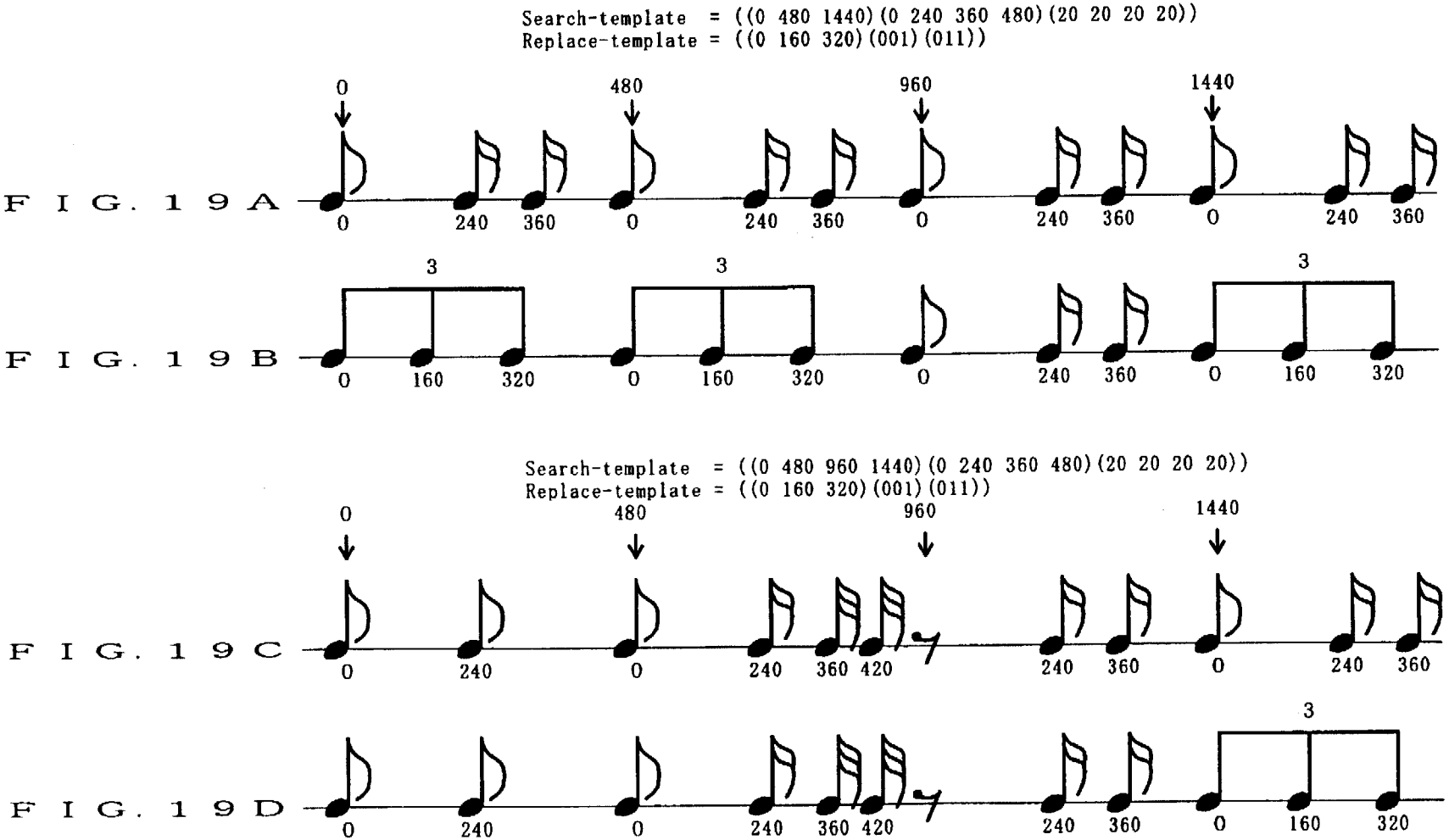
FIGS. 19A to 19D are diagrams explaining another example of the arithmetic operations for changing the contents of a current pattern by the transformer process.

FIGS. 19A and 19B are explanatory of a manner in which the current pattern of FIG. 18A is transformed in accordance with the search template ((0 480 960 1440) (0 240 360 480) (20 20 20 20)) and replace template ((0 160 320) (001) (011)).

The current pattern A of FIG. 19 is substantially the same as the one of FIG. 18A and has rhythm patterns which start from the locations indicated by the offset data (0 480 960 1440) and correspond to the search data (0 240 360). However, in FIG. 19A, the offset data of the search template is (0 480 1440) which is devoid of "960" contained in the offset data of FIG. 18. Therefore, in this case, only the third one of the rhythm patterns corresponding to the search data (0 240 360) is maintained in the original form without being replaced with a triplet as indicated by the replace data (0 160 320).

Further, FIGS. 19C and 19D are explanatory of a manner in which the current pattern of FIG. 19C is transformed in accordance with the search template ((0 480 960 1440) (0 240 360 480) (20 20 20 20)) and replace template ((0 160 320) (001) (011)).

Unlike the one of FIG. 18A, the current pattern of FIG. 19C has no rhythm pattern which starts from the locations indicated by the offset data and which corresponds to the search data (0 240 360), but it has a rhythm pattern which starts from the location indicated by the last offset data (1440). Therefore, in this case, only the fourth one of the rhythm patterns corresponding to the search data (0 240 360) is replaced with a triplet of the replace data (0 160 320), but the other note patterns are maintained in the original form.

Furthermore, FIGS. 20A to 20D show a manner in which the drum sound and velocity of a rhythm pattern are replaced in accordance with the drum sound selection data and velocity selection data.

In FIGS. 20A and 20B, search template ((0 480 960 1440) (0 240 360 480) (20 20 20 20)) and replace template ((0 160 320) (001) (011)) are the same as those of FIG. 18. Therefore, the rhythm pattern of FIG. 20A is transformed into a triplet rhythm pattern as shown in of FIG. 20B.

Since, in this case, the drum sound selection data is "011", the drum sound of the first data (eighth note) in the search data is replaced with that of the first data (first note of triplet) in the replace data, and the drum sound of the second data (sixteenth note) in the search data is replaced with those of the second and third data (second and third notes of triplet) in the replace data. Such replacements are shown by arrows between FIGS. 20A and 20B where the the first or second rhythm pattern is replaced with a triplet.

Similarly, since, in this case, the velocity selection data is "001", the velocity of the first data (eighth note) in the search data is replaced with the first and second data (first and second notes of triplet) in the replace data, and the velocity of the second data (sixteenth note) in the search data is replaced with the third data (third note of triplet). Such replacements are shown by arrows between FIGS. 20A and 20B where the the third or fourth rhythm pattern is replaced with a triplet.

In FIGS. 20C and 20D, the search template is ((0 480 960 1440) (0 240 360 480) (20 20 20 20)) which is the same as the above-mentioned, but the replace template is ((0 160 320) (001) (***) which is different from the above-mentioned only in drum sound selection data, so that the rhythm pattern of FIG. 20C is replaced with a triplet rhythm pattern as shown in FIG. 20D in a similar manner to the above-described transformer process.

In this case, the drum sound selection data (***) comprises a combination of values "0", "1" and "2" which sequentially varies like (000), (111), (222), (012), . . . .

Accordingly, in the first rhythm pattern of FIG. 20C, the drum sound of the first data (eighth note) in the search data is replaced with the first, second and third data (first, second and third notes of triplet) in the replaced data.

In the second rhythm pattern, the drum sound of the second data (sixteenth note) in the search data is replaced with the first, second and third data (first, second and third notes of triplet) in the replaced data.

In the third rhythm pattern, the drum sound of the third data (sixteenth note) in the search data is replaced with the first, second and third data (first, second and third notes of triplet) in the replaced data.

In the fourth rhythm pattern, the drum sound of the first data (eighth note) in the search data is replaced with the first data (first note of triplet) in the replaced data, the drum sound of the second data (sixteenth note) in the search data is replaced with the second data (second note of triplet) in the replaced data, and the drum sound of the third data (sixteenth note) in the search data is replaced with the third data (third note of triplet) in the replaced data. Such replacements are shown by arrows between FIGS. 20C and 20D where each rhythm pattern is replaced with a triplet.

FIG. 21 illustrates an example of video data shown on the display 29 of FIG. 1.

A bank display section 29A indicates which of the banks in the hard disk 24 the current bank is. In the illustrated example, the section 29A indicates that the current bank is bank A.

Below the bank display section 29A is a section for indicating the state of the current pattern. This section comprises a drum sound name display section 29B, a current sound display section 29C, a current pattern display section 29D and a current position display section 29E.

In the drum sound name display section 29B are presented drum sound names corresponding to the keyboard 1A.

The current sound display section 29C comprises a plurality of circular lighting spots which are provided on the right side of the respective drum sound names, in such a manner that only such a lighting spot corresponding to a currently-generated drum sound is lit.

The current pattern display section 29D shows a rhythm pattern for one measure by a plurality of square lighting spots. In the illustrated example, a rhythm pattern comprising bus drum, snare drum and closed high hat are shown. The current position display section 29E shows the position in the measure of the currently-generated sound.

By such video data presented on the display 29, it is possible to immediately recognize the contents of the current pattern. In addition, even when the current pattern has been transformed, it is possible to easily recognize how the pattern has been transformed. To this end, it is only sufficient to simultaneously display the patterns before and after transformation.

The foregoing embodiment has been described as being applied to rhythm accompaniment, but the present invention may also be applied to other forms of accompaniment such as base and chord backing accompaniments, in which case a multiplicity of base patterns and backing patterns are stored in the data base means so that any of the patterns is selected for each performance part in response to actuation of a predetermined operating member. Namely, in this case, operating members are provided in corresponding relation to the base part and backing parts 1, 2, 3, . . . (assuming that tone color is different for each backing part), so that, for example, any of the base patterns is selected from the data base by actuating the operating member for the base part, or any of the backing patterns is selected from the data base by actuating the operating member for backing part 1.

Further, although, in the foregoing embodiment, the second flag-correspondent processing (undo, fill-in, variation and transformer processes) has been described as initiated when performance to a measure line has been completed, it may be initiated immediately upon actuation of any of the corresponding keys.

The accent processing of step 52 in FIG. 15 has been described above as providing an accent effect by directly replacing note-on velocity with note number-correspondent velocity. But, an alternative arrangement is possible such that, just like the above-mentioned search template or replace template, plural accent templates each of which, for example, is a pattern indicating the degree of velocity replacement for each timing) are employed so that any of the templates is selected depending on the velocity of note-on note number, and then the velocity of the selected accent template replaces the note-on velocity.

Furthermore, the above-described embodiment employs keyboard keys as keys to which various functions are assigned, but in stead of such keys, switches may be displayed on the display of the personal computer in such a manner that various functions can be designated by selectively designating the switches. Or, the keyboard may be replaced by other suitable operator means such as drum pads or simple switches. Moreover, in the above-described embodiment, all the functions are designated entirely by the keyboard, but these functions may be designated by a combined use of the keyboard and other operating members; for example, the lock function may be assigned to and achieved by foot switch.

Moreover, although the present invention has been described above as applied to an automatic accompaniment device comprising an electronic musical instrument and a personal computer that are interconnected via MIDI circuitry, it is also applicable to an independent electronic musical instrument.

Moreover, although it has been described above that two kinds of modifiers are allotted to each transformer key so that either of the modifiers is selected depending on velocity value, the degree or depth of modifier-dependent transformation may be progressively switched depending on the varying velocity values. Further, only one modifier may be allotted to each transformer key.

Moreover, although, in the above-described embodiment, sequence data for each modifier covers four measures so that it terminates upon completion of performance of the four measures, the sequence data for four measures may be repetitively performed unless termination of the sequence data readout is specifically instructed. Further, of course, the sequence data may cover any other number of measures than four. In addition, the modifier designation may be made at any timing other than the measure line timing.

Furthermore, in changing a rhythm pattern by the transformer, different changing processes may be applied depending on the contents of the rhythm pattern. For instance, in such a case where the change is effected by adding drum sound or replacing a pattern by the transformer, it may be determined what kind of pattern a current rhythm pattern is, and then drum sound to be added or replacing pattern may be varied depending on whether the determined pattern is a 16-beat rhythm pattern or an 8-beat rhythm pattern.

Next, another embodiment of the present invention will be described hereinafter with particular reference to FIGS. 22 to 26.

In this embodiment, the switch panel 1B of the electronic musical instrument 1F includes a section designation means comprised of an intro key, ending key, fill-1 key and fill-2 key. In response to activation or operation of any of these keys in the section designation means, a process is triggered which corresponds to the activated key as will be described in detail hereinafter.

For example, when the intro key is activated while any automatic performance is not under way, a modification suitable for an intro performance is applied to the current pattern (i.e., basic pattern, which corresponds to a normal performance) in the current pattern memory 1, so that an automatic performance is initiated. Then, once the intro performance of a predetermined number of measures is terminated, switching is made to a performance based on the current pattern.

When the fill-1 key is activated while automatic performance is under way, a modification suitable for a fill-in performance is applied to the current pattern (i.e., basic pattern, which corresponds to a normal performance) in the current pattern memory 1, so that the accompaniment pattern is switched accordingly. Then, once the fill-in performance of a predetermined number of measures is terminated, the same current pattern performance (i.e., the normal performance) as before the modification is resumed.

When the fill-2 key is activated while automatic performance is under way, a modification suitable for a fill-in performance is applied to the current pattern (i.e., basic pattern, which corresponds to a normal performance) in the current pattern memory 1, so that the accompaniment pattern is switched accordingly. Then, once the fill-in performance of a predetermined number of measures is terminated, the automatic performance switches to a modified normal performance based on a modified basic pattern which is different from the current pattern (basic pattern) before the modification for for the fill-in, i.e., a slight modification of the pre-modification basic pattern.

Finally, when the ending key is activated while automatic performance is under way, a modification suitable for an ending performance is applied to the current pattern (i.e., basic pattern which corresponds to a normal performance or another suitable pattern) in the current pattern memory 1, so that the accompaniment pattern is switched accordingly. Then, once the ending performance of a predetermined number of measures is terminated, the automatic performance also terminates.

Here, the modification suitable for an intro, fill-in or ending performance is the one based on any of the above-mentioned modifiers, or based on a suitable combination of modifying elements of the modifiers; for example, in the case of an intro performance in the second measure, a modification may be applied to the basic pattern such that the first measure and the former half of the second measure is relatively quiet and the latter half of the second measure is upsurging.

Figure 22A:
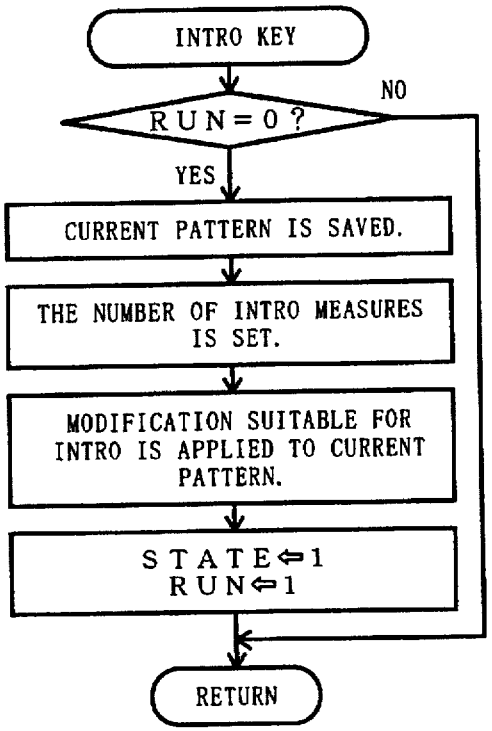
FIG. 22A is a flowchart illustrating an example of a process performed when an intro key in a section designation means is operated and a corresponding MIDI message is received from the electronic musical instrument.
Figure 22B:
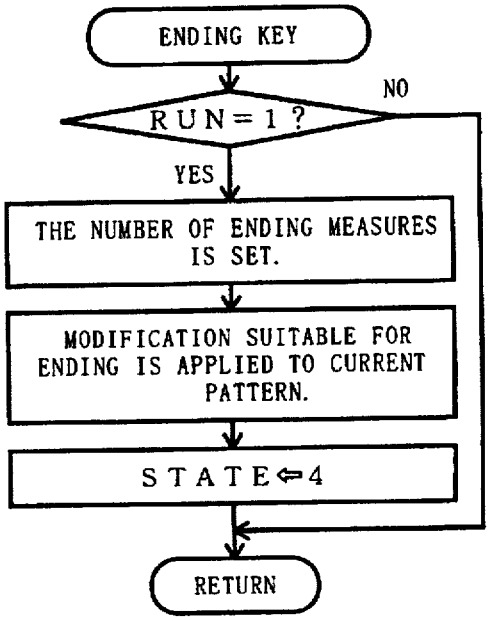
FIG. 22B is a flowchart illustrating an example of a process performed when an ending key in the section designation means is operated and a corresponding MIDI message is received from the electronic musical instrument.
Figure 22C:
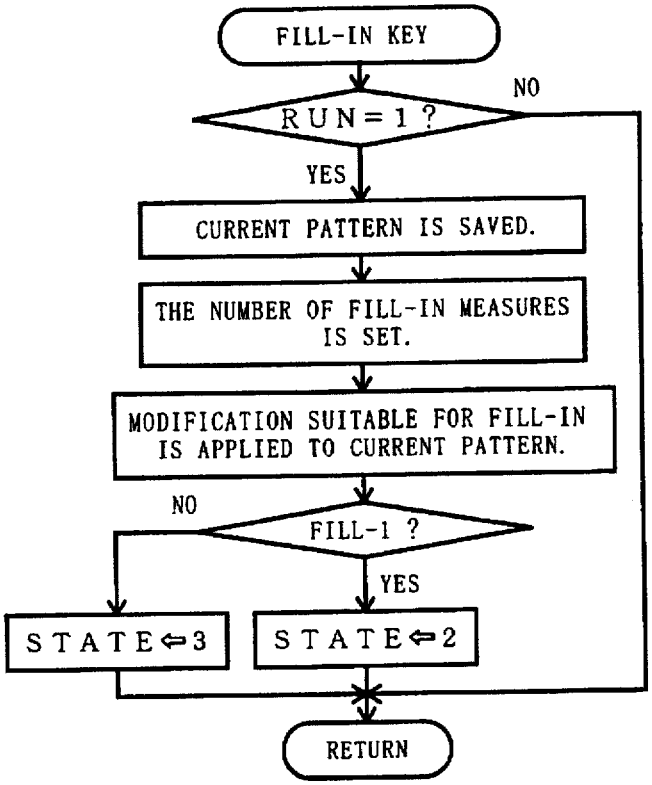
FIG. 22C is a flowchart illustrating an example of a process performed when a fill-in key (either a fill-1 key or a fill-2 key) in the section designation means is operated and a corresponding MIDI message is received from the electronic musical instrument.

FIGS. 22A to 22C are flowcharts each illustrating an example of a process performed when any of the intro, ending, fill-1 and fill-2 keys in the section designation means on the switch panel 1B is activated and a corresponding MIDI message is received from the electronic musical instrument 1F. Namely, each of the processes of FIGS. 22A to 22C is performed in correspondence to activation of any of the intro, ending, fill-1 and fill-2 keys in the section designation means.

FIG. 22A is a flowchart illustrating a process performed when the intro key is activated. In this process, a determination is made as to whether the flag RUN is at low level "0". With an affirmative (YES) determination, this means that no automatic performance is under way, and hence the program advances to a next step. However, with a negative (NO) determination, this means that an automatic performance is under way, so that the program ignores the activation of the intro key and returns to the main routine.

If the preceding step determines that no automatic performance is under way, the current pattern in the current pattern memory 1 is temporarily saved into the save memory 4. The number of intro measures necessary for an intro performance is set and a modification suitable for the intro performance is applied to the current pattern in the current pattern memory 1, so as to produce an intro performance pattern for the thus-set number of measures. Then, code number "1" indicative of an intro performance is set to a state register STATE, high level "1" is set to the flag RUN, and then the program returns to the main routine.

FIG. 22B is a flowchart illustrating a process performed when the ending key is activated. In this process, a determination is first made as to whether the flag RUN is at high level "1". With an affirmative determination, this means that an automatic performance is under way, and hence the program advances to a next step. However, with a negative determination, this means that no automatic performance is under way, so that the program ignores the activation of the ending key and returns to the main routine.

If the preceding step determines that an automatic performance is under way, the number of intro measures necessary for an ending performance is set and a modification suitable for the ending performance is applied to the current pattern in the current pattern memory 1, so as to produce an ending performance pattern for the thus-set number of measures. Then, code number "4" indicative of an ending performance is set to the state register STATE.

FIG. 22C is a flowchart illustrating a process performed when the fill-in key (either the fill-1 key or the fill-2 key) is activated. In this process, a determination is first made as to whether the flag RUN is at high level "1". With an affirmative determination, this means that an automatic performance is under way, and hence the program advances to a next step. However, with a negative determination, this means that no automatic performance is under way, so that the program ignores the activation of the fill-in key and returns to the main routine.

If the preceding step determines that an automatic performance is under way, the current pattern in the current pattern memory 1 is temporarily saved into the save memory 4. The number of intro measures necessary for a fill-in performance is set and a modification suitable for the fill-in performance is applied to the current pattern in the current pattern memory 1, so as to produce a fill-in performance pattern for the thus-set number of measures. Then, it is determined whether the activated key is the fill-1 or fill-2 key. If it is the fill-1 key, code number "2" indicative of a fill-in performance corresponding to the fill-1 key is set to the register STATE, and the program returns to the main routine. If it is the fill-2 key, code number "3" indicative of a fill-in performance corresponding to the fill-2 key, and the program returns to the main routine is set to the state register STATE.

Figure 23:
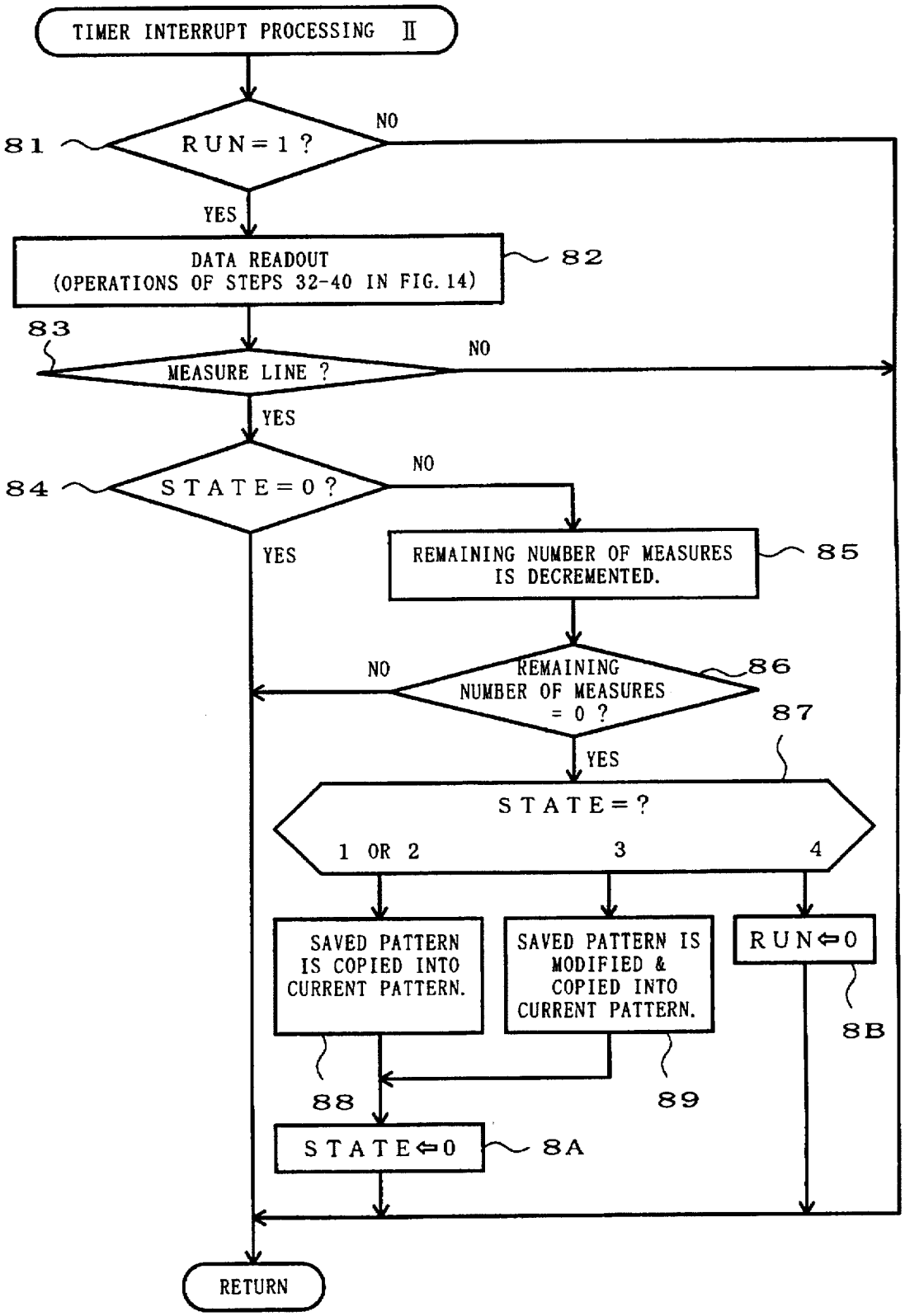
FIG. 23 is a flowchart illustrating timer interrupt processing II performed at a frequency of 480 times per quarter note.

FIG. 23 is a flowchart illustrating timer interrupt processing II which is performed at a frequency of 480 times per quarter note and in which the current pattern modified in any of the processes of FIGS. 22A to 22C is sequentially read out from the current pattern memory 1. This timer interrupt processing II is executed in correspondence to a tempo at which the current pattern is read out from the current pattern memory 1; that is, the interrupt frequency is varied in dependence on the tempo. This processing is performed in the following step sequence.

Step 81: A determination is made as to whether or not the flag RUN is at high level "1". If the determination is in the affirmative (YES), the program goes to a next step 82; if not, the program immediately returns to the main routine.

Step 82: Event data are sequentially read out from the current pattern memory 1 to carry out operations corresponding to the read-out event data. Namely, this step performs operations similar to those of steps 32 to 40 in the timer interrupt processing of FIG. 14.

Step 83: It is determined whether the readout timing in the measure (in-measure readout timing) coincides with measure line timing. If the determination is in the affirmative, the program advances to a next step 84; otherwise, the program returns to the main routine.

Step 84: A determination is made as to whether the stored value in the state register STATE is code number "0". If the stored value is "0" (YES), the program returns to the main routine; if the stored value is other than code number "0", the program goes to step 85.

Step 85: The number of measures set in any of the processes of FIGS. 22A to 22C (i.e., the remaining number of measures to be performed) is decremented. For example, where "4" was set as the number of intro measures in FIG. 22A and two measures have already been performed, the remaining number is decremented to "2" in this step.

Step 86: A determination is made as to whether the remaining number of measures to be performed is "0". If the remaining number is "0" (YES), the program proceeds to step 87; otherwise, the program immediately returns to the main routine since there remains one or more measures to be performed.

Step 87: Because the preceding step has determined that all the measures have terminated, it is further determined here what is the code number set in the register STATE, and a different branch is made depending on the determined code number. Namely, if the code number set in the state register STATE is "1" or "2"; the program branches to step 88; if the code number set in the state register STATE is "3", the program branches to step 89; and if the code number set in the state register STATE is "4", the program branches to step 8B.

Step 88: The determination in the preceding step that the code number is "1" or "2" means that an intro or fill-1 performance has been performed, and hence the current pattern temporarily saved in the save memory 4 (namely, the current pattern read before the performance was switched to an intro pr fill-1 performance) is copied into the current pattern memory 1, and the program proceeds to step 8A.

Step 89: The determination in the preceding step that the code number is "3" means that a fill-2 performance has been performed, and hence the current pattern temporarily saved in the save memory 4 (namely, the current pattern read before switching to the fill-2 performance occurred) is slightly modified into a patten suitable for being performed after the fill-2 performance and then copied into the current pattern memory 1, and the program proceeds to step 8A.

Step 8A: "0" is set to the state register STATE, and the program returns to the main routine. Thus, a normal pattern performance is performed next time.

Step 8B: The determination in the preceding step that the code number is "4" means that an ending performance has been performed, the flag RUN is set at low level "0", and the program returns to the main routine. This causes the performance to stop.

A description will now be made on still another embodiment of the present invention, in which, by activating the modifier designation means 8 while operating any of the keys in the section designation means, a modification process corresponding to the operated key in the section designation means (intro, ending, fill-1 or fill-2 modification) is performed on the basis of a modifier designated by the modifier designation means 8.

For example, when the intro key in the section designation means and the modifier designation means 8 are simultaneously activated during an automatic accompaniment, a modification is applied to the current pattern (basic pattern) in the current pattern memory 1 on the basis of the designated modifier and an automatic performance is initiated on the basis of the modified accompaniment pattern. Upon termination of the intro performance over a predetermined number of measures, the performance switches to a performance based on the current pattern is performed.

When the fill-1 key in the section designation means and the modifier designation means 8 are simultaneously activated during an automatic accompaniment, a modification is applied to the current pattern (basic pattern) in the current pattern memory 1 on the basis of the designated modifier, and the performance is switched to the modified accompaniment pattern. Then, upon termination of the fill-in performance over a predetermined number of measures, the current pattern (basic pattern) prior to the modification is resumed.

When the fill-2 key in the section designation means and the modifier designation means 8 are simultaneously activated during an automatic accompaniment, a modification is applied to the current pattern (basic pattern) in the current pattern memory 1 on the basis of the designated modifier, and the performance is switched to the modified accompaniment pattern. Then, upon termination of the fill-in performance over a predetermined number of measures, the performance is switched to an accompaniment pattern which is different from the current pattern (basic pattern) prior to the modification, namely, a pattern resulting from slightly modifying the pre-modification basic pattern on the basis of the designated modifier.

When the ending key in the section designation means and the modifier designation means 8 are simultaneously activated during an automatic accompaniment, a modification is applied to the current pattern (basic pattern) in the current pattern memory 1 on the basis of the designated modifier, and the performance is switched to the modified accompaniment pattern. Then, upon termination of the ending performance over a predetermined number of measures, the performance terminates.

Figure 24A:
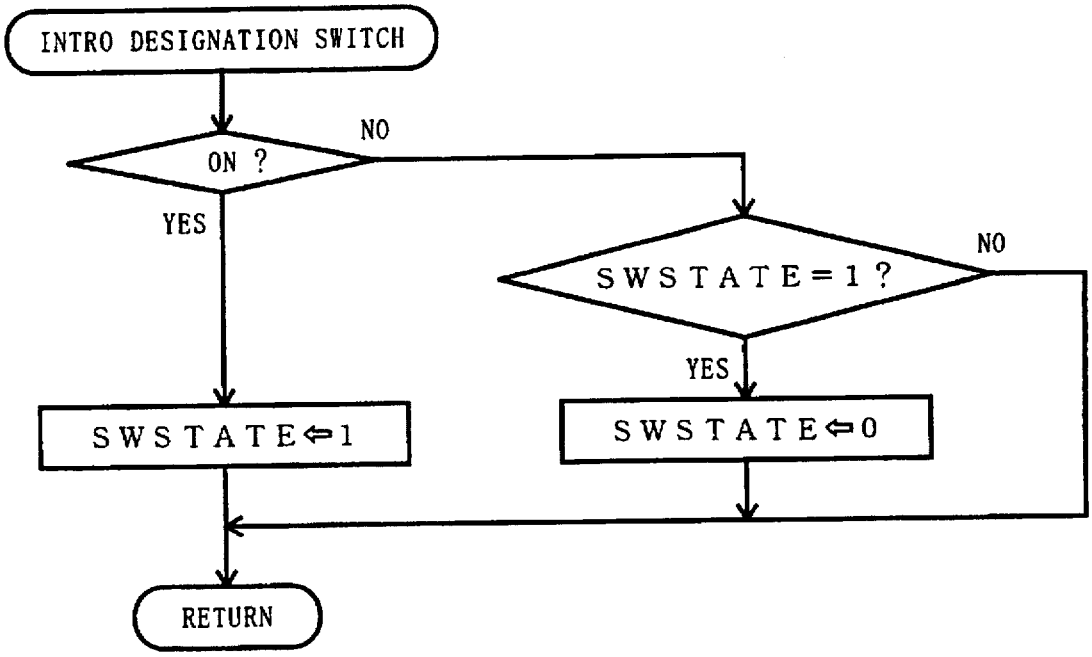
FIG. 24A is a flowchart illustrating an example of a process performed when an intro designation switch in the section designation means is operated and a corresponding MIDI message is received from the electronic musical instrument.
Figure 24B:
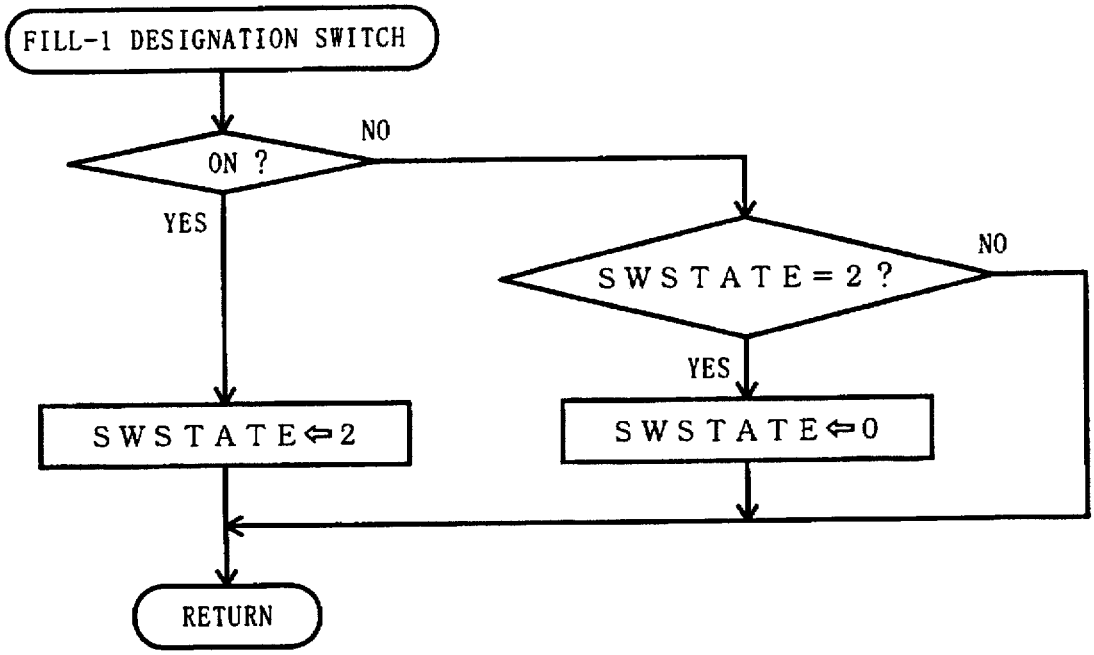
FIG. 24B is a flowchart illustrating an example of a process performed when a fill-1 designation switch in the section designation means is operated and a corresponding MIDI message is received from the electronic musical instrument.
Figure 25A:
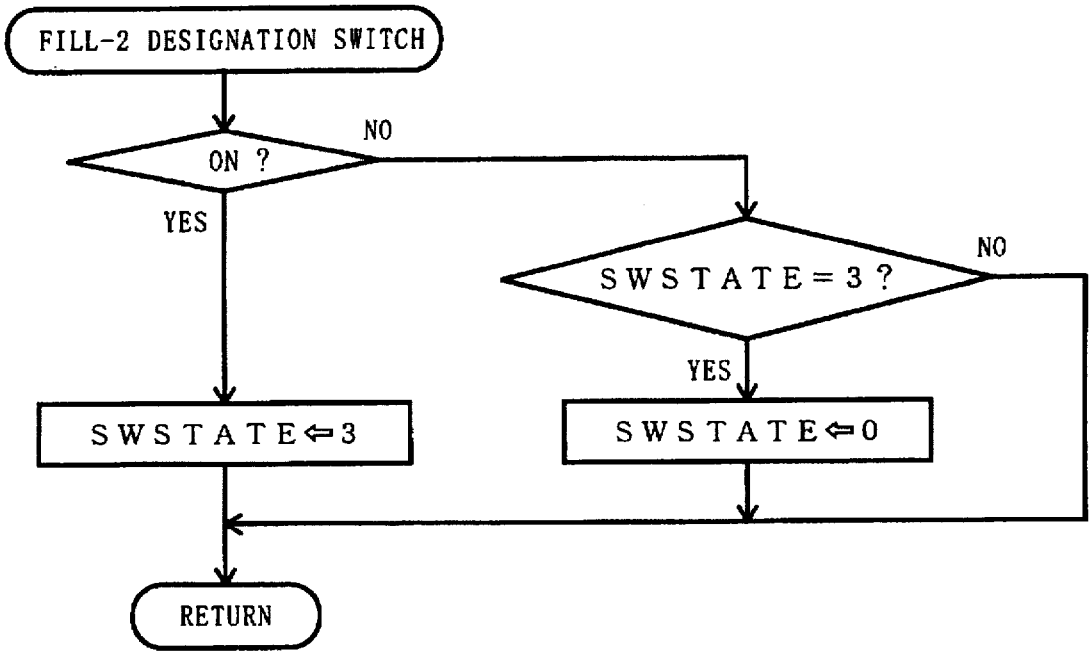
FIG. 25A is a flowchart illustrating an example of a process performed when a fill-2 designation switch in the section designation means is operated and a corresponding MIDI message is received from the electronic musical instrument.
Figure 25B:
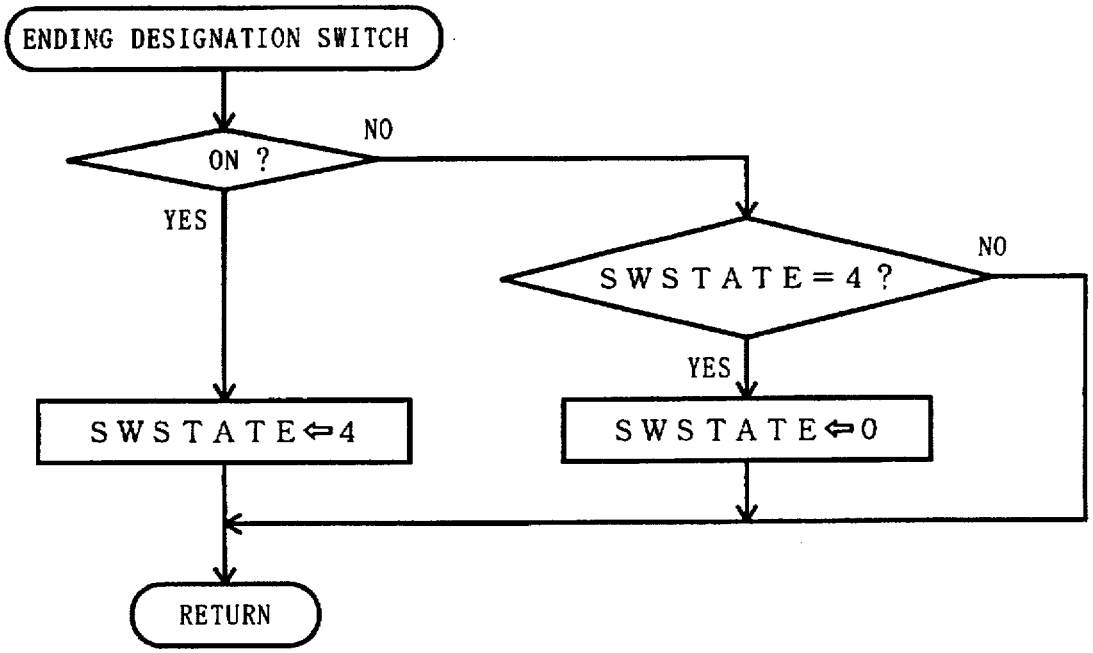
FIG. 25B is a flowchart illustrating an example of a process performed when an ending designation switch in the section designation means is operated and a corresponding MIDI message is received from the electronic musical instrument.

FIGS. 24A and 24B and 25A and 25B are flowcharts each illustrating an example of a process performed when any of the intro, ending, fill-1 and fill-2 keys in the section designation means on the switch panel 1B is activated and a corresponding MIDI message is received from the electronic musical instrument 1F. FIG. 24A is a flowchart illustrating a process performed when the intro designation switch is activated; FIG. 24B is a process performed when the fill-1 designation switch is activated; FIG. 25A is a process performed when the fill-2 designation switch is activated; and FIG. 25B is a process performed when the ending designation switch is activated.

In FIG. 24A, a determination is first made as to whether the received MIDI message indicates an on-event of the intro designation switch, i.e., whether the intro designation switch has been turned on. If the determination is in the affirmative, code number "1" indicating that the intro designation switch is in the on-state is set to a switch state register SWSTATE, and then the program returns to the main routine.

If, however, the received MIDI message indicates an off-event of the intro designation switch (NO), i.e., if the intro designation switch has been turned off, it is further determined whether the stored value in the switch state register SWSTATE is code number "1". If the determination is in the affirmative, "0" is set to the switch state register SWSTATE since the intro designation key has been turned off, and then the program returns to the main routine. If the stored value in the switch state register SWSTATE is other than code number "1", then the program returns to the main routine.

In the above-mentioned manner, the process of FIG. 24A rewrites the switch state register SWSTATE in response to the operational state of the intro designation switch.

In FIG. 24B, a determination is first made as to whether the received MIDI message indicates an on-event of the fill-1 designation switch, i.e., whether the fill-1 designation switch has been turned on. If the determination is in the affirmative, code number "2" indicating that the fill-1 designation switch is in the on-state is set to the switch state register SWSTATE, and then the program returns to the main routine.

If, however, the received MIDI message indicates an off-event of the fill-1 designation switch (NO), i.e., if the fill-1 designation switch has been turned off, it is further determined whether the stored value in the switch state register SWSTATE is code number "2". If the determination is in the affirmative, "0" is set to the switch state register SWSTATE since the fill-1 designation switch has been turned off, and then the program returns to the main routine. If the stored value in the switch state register SWSTATE is other than code number "2", then the program returns to the main routine.

In the above-mentioned manner, the process of FIG. 24B rewrites the switch state register SWSTATE in response to the operational state of the fill-1 designation switch.

Further, in FIG. 25A, a determination is first made as to whether the received MIDI message indicates an on-event of the fill-2 designation switch, i.e., whether the fill-2 designation switch has been turned on. If the determination is in the affirmative, code number "3" indicating that the fill-2 designation switch is in the activated state or on-state is set to the switch state register SWSTATE, and then the program returns to the main routine.

If, however, the received MIDI message indicates an off-event of the fill-2 designation switch (NO), i.e., if the fill-2 designation switch has been turned off, it is further determined whether the stored value in the switch state register SWSTATE is code number "3". If the determination is in the affirmative, "0" is set to the switch state register SWSTATE since the fill-2 designation switch has been turned off, and then the program returns to the main routine. If the stored value in the switch state register SWSTATE is other than code number "3", then the program returns to the main routine.

In the above-mentioned manner, the process of FIG. 25A rewrites the switch state register SWSTATE in response to the operational state of the fill-2 designation switch.

Finally, in FIG. 25B, a determination is first made as to whether the received MIDI message indicates an on-event of the ending designation switch, i.e., whether the ending designation switch has been turned on. If the determination is in the affirmative, code number "4" indicating that the ending designation switch is in the on-state is set to the switch state register SWSTATE, and then the program returns to the main routine.

If, however, the received MIDI message indicates an off-event of the ending designation switch (NO), i.e., if the ending designation switch has been turned off, it is further determined whether the stored value in the switch state register SWSTATE is code number "4". If the determination is in the affirmative, "0" is set to the switch state register SWSTATE since the ending designation switch has been turned off, and then the program returns to the main routine. If the stored value in the switch state register SWSTATE is other than code number "4", then the program returns to the main routine.

In the above-mentioned manner, the process of FIG. 25B rewrites the switch state register SWSTATE in response to the operational state of the ending designation switch.

Figure 26:
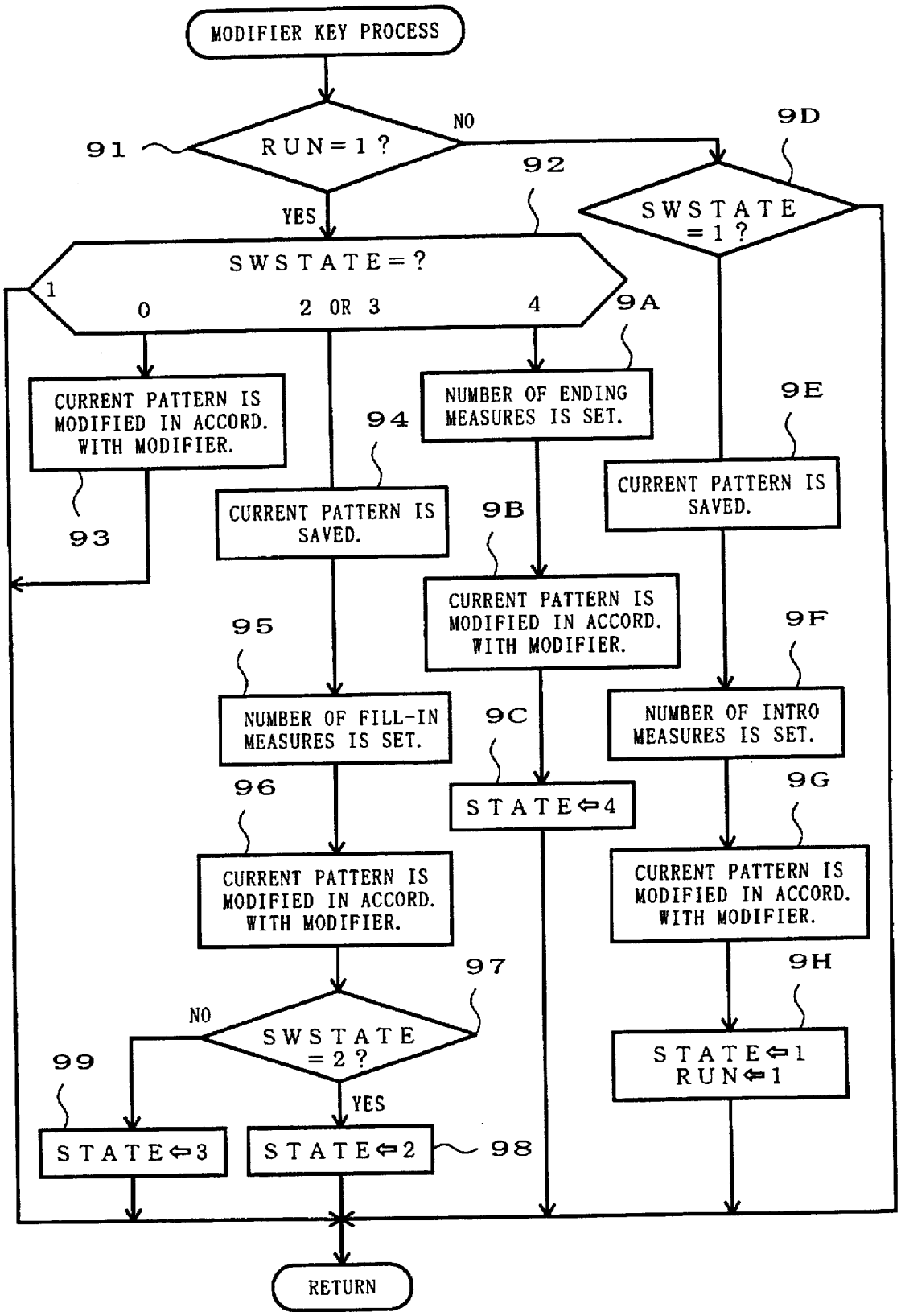
FIG. 26 is a flowchart illustrating another example of the MIDI reception processing of FIG. 8 performed when a received MIDI message is a modifier key corresponding to any of note numbers D2 to A2 (excluding #'s)

FIG. 26 is a flowchart illustrating a modifier key process performed when activation has been made of any of the keys of transformer 1 to transformer 5 on the keyboard 1A which correspond to note numbers D2–A2 (excluding #'s) and a MIDI message containing any of such note numbers D2–A2 (excluding #'s) has been received from the electronic musical instrument 1F. This process is performed in the following step sequence.

Step 91: A determination is first made as to whether or not the run state flag RUN is at high level "1". With an affirmative determination (YES), the program continues to a next step 92, while with a negative determination (NO), the program branches to step 9D.

Step 92: Because of the determination in the preceding step that an performance is under way, it is determined what is the code number currently stored in the switch state register SWSTATE, so that a different branch is made depending on the determined code number. Namely, if the code number stored in the register SWSTATE is "1" indicative of the on-state of the intro designation switch, then the program immediately returns to the main routine without conducting any other operations; if the code number is "0" indicative of the off-state of each switch in the intro designation switch, the program proceeds to step 93; if the code number is "2" or "3" indicative of the on-state of the fill-1 or fill-2 designation switch, the program proceeds to step 94; and if the code number is "4" indicative of the on-state of the ending designation switch, the program proceeds to step 9A.

Step 93: Because of the determination in preceding step 92 that no switch in the section designation means 63 has been activated, it is identified that a normal transformer above noted above is designated, so that in this step the current pattern is modified in accordance with the designated modifier and then the program returns to the main routine.

Step 94: Because of the determination in preceding step 92 that either the fill-1 designation switch or the fill-2 designation switch is in the on-state, it is identified that the designated transformer is to be used for a fill-in performance, so that in this step the current pattern in the current pattern memory 1 is temporarily saved into the save memory 4.

Step 95: The number of measures necessary for the fill-in performance is set.

Step 96: A modification suitable for the fill-in performance is made to the current pattern in the memory 1 in accordance with the modifier designated by the modifier designation means 8, so as to produce a fill-in performance pattern.

Step 97: It is determined whether the stored value in 99. the switch state register SWSTATE is "2". If answered in the affirmative, the program continues to step 98; if not, i. e, if the stored value is "3", the program branches to step Step 98: Because the stored value in the switch state register SWSTATE is code number "2" indicative of the on-state of the fill-1 designation switch, code number "2" indicative of a fill-in performance based on the activated fill-1 designation switch is set to the state register STATE in this step, and then the program returns to the main routine.

Step 99: Because the stored value in the switch state register SWSTATE is code number "3" indicative of the on-state of the fill-2 designation switch, code number "3" indicative of a fill-in performance based on the activated fill-2 designation switch is set to the state register STATE in this step, and then the program returns to the main routine.

Step 9A: Because of the determination in preceding step 92 that the ending designation switch is in the on-state, it is identified here that the designated transformer is to be used for an ending performance, so that the number of measures necessary for the ending performance is set.

Step 9B: A modification suitable for the ending performance is applied to the current pattern in the memory 1 in accordance with the modifier designated by the modifier designation means 8, so as to produce an ending performance pattern.

Step 9C: Code number "4" indicative of an ending performance based on the activated ending designation switch is set to the state register STATE in this step, and then the program returns to the main routine.

Step 9D: Because of the determination in the preceding step that no performance is under way, it is determined here whether or not the code number currently stored in the switch state register SWSTATE is "1". If answered in the affirmative, the program proceeds to step 9E, but if the code number is other than "1", the program returns to the main routine without conducting any other operations.

Step 9E: Because of the determination in preceding step 9D that the stored value in the switch state register SWSTATE, it is identified that the designated transformer is to be used for an intro performance, so that in this step the current pattern in the current pattern memory 1 is temporarily saved into the save memory 4.

Step 9F: The number of measures necessary for the intro performance is set.

Step 9G: A modification suitable for the intro performance is applied to the current pattern in the memory 1 in accordance with the modifier designated by the modifier designation means 8, so as to produce an intro performance pattern.

Step 9H: Code number "1" indicative of an intro performance is set to the state register STATE, high level "1" is set to the flag RUN, and the program returns to the main routine.

Each current pattern modified in the processes of FIGS. 24A to 26 is sequentially read out by the timer interrupt processing II of FIG. 23.

In the above-mentioned embodiments, the numbers of intro, fill-in and ending measures may each be determined in advance or set at a different value by varying the manner to operate the corresponding key. For example, each of the numbers of measures may be set in accordance with the operating intensity (touch intensity) or operation duration (operation-lasting time length) of the corresponding key. Alternatively, each of the numbers may be set in accordance with the operational position of the corresponding key in such an arrangement that allows the operational position to be detected.

Further, the switchover to the fill-in and ending performances may be effected immediately in response to a user's predetermined operation or may be effected at a first measure after the user's operation. Alternatively, these two switchover methods may be changeably employed depending on the operation timing.

Further, an alternative arrangement may be such that even the activation of a same modifier key achieves different modifications among the normal transformer designation, intro performance designation, fill-in performance designation and ending performance designation.

As has been described so far, the present invention can achieve intro, fill-in and ending performances full of variety, without a need to previously store a large quantity of accompaniment patterns.

Still another embodiment will be described with reference to FIGS. 27 to 33.

While in the above-mentioned embodiments the contents of the current pattern are modified in accordance with modifier data designated by the designation means 8 corresponding to the transformer designation key, in the embodiment to be described below, the contents of the current pattern are further modified in accordance with the settings in a modification table or modifier macro table. These modification table and modifier macro table are provided in a predetermined area of the RAM 23 as shown in FIG. 3.

Figures 27, 28:
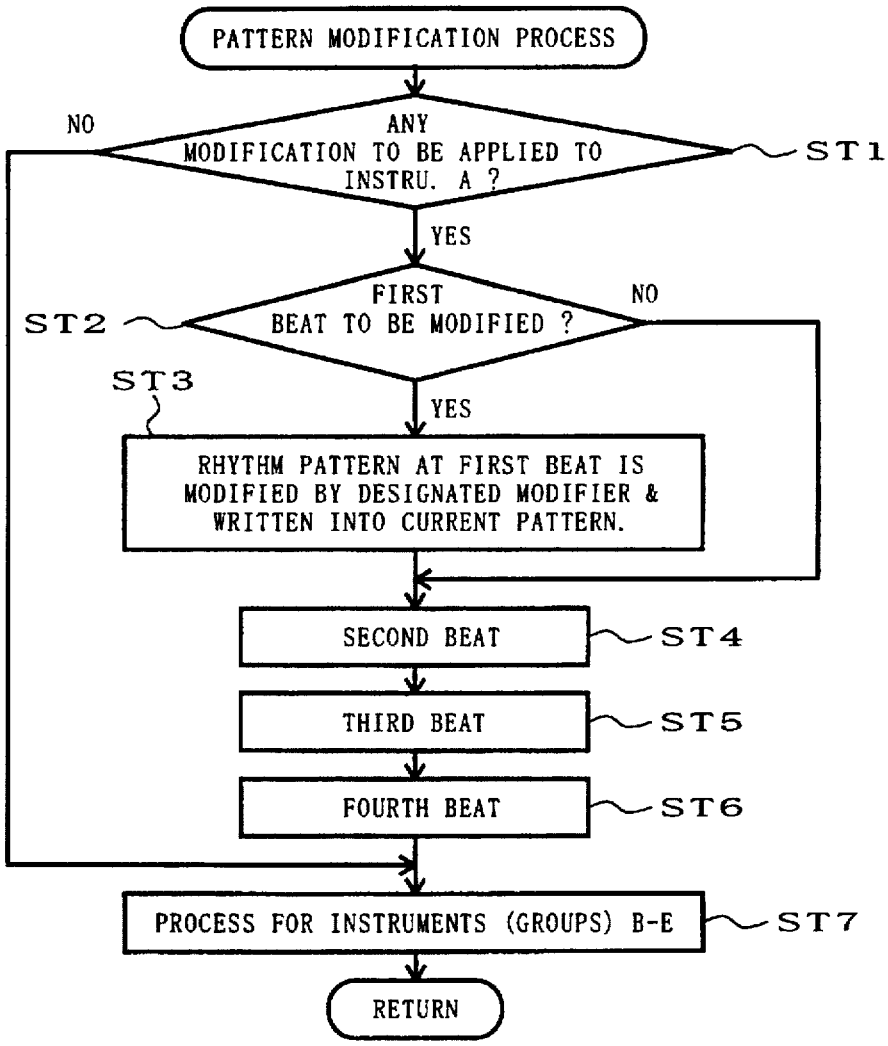
FIG. 27 is a diagram illustrating an example of a modification condition table.
FIG. 28 is a flowchart illustrating the detail of a pattern modification process included in the other processing of FIG. 8 performed by the CPU of the personal computer of FIG. 1.

FIG. 27 shows an example of the modification condition table. As shown, this modification condition table is comprised of a flag area that indicates, for each of plural musical instruments (or musical instrument groups) forming an accompaniment pattern, whether or not to make a modification based on modifier data (presence or absence of a modification to be applied), and a modified-place indicating area.

In the flag area, flag value "1" is set for each musical instrument for which a modification is to be applied, and flag value "0" is set for each musical instrument for which a modification is not to be applied. In the example of FIG. 27, high level flag value "1" is set for three musical instruments B, C and E of the five musical instruments A to E, and this means that the modifier-data-based modification is to be applied to the musical instruments B, C and E. Low level flag value "0" is set for the other two musical instruments A and D for which the modifier-data-based modification is not to be applied.

In the modified-place indicating area, the entire performance pattern length of each musical instrument part is divided into four blocks or sections. In FIG. 27, the entire pattern in the illustrated example has four beats, wherein each place to be modified is indicated as a shaded block or section, each place to not be modified is indicated as a blank block or section, and each shaded or blank block corresponds to a single beat. In the case of musical instrument B, for example, two shaded blocks exist in the latter half of the performance length (i.e., at the third and fourth beats) and this means that the modifier-data-based modification is to be applied only in the latter half. In the case of musical instrument C, shaded blocks exist throughout the performance length (i.e., at the first to the fourth beats) and this means that the modifier-data-based modification is to be applied in the entire performance length. Further, in the case of musical instrument E, a single shaded blocks exist in the first place of the performance length (i.e., at the first beat) and this means that the modifier-data-based modification is to be applied only in the first place.

While in the example of FIG. 27 each place to be modified as a shaded block, it may of course be indicated by high level flag value "1" or low level flag value "0" as with the above-mentioned flag area. Further, this modification condition table may be created and edited optionally by the user. A conversion process using the conversion table will be described in detail below.

Figures 29A, 29B, 30:
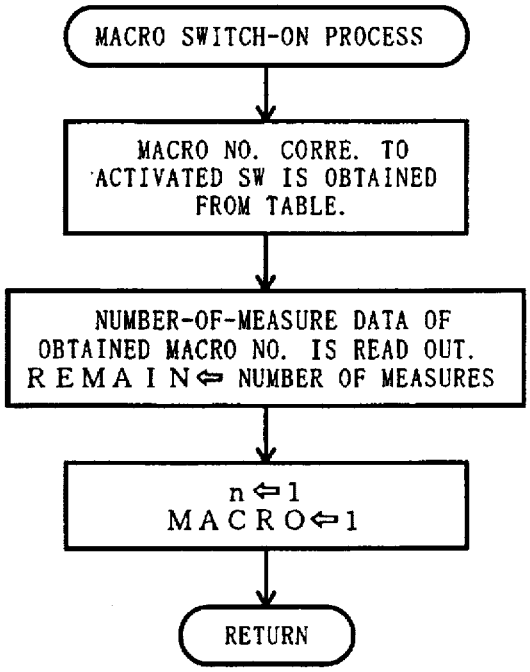
FIG. 29A is a diagram illustrating a detailed example of a modifier macro table.
FIG. 29B is a diagram illustrating a detailed example of a macro allocation table.
FIG. 30 is a flowchart illustrating the detail of a macro switch-on process included in the other processing of FIG. 8 performed by the CPU of the personal computer of FIG. 1.

FIG. 29A shows the detail of a modifier macro table, which is comprised of a number-of-measure area that, using macro numbers "1" to "N" as addresses, indicates the numbers of measures where a modifier-data-based modification is to be applied, and a modification content area that indicates what kind of modifier-data-based modification is to be applied to which measure.

The modifier macro table of FIG. 29A includes N macros. The number-of-measure area for macro 1 stores "4" to indicate that four measures are to be modified. For similar purposes, the number-of-measure area for macro 2 stores "2" indicating that two measures are to be modified; the number-of-measure area for macro 3 stores "1"; the number-of-measure area for macro 4 stores "2"; and the number-of-measure area for macro N stores "3". In this embodiment, the number of measures, "4", such as for macro 1, signifies that a modifier-based modification is applied up to the fourth measure: in macro 1, no modifier is allocated to the second measure and the number of measures to be actually modified is "3".

Further, for each of the macros, the modifier macro table stores, in the locations corresponding to the measures to be modified, the sort of modifier data representing the content of the modification process to be performed. Namely, for macro 1, "modifiers A+C" is stored in the first measure location, "modifier B" in the third measure location, and "modifier E" in the fourth measure location. For macro 2, "modifier B" is stored in the first measure location, and "modifiers C+D" in the second measure location. For macro 3, "modifiers D+A" is stored in the first measure location. For macro 4, "modifier C" is stored in the first measure location, and "modifier B" in the second measure location. Further, for macro N, "modifier B" is stored in the first measure location, "modifiers A+C" in the second measure location, and "modifier E" in the third measure location. Here, the "modifier B" represents that a modification process is performed on the basis of modifier B, and the "modifier E" represents that a modification process is performed on the basis of modifier E. The "modifiers A+C" represents that a modification process is first applied to a pattern portion (e.g., a certain measure) on the basis of modifier A and then a modification process is performed on the basis of modifier C (in practice, these two modification processes are performed simultaneously, namely, dual modifications are applied to the same pattern portion). Similarly, the "modifiers C+D" represents that a modification process is first applied to a pattern portion (e.g., a certain measure) on the basis of modifier C and then a modification process is performed on the basis of modifier D, and likewise the "modifiers D+A" represents that a modification process is first applied to a pattern portion (e.g., a certain measure) on the basis of modifier D and then a modification process is performed on the basis of modifier A.

FIG. 29B is a diagram illustrating a macro allocation table that indicates which modifier macros in the modifier macro table of FIG. 29A are allocated to which macro switches. The macro switches comprise four push button switches, and the last activated push button switch remains effective.

In the example of FIG. 29B, macro number "1", i.e., macro 1 of FIG. 29A is allocated to the first macro switch, macro 2 to the second macro switch, macro 4 to the third macro switch, and macro 5 to the fourth macro switch. Thus, when the first macro switch is activated last, the transformer 9, in accordance with macro 1 of the modifier macro table, proceeds with a series of modifier macro processes, where modifications are applied on the basis of modifiers A and C in the first measure, no modification is applied in the second measure, a modification is applied on the basis of modifier C in the third measure, and then a modification is applied on the basis of modifier E in the fourth measure. The modifier macro table and macro allocation table may be created and edited optionally by the user.

Further, in this embodiment, modifier editing operators are provided for editing the modifier data, and these operators are implemented by keyboard keys and ten-keys on the switch panel 2B of FIG. 1. The editing process by such modifier editing operators includes modifier creating, modifier editing, modifier copying, modifier removing processes, etc. as will be later described in detail.

The details of the individual modifiers will be described.

Figure 32:
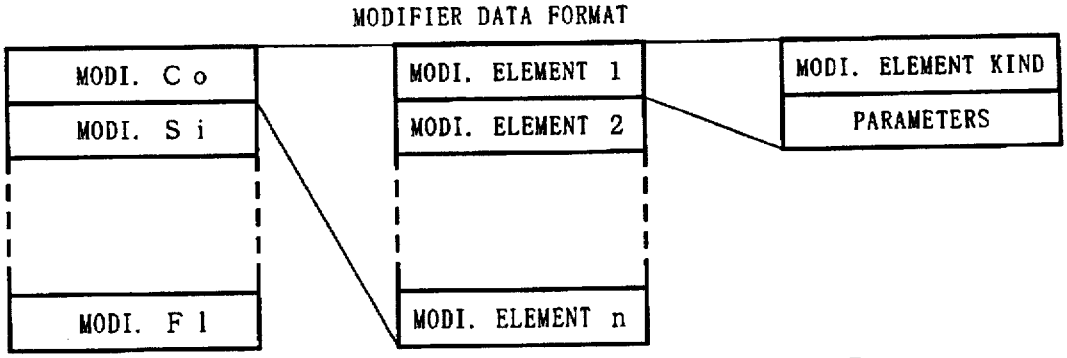
FIG. 32 is a diagram illustrating the data format of modifiers.

FIG. 32 illustrates the data format of the modifiers. As illustrated, each modifier is comprised of plural desired modification elements 1–n, and each of the modification elements is comprised of data indicative of the kind of the element and parameters. The number of the modification elements varies from 2 to 3 depending on the modifier. The kind of the modification element is an algorithm (program) which, on the basis of parameters, describes what kind of modification is to be applied to the current pattern. Therefore, the content of each modifier can be changed by changing the algorithm and parameters via the modifier editing process.

The complexing processing (Complex) described by modifier "Co" is formed of, for example, two modification elements. The algorithm of the first modification element of the complexing processing is typically directed to searching, for example, a rock music pattern in the data base means 5 for a triplet note pattern corresponding to a preselected pattern prototype called "template" and then adding the searched-out note pattern to the current pattern. In this first modification element, the "template" and "triplet note" are the parameters. Therefore, the first modification element of the complexing process can be rewritten by changing the template, changing the triplet note into quintuplet note, or the like. The algorithm of the second modification element of the complexing processing is typically directed to randomly extracting from the data base means 5 such drum sound which constitutes a non-crash component and then adding the extracted drum sound to the current pattern. In this second modification element, the "crash" is the parameter.

The simplifying processing (Simple) described by modifier "Si" is formed of, for example, three modification elements. The algorithm of the first modification element of the simplifying processing is typically directed to searching through the data base means 5 for a rhythm pattern which is closer to a basic rhythm pattern than that of bus drum (BD) and snare drum (SD) of the current pattern, and then replacing the current pattern with the searched-out rhythm pattern. In this first modification element, the "bus drum" and "snare drum" are the parameters. The algorithm of the second modification element of the simplifying processing is typically directed to searching through the data base means 5 for a rhythm pattern which is closer to a basic rhythm pattern than that of high hat (HHC, HHO) in the current pattern, and then replacing the current pattern with the searched-out rhythm pattern. In this second modification element, the "high hat" is the parameter. That is, the first and second modification elements are different from each other only in content of parameter. Further, the third modification element of the simplifying processing is typically directed to removing, from the current pattern, rhythm pattern of a component other than those of the above-mentioned bus drum (BD), snare drum (SD) or high hat (HHC, HHO). In this third modification element, the "bus drum", "snare drum" and "high hat (HHC, HHO)" are the parameters.

The hardening processing (Hard) described by modifier "Ha" is formed of, for example, two modification elements. The algorithm of the first modification element is typically directed to uniformly increasing the value of all the velocity data of the rhythm pattern in the current pattern. In this second modification element, the "all" and "uniformly" are the parameters. The algorithm of the second modification element is typically directed to changing the drum sounds in the current pattern from those of a softening component to those of a hardening component.

Here, among such drum sounds forming the hardening component are bus drum (BD), snare drum (SD), tom tom (Tom H, Tom M, Tom L), cowbell (Cowbell), agogo (Agogo H, Agogo L), hand claps (Claps) and crash cymbals (Crash CY), while among such drum sound forming the softening component are claves (Clave), tambourine (Tamb), high hat (HHC, HHO), ride cymbals (CY), conga (Conga H, Conga L), wood block and shaker. Thus, several kinds of modification element can be created by setting these drum sounds as parameters. Wood block and shaker are listed here just by way of example as the softening component forming drum sound, although they are not actually allotted to the keyboard 1A in this embodiment.

The softening processing (Soft) described by modifier "So" is formed of, for example, two modification elements. The algorithm of the first modification element is typically directed to uniformly decreasing the value of all the velocity data of the rhythm pattern in the current pattern. In this first modification element, the "all" and "uniformly" are the parameters. The algorithm of the second modification element is typically directed to changing the drum sounds in the current pattern from those of a hardening component to those of a softening component. In this second modification element, the "softening component" and "hardening component" are the parameters.

Further, the energizing processing (Energetic) described by modifier "En" is formed of, for example, the following three modification elements. The algorithm of the first modification element is typically directed to increasing the number of template-based note patterns within the current pattern. In this first modification element, the "template" is the parameter. The algorithm of the second modification element is typically directed to causing the tempo speed to approach about "120". In this second modification element, the "120" is the parameter. The algorithm of the third modification element is typically directed to causing the rhythm pattern in the current pattern to approach a triplet rhythm pattern on the basis of the template (shuffling process). In this third modification element, the "template" and "triplet" are the parameters.

The calming processing (Calm) described by modifier "Ca" is formed of, for example, the following three modification elements. The algorithm of the first modification element is typically directed to decreasing the number of template-based note patterns within the current pattern. In this first modification element, the "template" is the parameter. The algorithm of the second modification element is typically directed to causing the tempo speed to approach an approximate value of "60". Namely, this second modification element is similar to the second modification element of the energizing process, except that the parameter is "60" as compared to "120" in the latter-said element. The algorithm of the third modification element is typically directed to causing the rhythm pattern in the current pattern to approach a non-triplet rhythm pattern on the basis of the template (non-shuffling process). In this third modification element, the "template" and "non-triplet" are the parameters.

Furthermore, the mechanizing processing (Mechanical) described by modifier "Me" is formed of, for example, the following four modification elements. The algorithm of the first modification element is typically directed to quantizing the rhythm pattern in the current pattern to within a resolution of sixteenth note. In this first modification element, the "template" and "sixteenth" are the parameters. The algorithm of the second modification element is typically directed to, on the basis of a template for bus drum (BD) or snare drum (SD), quantizing the rhythm pattern in the current pattern to within a resolution of eighth note. In this second modification element, the "template", "bus drum (BD)", "snare drum (SD)" and "eighth" are the parameters. The algorithm of the third modification element is typically directed to changing the drum sounds in the current pattern from those of a softening component to those of a hardening component. In this third modification element, the "softening component" and "hardening component" are the parameters. The algorithm of the fourth modification element is typically directed to compressing the velocity data to a value centering around "90". In this fourth modification element, the "90" is the parameter.

Furthermore, the gracing processing (Graceful) described by modifier "Gr" is formed of, for example, the following four modification elements. The algorithm of the first modification element is typically directed to extending the velocity data in opposite directions about a value of 64. In this first modification element, the "64" is the parameter. The algorithm of the second modification element is typically directed to adding triplet note pattern to the current pattern on the basis of a template. In this second modification element, the "template" and "triplet" are the parameters. The algorithm of the third modification element is typically directed to changing the drum sounds in the current pattern from those of a hardening component to those of a softening component. In this third modification element, the "hardening component" and "softening component" are the parameters. The algorithm of the fourth modification element is typically directed to applying flutter (decorative sound) to the drum sound in the current pattern. In this fourth modification element, the "flutter" is the parameter.

Moreover, the stuttering processing (Stuttering) described by modifier "St" is formed of, for example, the following two modification elements. The algorithm of the first modification element is typically directed to, on the basis of a template, replacing downbeat in the rhythm pattern of the current pattern with upbeat (syncopation process). In this first modification element, the "template" is the parameter. The algorithm of the second modification element is typically directed to adding triplet note pattern to the current pattern on the basis of a template. In this second modification element, the "template" and "triplet" are the parameters.

Finally, the floating processing (Floating) described by modifier "Fl" is formed of, for example, the following five modification elements. The algorithm of the first modification element is typically directed to, on the basis of a template, replacing upbeat in the rhythm pattern of the current pattern with downbeat (non-syncopation process). In this first modification element, the "template" is the parameter. The algorithm of the second modification element is typically directed to, on the basis of a template, decreasing the number of triplet note patterns in the current pattern. In this second modification element, the "template" and "triplet" are the parameters. The algorithm of the third modification element is typically directed to, on the basis of a template, adding 12/8-triplet rhythm pattern to the current pattern. In this third modification element, the "template"

and "12/8-triplet" are the parameters. The algorithm of the fourth modification element is typically directed to changing the drum sounds in the current pattern from those of a hardening component to those of a softening component. In this fourth modification element, the "hardening component" and "softening component" are the parameters. The algorithm of the fifth modification element is typically directed to causing the tempo speed to approach to an approximate value of "120". In this fifth modification element, the "120" is the parameter.

FIG. 28 is a flowchart illustrating the detail of a pattern modification process included in the other processing of FIG. 8 performed by the CPU 21 of the personal computer 20. This pattern modification process is performed in accordance with the setting of the modification condition table.

First, a determination is made in step ST1 as to whether musical instrument A (musical instrument group A) has any modification to be applied, i.e., whether high level "1" is set in the flag area of the modification condition table. If answered in the affirmative in step ST1, it is further determined in step ST2 whether the first beat of musical instrument A (musical instrument group A) is to be modified, i.e., whether the first beat in the modified-place indicating area for musical instrument A (musical instrument group A) is indicated as a shaded block. If the first beat is to be modified, the rhythm pattern at the first beat is modified on the basis of the designated modifier and the resultant modified pattern is written into the current pattern in step ST3.

If step ST2 has determined that the first beat is not to be modified, or when the modification of the first beat has been completed, the same operations of steps ST2 and ST3 as performed on the first beat are repeated for the second beat in step ST4. That is, it is determined whether the second beat of musical instrument A (musical instrument group A) is to be modified, and, if the first beat is to be modified, the rhythm pattern at the second beat is modified on the basis of the designated modifier so that the resultant modified pattern is written into the current pattern. Then, the same modification process is repeated for the third and fourth beats (steps ST5 and ST6).

If step ST1 has determined that musical instrument A (musical instrument group A) has no modification to be applied, or when the modification of musical instrument A (musical instrument group A) has been completed, the same operations of steps ST1 through ST6 as performed on musical instrument A (musical instrument group A) are repeated for musical instrument B (musical instrument group B) (routine ST7). That is, a determination is made as to whether musical instrument B (musical instrument group B) has any modification to be applied, a determination is made on each of the first to fourth beats, then a modification is applied to the rhythm pattern of each of the beasts having been determined as the one to be modified in accordance with the designated modifier, and then each modified rhythm pattern is written into the current pattern.

The above-mentioned modification process is repeated for musical instrument C (musical instrument group C), musical instrument D (musical instrument group D) and musical instrument E (musical instrument group E). In this way, all the musical instruments A–E (musical instrument groups A–E) are subjected to the pattern modification process.

FIG. 30 is a flowchart illustrating the detail of a macro switch-on process included in the other processing of FIG. 8 performed by the CPU 21 of the personal computer 20. This macro switch-on process is triggered by the activation of any of macro switches (not shown) on the switch panel of FIG. 1.

First, the macro number corresponding to the activated or turned-on macro switch is obtained from the macro allocation table of FIG. 29B, and then the number of measures associated with the obtained macro number is read out from the modifier macro table of FIG. 29A for storage into a remaining-number-of-measure register REMAIN. After that, the CPU returns to the main routine after setting "1" to variable n and to macro designation flag MACRO.

Figure 31:
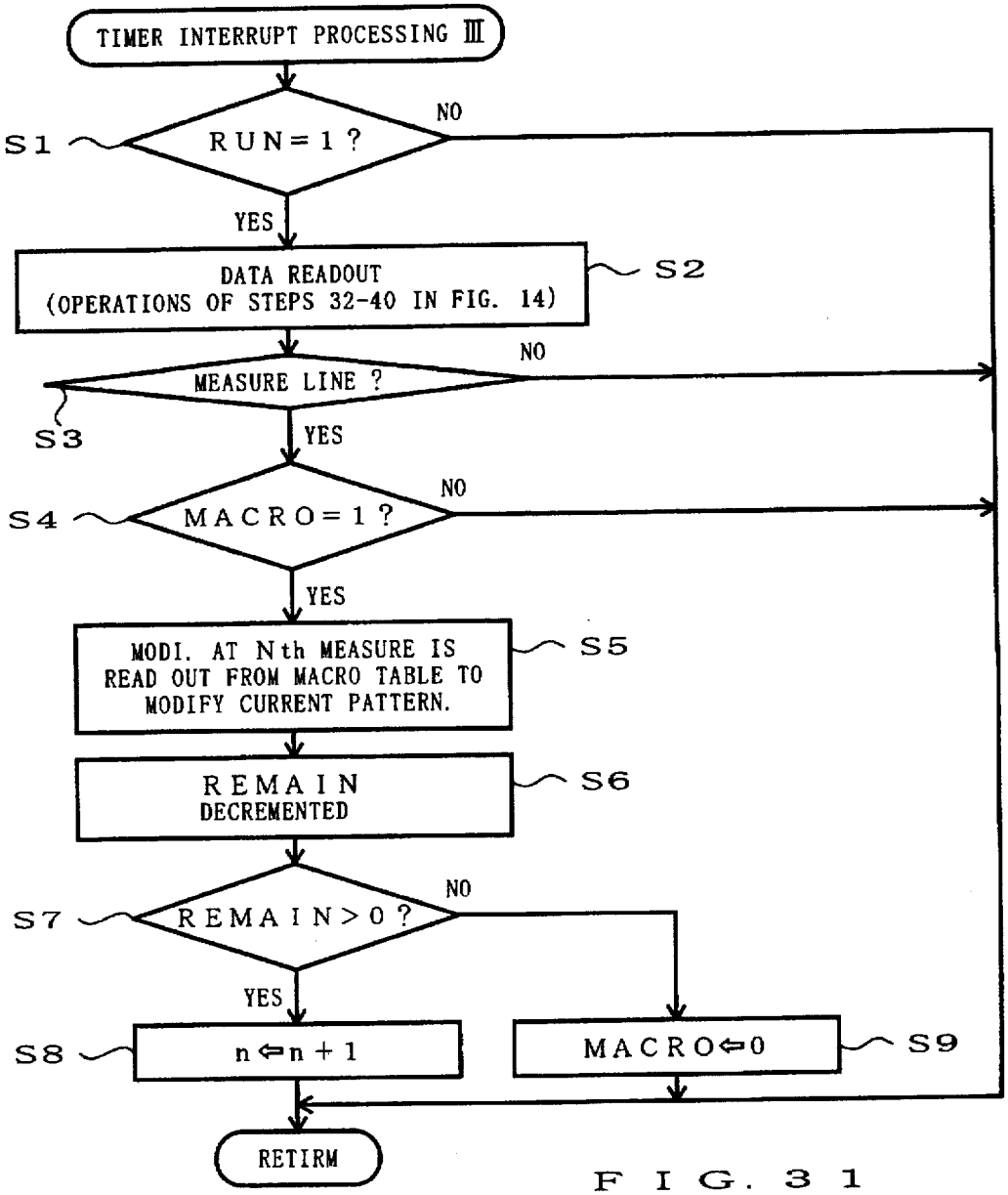
FIG. 31 is a flowchart of timer interrupt processing III performed at a frequency of 480 times per quarter note, showing a portion of the processing associated with the macro switch-on process of FIG. 30 performed in response to the operation of a macro switch.

FIG. 31 is a flowchart of timer interrupt processing III performed at a frequency of 480 times per quarter note, showing a portion of the processing associated with the macro switch-on process of FIG. 30 performed in response to the activation of the macro switch. This timer interrupt processing III is repeated in correspondence to a tempo at which the current pattern is read out from the current pattern memory 1. Namely, the timer interrupt frequency is varied by the tempo. The timer interrupt processing III is performed in the following step sequence.

Step S1: A determination is made as to whether or not the flag RUN is at high level "1". If the determination is in the affirmative (YES), the program goes to a next step S2; if not, the program immediately returns to the main routine.

Step S2: Event data are sequentially read out from the current pattern memory 1 to carry out operations corresponding to the read-out event data. Namely, this step performs operations similar to those of steps 32 to 40 in the timer interrupt processing of FIG. 14.

Step S3: It is determined whether the readout timing in the measure (in-measure readout timing) coincides with measure line timing. If the determination is in the affirmative, the program advances to a next step S4; otherwise, the program returns to the main routine.

Step S4: A determination is made as to whether the macro designation flag is at high level "1". If answered in the affirmative, the program continues to step S5, but if not, the program returns to the main routine.

Step S5: The modifier for the "n"th measure of the macro number is read out from the modifier macro table to modify the current pattern on the basis of the read-out modifier.

Step S6: The value in the remaining-number-of-measure register REMAIN is decremented by one.

Step S7: A determination is made as to whether the value in the remaining-number-of-measure register REMAIN is greater than "0". If the remaining number is greater than "0" (YES), the program proceeds to step S8; otherwise, the program branches to step S9.

Step S8: Variable n is incremented by one, and then the program returns to the main routine.

Step S9: The macro designation flag is reset to low level "0", and then the program returns to the main routine.

For example, when the third macro switch has been activated, macro number "4" is obtained from the macro allocation table, and the number-of-measure is "2" for the obtained macro number "4" in the modifier macro table. Hence, "2" is stored into the remaining-number-of-measure register REMAIN, and high level "1" is stored into the variable n and macro designation flag MACRO. Then, the timer interrupt processing III is executed, in which event data corresponding to the current in-measure readout timing is read out from the current pattern memory 1 in step S2 since the flag RUN is at high level "1".

Once the in-measure readout timing reaches measure line timing, the operation of step S4 is performed, where an affirmative (YES) determination results because the macro designation flag MACRO is at high level "1", so that the operations of steps S5 and S6 are performed. Namely, in step S5, modifier C for the first measure of macro number "4" is read out from the modifier macro table so as to modify the current pattern on the basis of the read-out modifier C, and in next step S6, the value in the remaining-number-of-measure register REMAIN is decremented from "2" to "1". Because the remaining-number-of-measure register REMAIN is not "0", an affirmative determination results in step S7, so that the operation of step S8 is performed to increment the variable n from "1" to "2".

Then, once the in-measure readout timing reaches measure line timing of the second measure, the operation of step S4 is performed, where an affirmative (YES) determination results because the macro designation flag MACRO is at high level "1", so that the operations of steps S5 and S6 are performed. Namely, in step S5, modifier B for the second measure of macro number "4" is read out from the modifier macro table so as to modify the current pattern on the basis of the read-out modifier B, and in next step S6, the value in the remaining-number-of-measure register REMAIN is decremented from "1" to "0". Because the remaining-number-of-measure register REMAIN is now "0", a negative (NO) determination results in step S7, so that the operation of step S9 is performed to reset the macro designation flag MACRO to "0".

In the above-described manner, the modification process is performed on the basis of the modifier macro table.

Figure 33:
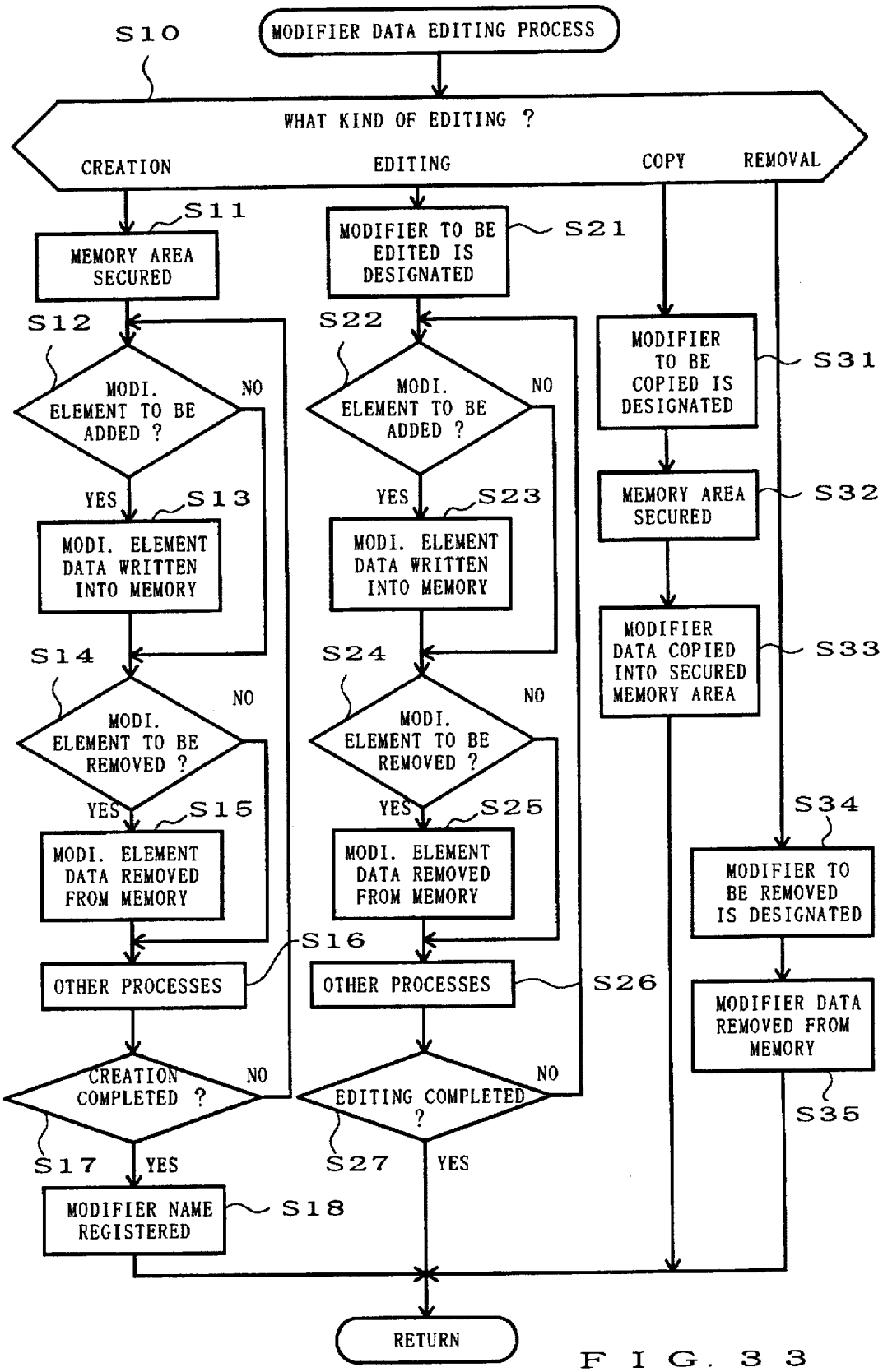
FIG. 33 is a flowchart illustrating the detail of a modifier data editing process included in the other processing of FIG. 8 performed by the CPU of the personal computer of FIG. 1.

FIG. 33 is a flowchart illustrating the detail of a modifier data editing process included in the other processing of FIG. 8 performed by the CPU 21 of the personal computer 20. The modifier data editing process is trigger by the activation of any of modifier editing keys or operators provided on the switch panel 2B, which include a modifier creating key, modifier editing key, modifier copying key and modifier removing key. The modifier data editing process is performed in the following step sequence.

Step S10: A determination is first made as to the sort of editing to be made, i.e., which of the above-mentioned modifier editing keys has been activated or operated, and a different branch is made depending on the activated key. That is, where the modifier creating key has been activated, a branch is made to the modifier creating process of steps S11 to S18; where the modifier editing key has been activated, a branch is made to the modifier editing process of steps S21 to S27; where the modifier copying key has been activated, a branch is made to the modifier copying process of steps S31 to S33; and where the modifier removing key has been activated, a branch is made to the modifier removing process of steps S34 to S35.

The process of steps S11 to S18 is triggered by the activation of the modifier creating key.

Step S11: Because of the determination in the preceding step that the modifier creating process is to be performed, a memory area for storing a modifier to be created is secured in the RAM 23.

Step S12: A determination is made as to whether or not to add any modification element constituting the modifier to be created. If the determination is in the affirmative, the program proceeds to next step S13; otherwise, the program jumps to step S14.

Step S13: The modification element data is written into the memory area (which has been secured in step S11).

Step S14: A determination is made as to whether or not to remove any modification element constituting the modifier to be created. If the determination is in the affirmative, the program proceeds to next step S15; otherwise, the program jumps to step S16.

Step S15: The modification element data is removed from the memory area storing the modifier to be created.

Step S16: Other processing is performed, such as rewriting the sort of modification element (program change), modification of parameters, etc.

Step S17: It is ascertained whether or not the modifier creating process has been completed. If answered in the affirmative, the program proceeds to step S18, but if the modifier creating process has not been completed, the program reverts to step S12 so as to repeat the operations of S12 to S16.

Step S18: Since the creating process has been completed, the name of the created modifier is registered, and the program returns to the main routine.

The process of steps S21 to S27 is triggered by the activation of the modifier editing key.

Step S21: The modifier to be edited is designated by name. For instance, modifier name Co is designated for the complexing processing; modifier name Si for the simplifying processing; modifier name Ha for the hardening processing; modifier name So for the softening processing; modifier name En for the energizing processing; modifier name Ca for the calming processing; modifier name Me for the mechanizing processing; modifier name Gr for the gracing processing; modifier name St for the stuttering processing; and modifier name Fl for the floating processing.

Step S22: A determination is made as to whether or not the editing is intended for addition of a modification element. If the determination is in the affirmative, the program proceeds to next step S23; otherwise, the program jumps to step S24.

Step S23: The modification element data to be added is written into a memory area storing the modifier to be edited.

Step S24: A determination is made as to whether or not the editing is intended for removal of a modification element. If the determination is in the affirmative, the program proceeds to next step S25; otherwise, the program jumps to step S26.

Step S25: The modification element data is removed from the memory area storing the modifier to be edited.

Step S26: Other processing is performed, such as rewriting the sort of modification element constituting the modifier to be edited (program change), modification of parameters, etc.

Step S27: It is ascertained whether or not the modifier editing process has been completed. If answered in the affirmative, the program returns to the main routine, but if the modifier editing process has not been completed, the program reverts to step S22 so as to repeat the operations of S22 to S26.

The process of steps S31 to S33 is triggered by the activation of the modifier copying key. First, in step S31, the modifier to be copied is designated by name. Then, in step S32, a memory area for storing the modifier to be copied is secured in the RAM 23. After that, in step S33, the designated modifier is copied into the memory area secured in the preceding step, and then the program returns to the main routine.

Finally, the process of steps S34 and S35 is triggered by the activation of the modifier removing key. The modifier to be removed is designated by name in step S34, then the modifier data to be removed is removed from the memory area, and then the program returns to the main routine.

The new modifiers made in the above-mentioned manner may be separately allocated to the transformer keys corresponding to note numbers D2, E2, F2, G2 and A2 on the keyboard 1A.

Further, such new modifiers may be designated as desired via the modification condition table of FIG. 27 or the modifier macro table of FIG. 29A.

As has been described so far, the present invention facilitates creation and modification of accompaniment patterns, and can achieve performance full of variety without a need to previously store a large quantity of accompaniment patterns.

Next, still another embodiment of the present invention will be described below with reference to FIGS. 34 and 35. In this embodiment, it is allowed to ascertain how the rhythm pattern modified in the above-mentioned transformer process has changed from the pre-modification state. It is also allowed to ascertain what kind of modification element (detailed modification algorithm) is used for the modification: in the complexing processing, for example, the first modification element is to search the data base means 5 for a triplet rhythm pattern corresponding to a predetermined pattern prototype called a template and then add the searched-out pattern to the current pattern (search template process), and the second modification element is to randomly extract from the data base means 5 such drum sound which constitutes a non-crash component and then add the extracted drum sound to the current pattern (add component process).

Figure 34:
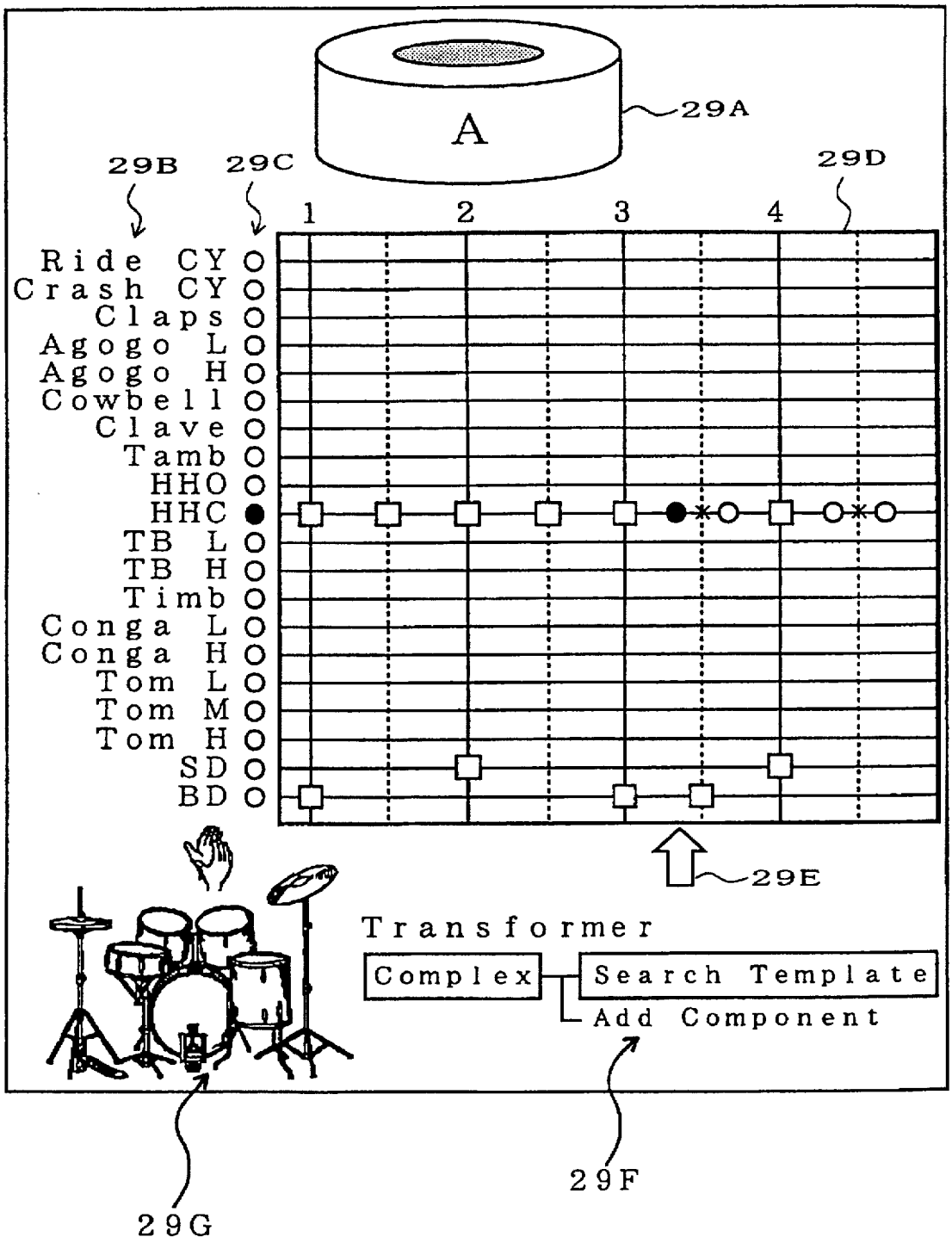
FIG. 34 is a diagram showing another example of video information shown on the display.

FIG. 34 is a diagram showing another example of video information shown on the display 29 of FIG. 1. Of one-measure rhythm pattern presented on the current pattern display section 29D, each event newly added in the transformer process is indicated by a circular lighting spot, while each event removed by the transformer process is indicated by a cross lighting spot. With such an arrangement, the user can visually ascertain how the rhythm pattern has changed through the current modification, and also can readily recognize the relationship between the designated modifier and the state of the actually effected modification.

Further, below the current pattern display section 29D is provided a transformer display section 29F that indicates which of the plural transformer modifiers has been designated and which of the plural modification elements constituting the modifier has been used for the modification. The example of FIG. 34 shows that "complex" has been designated as a transformer modifier, that the modifier "complex" comprises two modification elements, search template and add component processes, and that only the search template process is highlighted (enclosed in a rectangular frame in the illustrated example). Thus, the display section 29F in the illustrated example indicates that only the search template process is used to execute the current modification. Accordingly, a combined display of the current pattern display section 29D and transformer display section 29F allows the user to readily recognize the relationship between the activated modification element and the state of the actually effected modification. Of course, where the two modification elements have been activated, both the elements are displayed in a highlighted fashion.

Further, to the left of the transformer display section 29F is provided a drum set display section 29G where a set of typical drum sounds is presented in the form of a picture depicting a corresponding drum set. In this display section 29G, each musical instrument associated with a sound being generated is displayed in a manner (in a different or reversed color) to be distinguishable from other musical instruments associated with sounds not being generated.

Figure 35:
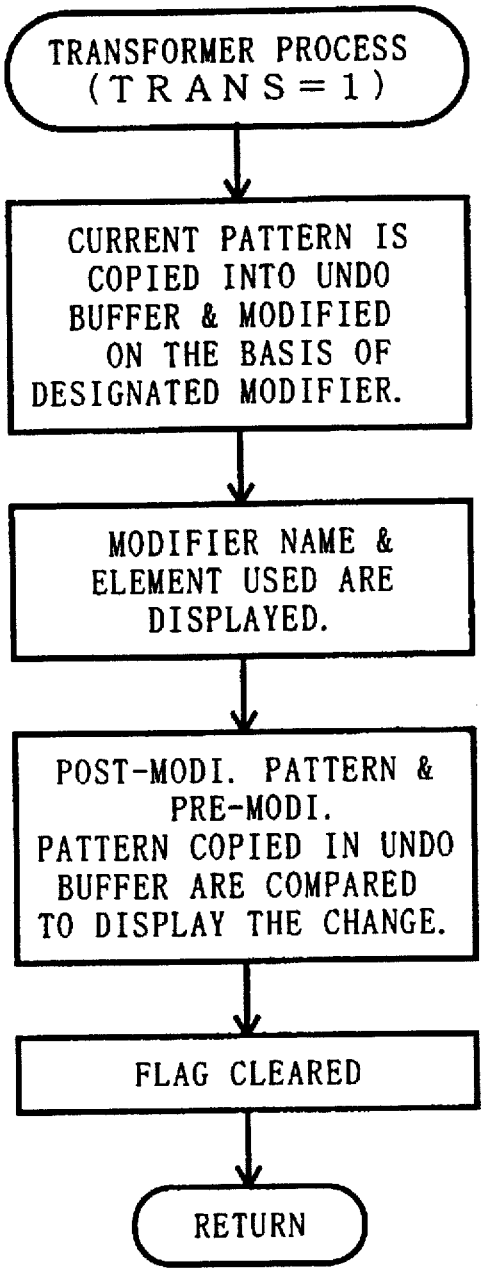
FIG. 35 is a flowchart illustrating an example of the transformer process corresponding to the displayed information of FIG. 34, which is performed as part of a second flag-correspondent processing of FIG. 1.

FIG. 35 is a flowchart illustrating an operational flow corresponding to the displayed information of FIG. 34, which is a modification of the transformer process of FIG. 16D. Processing associated with the display of FIG. 34 is performed in place of the transformer process of FIG. 16D in such a case where the transformer flag TRANS is set at high level "1" (TRANS=1) by the activation of any of the transformer keys corresponding to note numbers D2, E2, F2, G2 and A2 on the keyboard 1A.

In the transformer process of FIG. 35, the current pattern in the current pattern memory 1 is first copied into the undo buffer 3, and the above-mentioned arithmetic operations are conducted to modify the current pattern on the basis of the designated modifier. Then, the name of the modifier ("Complex" in the illustrated example of FIG. 34) and any of the modification element constituting the modifier which has been used for the modification are indicated on the display 29, and each of the modification elements actually used for the modification is displayed in a highlighted fashion. Next, a comparison is made between the post-modification current pattern and the pre-modification current pattern copied in the undo buffer, so as to display how the pattern has been modified as shown in FIG. 34. After that, the transformer flag TRANS is cleared to low level "0".

While, in the above-mentioned embodiment, each event newly added in the transformer process is indicated by a circular lighting spot and each event removed by the transformer process is indicated by a cross lighting spot with each unchanged event being indicated by a square lighting spot, all these events may be indicated by lighting spots of a same shape. In such a case, the added event, removed event and unchanged events may be made distinguishable such as by varying the displayed color, the size of the displayed mark or the shaded pattern among these events.

Furthermore, where the velocity data, tone color etc. have changed due to the transformer process, such changes may be visually displayed for recognition of the user. For example, where the velocity data has changed, the displayed mark representative of the associated event may be changed in size, or where the tone color has changed, the color or shape of the displayed mark may be changed.

Moreover, the present invention may be applied to other than automatic rhythm performance, such as automatic accompaniment containing bass performance and/or chord-backing performance.

As has been described so far, the present invention simplifies and facilitates necessary operations for rhythm pattern modification, and thereby allows the user to readily obtain desired accompaniment patterns. It also allows the user to readily recognize how a pattern is modified, as well as the relationship between the modifier or modification element and a manner in which actual modification is effected using the modifier or modification element.

Next, various modifications of the present invention will be described with reference to FIGS. 36 to 45.

Figure 36:
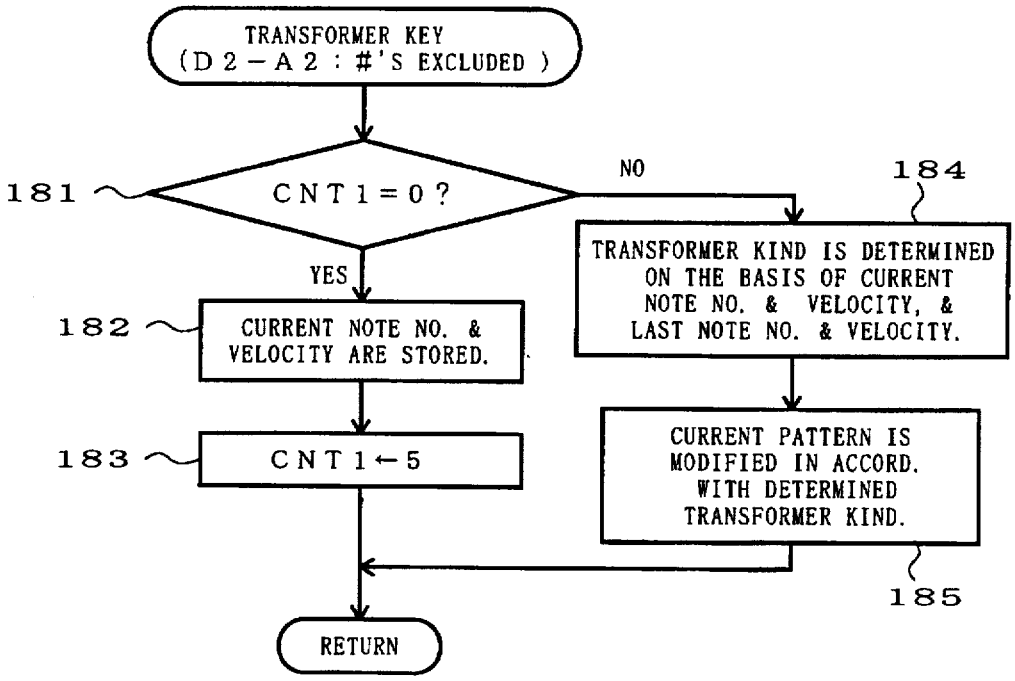
FIG. 36 is a flowchart illustrating a detailed example of the MIDI message reception processing of FIG. 8B, which is performed when a received MIDI message is a note-on message corresponding to a transformer key of any of note numbers D2 to A2 (excluding #'s)
Figure 37:
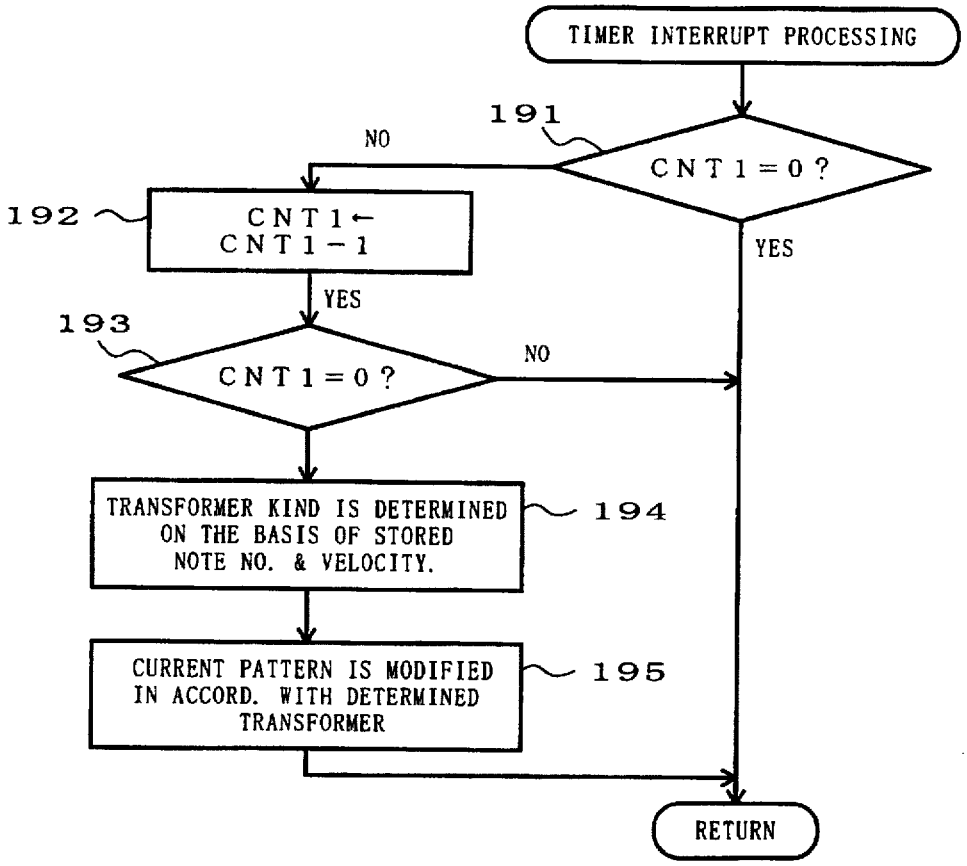
FIG. 37 is a flowchart illustrating the detail of timer interrupt processing performed every 10 ms in connection with the example of FIG. 36.

The first modified example as will be described in relation to FIGS. 36 and 37 is characterized in that, where two of the above-mentioned transformer designation keys are activated practically simultaneously, it causes a kind of transformer (=modifier), different from where either of the keys is activated singly, to be designated, thereby allowing an increased number of transformers to be designated by a limited number of designation operators.

FIG. 36 is a flowchart illustrating a detailed example of a processing routine, corresponding to the first modified example, which is performed by the CPU 21 of the personal computer 20 when a received MIDI message from the electronic musical instrument 1F is a key-on message corresponding to a transformer key of any of note numbers D2 to A2 (excluding #'s). Upon receipt of the MIDI message of any of note numbers D2 to A2 (excluding #'s), a determination is made in step 181 as to whether the counter CNT1 is at a count "0". If answered in the affirmative, the note number and velocity value associated with the current key-on event are stored into respective registers in step 182. Then, the program proceeds to step 183 in order to set a value "5" to the counter CNT1. The counter CNT1 is a vertual counter realized by a soft ware progam, that counts down by one for every predetermined time (10 ms in this embodiment) and counts up to about 50 ms by being set at "5" as mentioned. If the counter CNT1 is not at a count of "0" as determined in step 181, i.e., if the counter CNT1 is at a count from 5 to 1, the program proceeds to step 184, where the transformer's kind is determined on the basis of a combination of the current note number and velocity value and the last note number and velocity value. Then, in step 185, a transformer process is performed in accordance with the determined transformer's kind in the same manner as previously mentioned, so as to modify the current pattern.

The negative determination results in step 181 when the count value of the counter CNT1 is any of "5" to "1", i.e., where time elapsed from the last key-on timing is not longer than 50 ms. In such a case, it is considered that two transformer keys have been activated substantially simultaneously, so that the transformer's kind is determined on the basis of a combination of the current note number and velocity value and the last note number and velocity value, in such a manner that the determined transformer's kind differs from the one determined only on the basis of the last note number and velocity value or on the basis of the current note number and velocity value.

In the above-described embodiments, either of two different transformer's kinds can be designated depending on whether the velocity value is greater than a predetermined value or not, so that ten kinds of transformers are selectable by use of five transformer keys. By contrast, in the first modified example, the above-mentioned combinational approach will permit a selection from a total of 40 kinds (transformer key 1-high velocity and transformer key 2-low velocity; transformer key 1-high velocity and transformer key 2-high velocity; transformer key 1-high velocity and transformer key 3-low velocity; transformer key 1-high velocity and transformer key 3-high velocity; . . . ). This allows an increased number of the transformer kinds by used of a limited number of the keys. Each transformer kind designated by such a combination may have nothing to do with the respective transformer kinds designated by separately activated individual keys, or may be a mixture of the respective transformer keys designated by separately activated individual keys (e.g., complex and energetic process, simple and graceful process or the like).

FIG. 37 is a flowchart illustrating the detail of timer interrupt processing performed by the CPU 21 of the personal computer 20, where the counter CNT1 having been set at "5" in step 183 of FIG. 36 is decremented and the transformer process is performed once the counter CNT1 reaches a count "0" as a result of the decrement. This timer interrupt processing is executed every 10 ms.

First, in step 191, a determination is made as to whether the counter CNT1 is at a count value "0". If answered in the affirmative, the CPU 21 immediately returns to the main routine since it is no longer necessary to count down. If the count value is other than "0", the CPU 192 branches to step 192 to decrement the value in the counter CNT1 by one. Then, it is further determined in step 193 whether the counter CNT1 has reached "0". With an affirmative answer in step 193, the CPU 21 proceeds to step 194 where a transformer kind is determined on the basis of the note number and velocity values stored in the respective registers, and then to step 195 where the transformer process is executed in accordance with the determined transformer kind so as to modify the current pattern. With a negative answer in step 193, however, the CPU 21 immediately returns to the main routine. When the interrupt processing has been performed five times (i.e., when about 50 ms has passed) since any of the transformer keys was activated last, it is considered that the transformer key was operated singly, so that the current pattern is modified by a transformer key determined on the basis of the note number and velocity value associated with the key operation.

It should be appreciated that the time period threshold used to determine whether two keys have been operated practically simultaneously may be longer or shorter than about 50 ms. Further, where it is detected that more than two operators have been operated practically simultaneously, a further different modifier may be designated.

Next, the second modified example will be described with reference to FIG. 38. In this modified example, if the transformer kind associated with the current designation is the opposite in nature to the last designated transformer kind, the pattern prior to the modification by the last transformer process is restored. More specifically, in the above-described embodiments, either of two different modifiers is selectable depending on whether the operating velocity of a single transformer key is high or low, and these two modifiers have respective meanings that are musically opposite to each other (e.g., complex and simple, hard and soft). Every such two modifiers is stored in pair. When the transformer process is to be performed on the basis of a given transformer kind, the content of the pre-modification current pattern is saved in the undo buffer, and then upon designation of a transformer kind opposite to the given transformer kind after completion of the modification based on the given transformer kind, the saved pattern is restored from the undo buffer as the current pattern.

Figure 38:
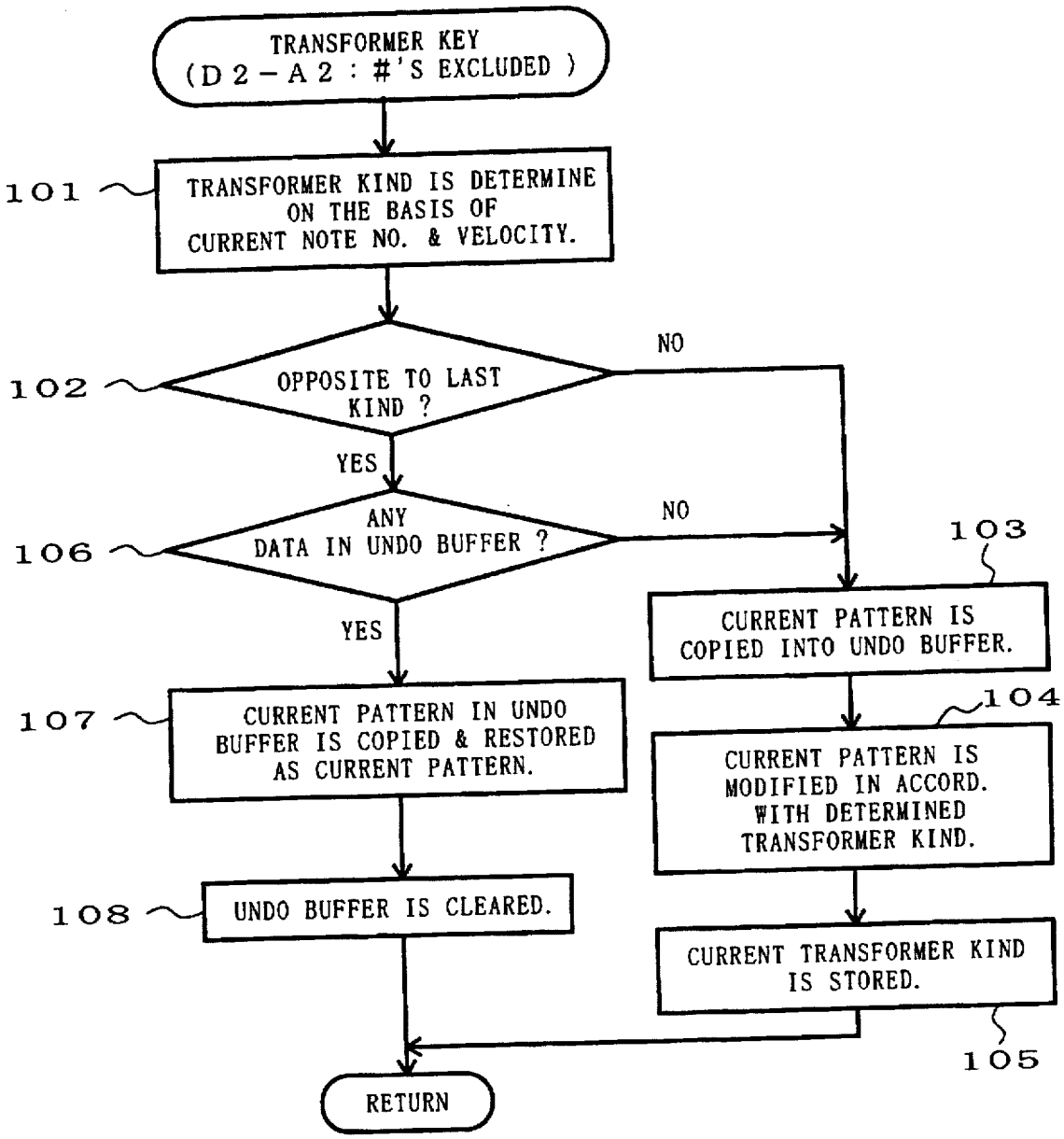
FIG. 38 is a flowchart illustrating another detailed example of the MIDI message reception processing of FIG. 8B, which is performed when a received MIDI message is a note-on message corresponding to a transformer key of any of note numbers D2 to A2 (excluding #'s)

FIG. 38 is a flowchart illustrating another detailed example of the processing routine, corresponding to the second modified example, which is performed by the CPU 21 of the personal computer 20 when a received MIDI message from the electronic musical instrument 1F is a key-on message corresponding to a transformer key of any of note numbers D2 to A2 (excluding #'s). Upon receipt of the MIDI message associated with any of note numbers D2 to A2 (excluding #'s), a transformer kind is determined in step 101 on the basis of the current note number and velocity value. Then, a determination is made in step 102 as to whether the determined transformer kind is the opposite of the last designated transformer kind. With a negative determination in step 102, the CPU 21 branches to step 103 to copy the content of the current pattern into the undo buffer. Then, in step 104, the transformer process is performed in accordance with the determined transformer kind so as to modify the current pattern. Thereafter, in step 105, the current transformer kind is stored into a register.

With an affirmative determination in step 102, the CPU 21 proceeds to step 106 to determine whether there is any pattern data in the undo buffer. If there is pattern data in the undo buffer (YES), the pattern data is copied from the undo buffer into the current pattern so as to restore the current pattern into the state prior to the modification by the last transformer process. Then, in step 108, the undo buffer is cleared so that the above operation for restoring the current pattern into the pre-modification state is effective only once. If a further opposite transformer kind is designated later, the determination in step 106 becomes negative because no pattern data is stored in the undo buffer, and thus the CPU 21 proceeds with operations in and after step 103. For example, in such a case where a transformer kind "complex" is designated when the current pattern is a pattern "A", the pattern "A" is copied into the undo buffer and subjected to the complexing processing so that modified current pattern A' is provided. Then, once a transformer kind "simple" opposite to the transformer kind "complex" is designated, the pattern "A" is read out from the undo buffer and set as the current pattern.

In this way, where the currently designated transformer kind is the opposite of the last designated transformer kind, the accompaniment pattern prior to the modification based on the last modifier designated is restored. This allows the transformer undo designation to fit the user's sense. It should be obvious to people of ordinary skill in the art that this technique may be used in combination with the above-mentioned technique where the transformer process is undone in response to designation made via the undo key. Further, a mode switching means may be provided so that the undo function is turned on or off in response to designation of the opposite transformer kind.

Next, the third modified example of the present invention will be described with reference to FIGS. 39 to 41. According to this third example, where plural transformer processes are designated, only one transformer process is treated as effective, so as to prevent any unintended pattern modification resulting from possible mistouch and chattering. Further, a mode switching means is provided to permit a selection of a mode where only one designated transformer process is made effective as well as a mode where all the designated transformer processes are made effective.

Figure 39:
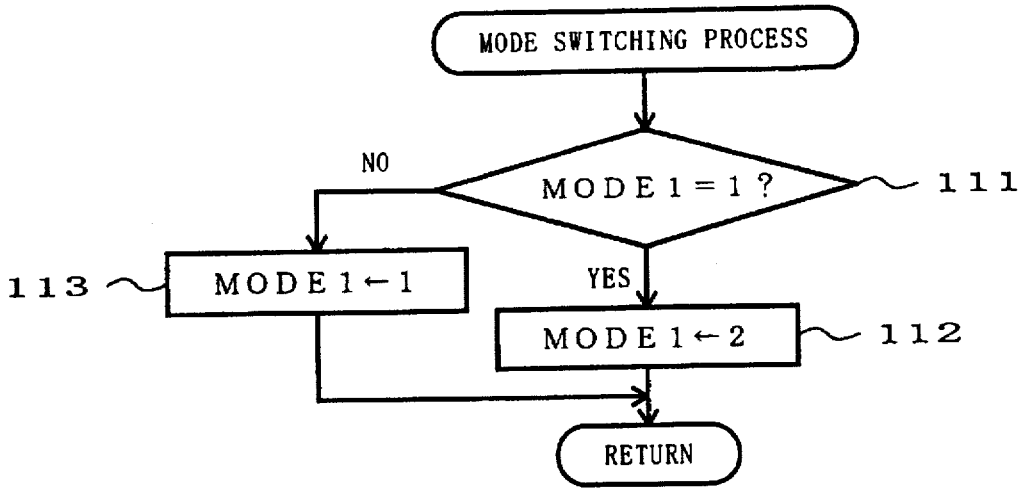
FIG. 39 is a flowchart illustrating the detail of a mode switching process included in the other processing of FIG. 8 performed by the CPU of the personal computer of FIG. 1.

FIG. 39 is a flowchart illustrating the detail of a mode switching process included in the other processing of FIG. 8 performed by the CPU 21 of the personal computer 20. In this mode switching process, when an unillustrated mode switch is activated (such as by using the mouse 2A to select a mode switch displayed on the display 29 of the personal computer 20 and click over the mode switch), it is checked in step 111 whether the current value in mode register MODE1 is "1" or not. If it is "1" (YES), the value in the mode register MODE1 is set to "2" in step 112, but if not, the CPU 21 branches to step 113 to set the mode register MODE1 at "1". Here, the mode register MODE1 at the value of "1" signifies a mode where only the first of two transformer designations occurring within a predetermined time period is made effective, and the mode register MODE1 at the value of "2" signifies a mode where the two transformer designations are both made effective.

Figure 40:
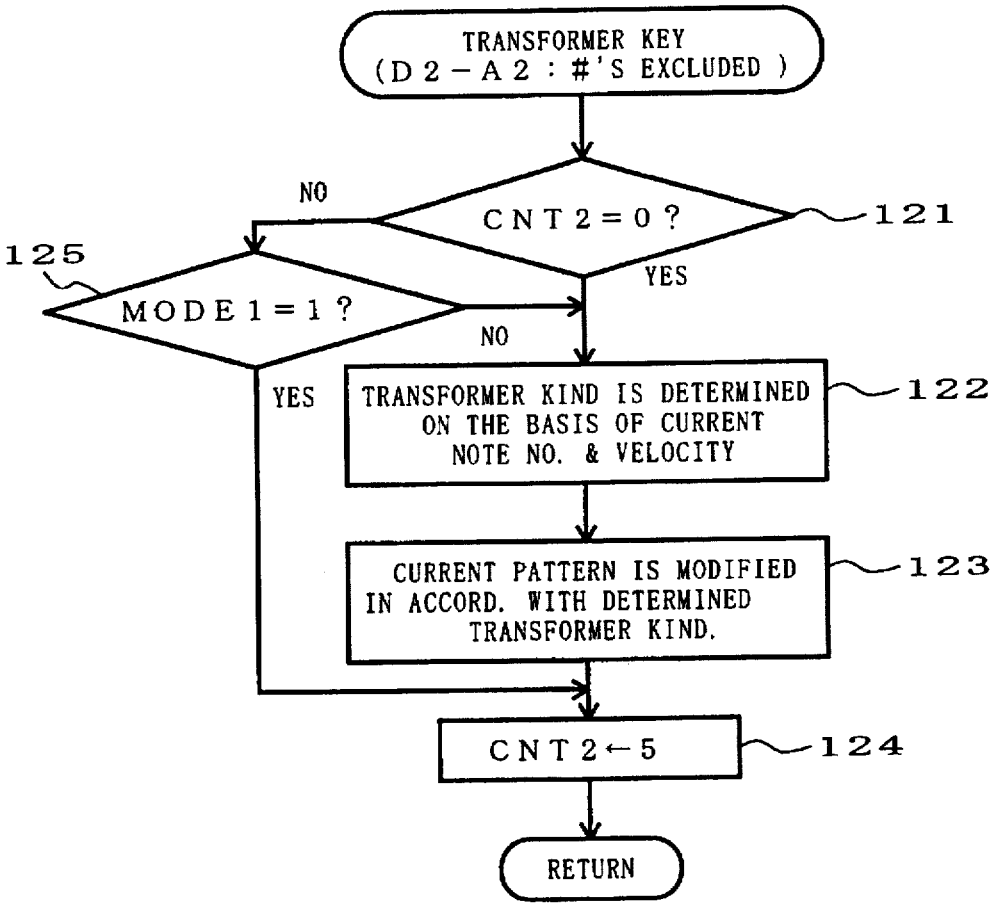
FIG. 40 is a flowchart illustrating still another detailed example of the MIDI message reception processing of FIG. 8B, which is performed when a received MIDI message is a note-on message corresponding to a transformer key of any of note numbers D2 to A2 (excluding #'s)

FIG. 40 is a flowchart illustrating still another example of the processing routine, corresponding to the third modified example, which is performed by the CPU 21 of the personal computer 20 when a received MIDI message is a key-on message corresponding to a transformer key of any of note numbers D2 to A2 (excluding #'s). Upon receipt of the MIDI message pertaining to any of note numbers D2 to A2 (excluding #'s), a determination is made in step 121 as to whether the counter CNT2 is at a count "0". If answered in the affirmative, the CPU 122 proceeds to step 122 where a transformer kind is determined on the basis of the current note number and velocity values, and then to step 123 where the transformer process is executed in accordance with the determined transformer kind so as to modify the current pattern. Then, the CPU 21 proceeds to step 124 in order to set a value "5" to the counter CNT2. The counter CNT2, similarly to the counter CNT1, is a software counter that counts down by one for every predetermined time (10 ms in this embodiment) and counts up to about 50 ms by being set at "5" as mentioned.

Figure 41:
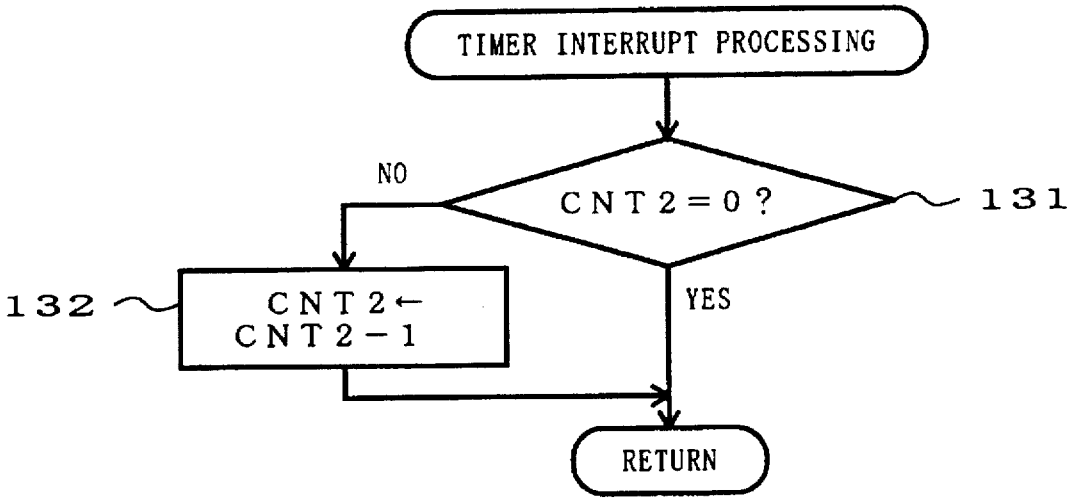
FIG. 41 is a flowchart illustrating the detail of timer interrupt processing performed every 10 ms in connection with the example of FIG. 40.

FIG. 41 is a flowchart illustrating the detail of timer interrupt processing performed by the CPU 21 of the personal computer 20 in connection with the example of FIG. 40, where the counter CNT2 having been set at "5" in step 124 of FIG. 40 is decremented. This timer interrupt processing is executed once for every 10 ms. First, in step 131, a determination is made as to whether the counter CNT2 is at a count value "0". If answered in the affirmative, the CPU 21 immediately returns to the main routine, but if the count value is other than "0", the counter CNT2 is decremented by one.

If a new transformer is designated between the time when the counter CNT2 is set at "5" in step 124 and the time when the counter CNT2 reaches the count vale of "0", i.e., before about 50 ms has elapsed, a negative determination results in step 121 of FIG. 40, so that the CPU 125 branches to step 125, where a determination is made as to whether the current value in the mode register MODE1 is "1". With an affirmative answer in step 125, the CPU 21 jumps over steps 122 and 123 to step 124 in order to invalidate the new transformer designation. If, on the other hand, the current value in the mode register MODE1 is "2" (NO), the CPU 21 goes to step 124 via steps 122 and 123 to perform the transformer process based on the new transformer designation. In this manner, where two transformer designations occur within a predetermined time period while the value of the mode register MODE1 is "1", only the first designation is made effective; where two transformer designations occur within a predetermined time period while the value of the mode register MODE1 is "2", however, both the designations are made effective. This arrangement will be useful when the user has an intention to designate more than one transformer practically simultaneously.

It should be appreciated that the time period threshold used to determine whether two keys have been operated practically simultaneously may be longer or shorter than about 50 ms. Further, where it is detected that more than two operators have been operated practically simultaneously, only the first operation may be made effective similarly to the above-mentioned; alternatively, only the last operation or only he operation with the greatest velocity may be made effective.

Next, the fourth modified example of the present invention will be described with reference to FIGS. 42 and 43. According to this fourth example, when a transformer process is designated, a mode switching arrangement permits a selection of either a mode where the designated transformer process is executed immediately or a mode where the designated transformer process is executed at next measure line timing.

Figure 42:
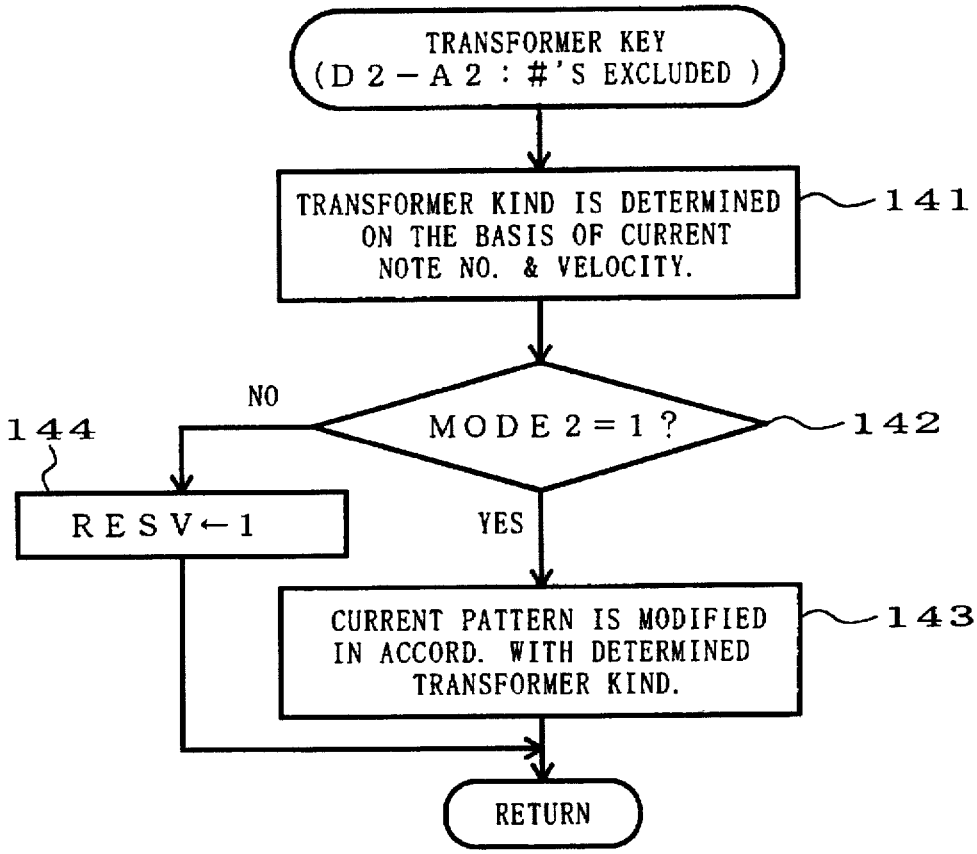
FIG. 42 is a flowchart illustrating still another detailed example of the MIDI message reception processing of FIG. 8B, which is performed when a received MIDI message is a note-on message corresponding to a transformer key of any of note numbers D2 to A2 (excluding #'s)

FIG. 42 is a flowchart illustrating still another example of the processing routine, corresponding to the fourth modified example, which is performed by the CPU 21 of the personal computer 20 when a received MIDI message is a key-on message corresponding to a transformer key of any of note numbers D2 to A2 (excluding #'s). Upon receipt of the MIDI message pertaining to any of note numbers D2 to A2 (excluding #'s), a transformer kind is determined in step 141 on the basis of the current note number and velocity values, and a determination is made in step 142 as to whether the current value in mode register MODE2 is "1" or not.

Although not specifically explained to avoid unnecessary duplication, the mode register MODE2 is a register that is switched between the values "1" and "2" via operations as in FIG. 39. The register MODE2 at the value of "1" indicates the mode where the designated transformer process is executed immediately, whereas the register MODE2 at the value of "2" indicates the mode where the designated transformer process is executed at next measure line timing.

If it is determined in step 142 that the current value in mode register MODE2 is "1", the transformer process is executed in step 143 in accordance with the determined transformer kind so as to modify the current pattern. Namely, the transformer process is executed immediately upon designation. If, on the other hand, it is determined in step 142 that the current value in mode register MODE2 is not "1" but "2", "1" is set to reserve flag RESV in step 144, which is a flag indicating that there has been designated a transformer process and execution of the designated transformer process is reserved for the next measure line timing.

Figure 43:
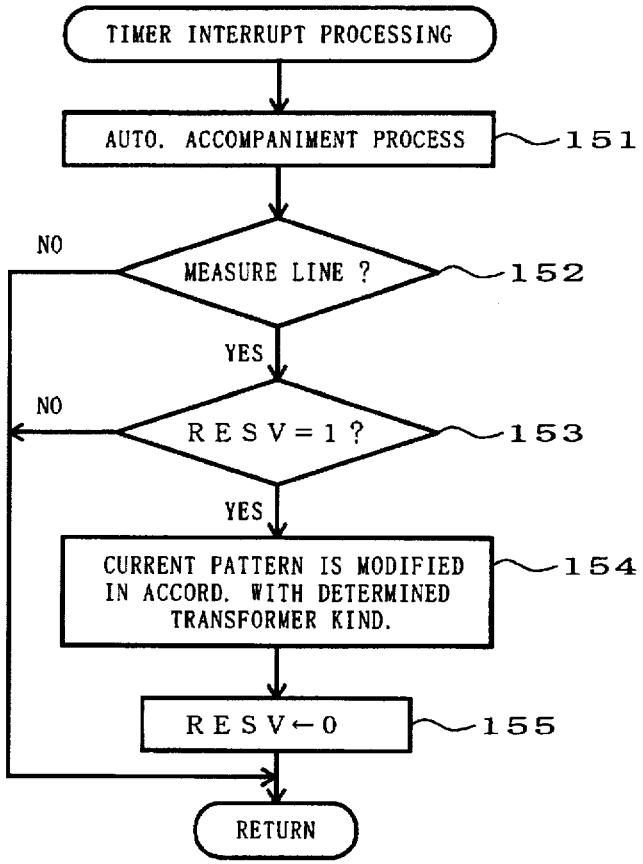
FIG. 43 is a flowchart illustrating the detail of timer interrupt processing performed at a frequency of 480 times per quarter note in connection with the example of FIG. 42.

FIG. 43 is a flowchart illustrating the detail of timer interrupt processing performed at a frequency of 480 times per quarter note in connection with the example of FIG. 42. First, in step 151, the current pattern data are read out for execution of an automatic accompaniment process, by operations similar to those of steps 31 to 40 of FIG. 14. Next, in step 152, a determination is made as to whether the current in-measure timing coincides with measure line timing. If answered in the affirmative in step 152, the CPU 21 proceeds to step 153, but if not, the CPU 21 immediately returns to the main routine. In step 153, it is further determined whether or not the reserve flag RESV is at a value "1". If it is at "1", the transformer process is executed in step 154 in accordance with the determined transformer kind so as to modify the current pattern. Namely, when the reserve flag RESV is at "1", the transformer process is executed at the first measure line timing after the transformer designation. Then, the reserve flag RESV is reset to "0" in step 155, and the CPU 21 returns to the main routine. If, however, the reserve flag RESV is not at "1" as determined in step 153, the CPU 21 immediately returns to the main routine.

In this way, when the register MODE2 is at the value of "1", the designated transformer process is executed immediately, whereas when the register MODE2 is at the value of "2", the designated transformer process is executed at the next measure line timing. Alternatively, when the register MODE2 is at the value of "1", the designated transformer process may be executed at the next beat timing or the like rather than at the next measure line timing. There may be some time discrepancy between the transformer process designation timing and the actual execution timing of the designated transformer process.

Thus, where a pattern change is desired in the middle of a measure, it is only sufficient for the user to designate a transformer in mode "1", whereas where a pattern change is desired at specific measure line timing, it is only sufficient for the user to designate a transformer in mode "2". The user can properly use either mode depending on his or her taste or desired performance form.

Next, the fifth modified example of the present invention will be described with reference to FIG. 44. According to this fifth example, when a transformer process is designated, whether the designated transformer process is to be executed immediately or to be executed at next measure line timing can be selected depending on specific in-measure timing at which the transformer designation is made.

Figure 44:
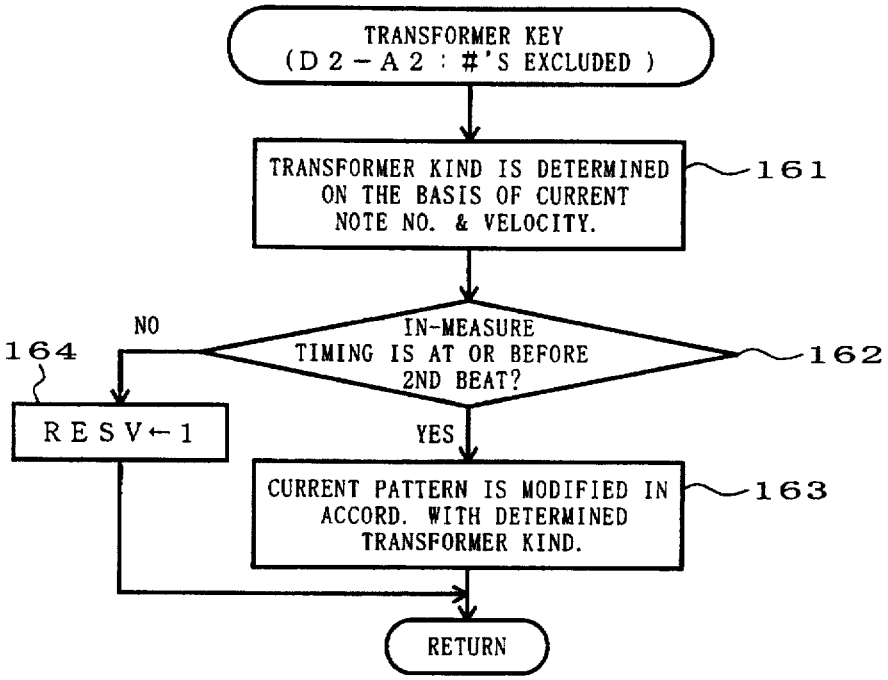
FIG. 44 is a flowchart illustrating still another detailed example of the MIDI message reception processing of FIG. 8B, which is performed when a received MIDI message is a note-on message corresponding to a transformer key of any of note numbers D2 to A2 (excluding #'s)

FIG. 44 is a flowchart illustrating still another example of the processing routine, corresponding to the fifth modified example, which is performed by the CPU 21 of the personal computer 20 when a received MIDI message is a key-on message corresponding to a transformer key of any of note numbers D2 to A2 (excluding #'s). Upon receipt of the MIDI message pertaining to any of note numbers D2 to A2 (excluding #'s), a transformer kind is determined in step 161 on the basis of the current note number and velocity values, and a determination is made in step 162 as to whether the in-measure timing at which the transformer process designation has occurred is at or before the second beat.

If answered in the affirmative in step 162, the transformer process is executed in step 163 in accordance with the determined transformer kind so as to modify the current pattern. Namely, the transformer process is executed immediately upon designation. If, however, the in-measure timing is after the second beat as determined in step 162, the reserve flag RESV, which is similar to the one in the fourth modified example, is set at "1" in step 164.

Then, once it is determined, through operations similar to those of the timer interrupt processing of FIG. 43, that the reserve flag RESV is at "1" at the measure line timing, the transformer process is executed at that timing. In this manner, control is performed such that whether the designated transformer process is to be executed immediately or to be executed at next measure line timing is selected depending on specific in-measure timing at which the transformer designation takes place. Thus, the transformer process is basically effected at the first measure line timing after the designation, but, in such a case where the user wrongly designates a transformer a little behind intended measure line timing, the pattern can be changed as desired immediately without waiting until the next measure line timing. Accordingly, the above-mentioned arrangement allows the transformer process to be effected at any timing intended by the user.

As in the fourth modified example, where the transformer process designation timing is at or before the second beat, the transformer process may be effected at the next beat timing or the like, and there may be some time discrepancy between the transformer process designation timing and the actual execution timing of the designated transformer process. Further, the threshold beat timing used to decide whether the transformer process is to be executed immediately or to be executed at the next measure line timing is other than the second beat timing.

Finally, the sixth modified example of the present invention will be described with reference to FIG. 45. According to this sixth example, as long as the transformer process designation operation lasts continuously, the transformer process is executed once for every predetermined timing (e.g., for every measure line timing).

Figure 45:
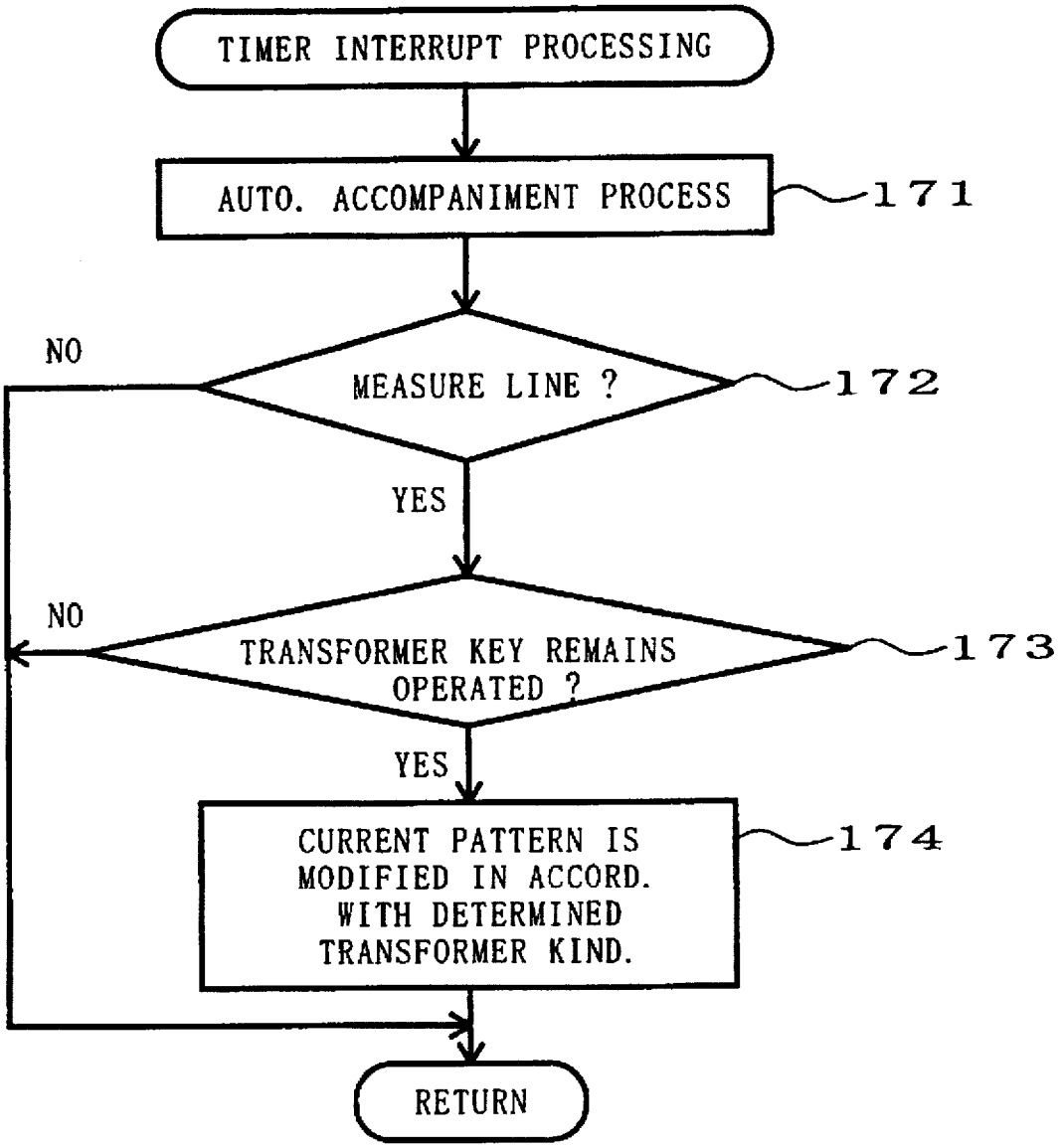
FIG. 45 is a flowchart illustrating the detail of timer interrupt processing performed at a frequency of 480 times per quarter note in connection with the example of FIG. 44.

FIG. 45 is a flowchart illustrating the detail of timer interrupt processing performed at a frequency of 480 times per quarter note in connection with the example of FIG. 44. First, in step 171, the current pattern data are read out for execution of an automatic accompaniment process, by operations similar to those of steps 31 to 40 of FIG. 14. Next, in step 172, a determination is made as to whether the current in-measure timing coincides with measure line timing. If answered in the affirmative in step 172, the CPU 21 proceeds to step 173, but if not, the CPU 21 immediately returns to the main routine. In step 173, it is further determined whether or not a transformer key is maintained in the on-state. If it is maintained in the on-state (YES), the transformer process is executed in step 174 in accordance with the determined transformer kind so as to modify the current pattern; otherwise, the CPU 21 immediately returns to the main routine. In this way, where the transformer key remains operated long enough to reach specific measure line timing, the transformer process is executed at that measure line timing. Namely, as long as the transformer key remains operated, the transformer process is executed each time measure line timing is reached, so that the pattern is changed in succession. It should be appreciated that the timing at which the transformer process is executed may be other than the measure line timing, such as the first and second beats, every beat, or every other beat.

As has been described so far, the present invention achieves the benefit that the accompaniment pattern can be modified as desired by the user.

What is claimed is:

1. An automatic accompaniment device comprising:

accompaniment pattern storage means storing an accompaniment pattern;

readout means for reading out the accompaniment pattern from said accompaniment pattern storage means;

special performance designation means for designating a special performance, said special performance being at least one performance among intro, fill-in and ending performances;

pattern modification means for applying, to the accompaniment pattern read out by said readout means, a modification corresponding to the special performance designated by said special performance designation means;

progression control means for controlling progression of an automatic accompaniment performance in accordance with the designated special performance; and accompaniment tone generation means for generating automatic accompaniment tone on the basis of the read-out accompaniment pattern and the accompaniment pattern modified by said pattern modification means; and wherein said pattern modification means modifies said read-out automatic accompaniment pattern in accordance with a predetermined algorithm corresponding to said designated special performance.

2. An automatic accompaniment device as defined in claim 1 wherein said pattern modification means applies the modification to at least one element among plural elements constituting the accompaniment pattern.

3. An automatic accompaniment device as defined in claim 2 wherein said pattern modification means time-varies a manner in which said modification means modifies the read-out accompaniment pattern.

4. An automatic accompaniment device as defined in claim 2 wherein said pattern modification means modifies a predetermined section of the read-out accompaniment pattern to provide the special performance, said modification means dividing the predetermined section into plural subsections and modifying the subsections independently of each other.

5. An automatic accompaniment device as defined in claim 1 wherein when the special performance is designated, said progression control means provides said accompaniment tone generation means with only a predetermined number of measures of said modified accompaniment pattern in place of said read-out accompaniment pattern, in such a manner that the special performance based on said modified accompaniment pattern is inserted for the predetermined number of measures in place of a normal performance based on the read-out accompaniment pattern.

6. An automatic accompaniment device as defined in claim 5 wherein the predetermined number of measures is set independently for each different form of said special performance.

7. An automatic accompaniment device as defined in claim 5 wherein where the designated special performance is the intro performance, said progression control means performs control such that the special performance based on said modified accompaniment pattern is executed at first and then the normal performance based on the read-out accompaniment pattern is executed.

8. An automatic accompaniment device as defined in claim 5 wherein where the designated special performance is a normal fill-in performance, said progression control means performs control such that the special performance based on said modified accompaniment pattern is executed and then the normal performance based on the read-out accompaniment pattern is resumed.

9. An automatic accompaniment device as defined in claim 5 wherein where the designated special performance is a special fill-in performance, said progression control means performs control such that the special performance based on said modified accompaniment pattern is executed, then the read-out accompaniment pattern is modified for a normal performance and then a modified normal performance based on the modified read-out accompaniment pattern is executed.

10. An automatic accompaniment device as defined in claim 5 wherein where the designated special performance is the ending performance, said progression control means performs control such that the special performance based on said modified accompaniment pattern is executed and then the automatic accompaniment performance is terminated.

11. An automatic accompaniment device comprising:

accompaniment pattern storage means storing plural accompaniment patterns;

read-out means for selectively reading out one of the accompaniment patterns from said accompaniment pattern storage means;

special performance designation means for designating a special performance from among plural special performances, said special performances including intro, fill-in and ending performances;

pattern modification means for applying, to the accompaniment pattern read out by said read-out means, a modification corresponding to the special performance designated by said special performance designation means;

progression control means for controlling progression of an automatic accompaniment performance in accordance with the designated special performance; and accompaniment tone generation means for generating automatic accompaniment tone on the basis of the read-out accompaniment pattern and the accompaniment pattern modified by said pattern modification means; and wherein said pattern modification means modifies said read-out automatic accompaniment pattern in accordance with a predetermined algorithm corresponding to said designated special performance.

12. An automatic accompaniment device comprising:

accompaniment pattern storage means storing an accompaniment pattern;

read-out means for reading out the accompaniment pattern from said accompaniment pattern storage means;

special performance designation means for designating a special performance, said special performance being one of intro, fill-in and ending performances;

modifier supply means for supplying modifier data describing a manner of modifying the accompaniment pattern;

pattern modification means for applying, to the accompaniment pattern read out by said read-out means, a modification based on the modifier data supplied by said modifier supply means;

progression control means for controlling progression of an automatic accompaniment performance in accordance with the special performance designated by said special performance designation means; and accompaniment tone generation means for generating automatic accompaniment tone on the basis of the read-out accompaniment pattern and the accompaniment pattern modified by said pattern modification means.

13. An automatic accompaniment device as defined in claim 12 wherein said modifier supply means includes selection means for selecting one or more modifiers from among plural said modifiers, said pattern modification means modifying the read-out accompaniment pattern in accordance with a combination of the one or more modifiers selected by said selection means.

14. An automatic accompaniment device as defined in claim 12 wherein said modifier supply means includes an operating member to select a desired said modifier and detection means for detecting an operating touch applied to said operating member, said supply means supplies modifier data that is obtained by qualifying the modifier selected by said operating member in accordance with the touch detected by said detection means.

15. An automatic accompaniment device as defined in claim 12 wherein said modifier supply means divides, into plural subsections, a predetermined section of the accompaniment pattern for which said special performance is to be executed and supplies the modifier data for each of the subsections.

16. An automatic accompaniment device as defined in claim 12 wherein even where the modifier data supplied by said modifier supply means is unchanged, said pattern modification means applies different modifications if the accompaniment pattern read out by said read-out means varies in type.

17. An automatic accompaniment device comprising:

accompaniment pattern storage means storing an accompaniment pattern in correspondence to plural musical instrument parts;

read-out means for reading out the accompaniment pattern from said accompaniment pattern storage means;

modifier supply means for supplying modifier data describing a manner of modifying the accompaniment pattern;

modification condition data supply means for supplying modification condition data for each of the musical instrument parts in correspondence to the modifier data supplied by said modifier supply means; and modification means for, for each of the musical instrument parts, modifying the accompaniment pattern read out by said read-out means in accordance with the modifier data supplied by said modifier supply means and the modification condition data supplied for each of the musical instrument parts by said modification condition data supply means.

18. An automatic accompaniment device as defined in claim 17 wherein said modification condition data supply means includes determination means for, for each of the musical instrument parts, determining whether or not to modify the read-out accompaniment pattern, said modification means applies, to any of the musical instrument parts which has been determined to be modified, a pattern modification process in accordance with a predetermined algorithm corresponding to the modifier data.

19. An automatic accompaniment device as defined in claim 17 wherein said modification condition data supply means includes determination means for, for each of the musical instrument parts, determining whether or not to modify the read-out accompaniment pattern and also setting a section of the pattern to be modified, said modification means applies, to the section of the pattern for any of the musical instrument parts which has been determined to be modified, a pattern modification process in accordance with a predetermined algorithm corresponding to the modifier data.

20. An automatic accompaniment device as defined in claim 17 which further comprises save means for saving the accompaniment pattern modified by said modification means, and means for reading our the modified accompaniment pattern saved in said save means so as to generate automatic accompaniment tone on the basis of the read-out modified accompaniment pattern.

21. An automatic accompaniment device comprising:

accompaniment pattern storage means storing an accompaniment pattern;

read-out means for reading out the accompaniment pattern from said accompaniment pattern storage means;

modifier supply means for supplying modifier data describing a manner of modifying the accompaniment pattern;

modification means for modifying a partial time range of the accompaniment pattern read out by said read-out means, in accordance with a predetermined algorithm corresponding to the modifier data supplied by said modifier supply means.

22. An automatic accompaniment device as defined in claim 21 which further comprises save means for saving the accompaniment pattern modified by said modification means, and means for reading our the modified accompaniment pattern saved in said save means so as to generate automatic accompaniment tone on the basis of the read-out modified accompaniment pattern.

23. An automatic accompaniment device as defined in claim 21 wherein said accompaniment pattern comprises plural musical instrument parts, said modification means, for each of the musical instrument parts, modifies an individually set time range of said accompaniment pattern.

24. An automatic accompaniment device comprising:

accompaniment pattern storage means storing an accompaniment pattern;

read-out means for reading out the accompaniment pattern from said accompaniment pattern storage means;

modifier supply means for supplying a combination of plural modifier data each describing a manner of modifying the accompaniment pattern; and modification means for modifying the accompaniment pattern read out by said read-out means, in accordance with a predetermined algorithm corresponding to the plural modifier data supplied by said modifier supply means.

25. An automatic accompaniment device as defined in claim 24 wherein the combination of the plural modifier data includes a first form of combination for applying modifications to a common section of the accompaniment pattern in an additive fashion, and wherein when said modifier supply means supplies plural said modifier data corresponding to the first form of combination, said modification means applies modifications to a predetermined common section of the accompaniment pattern in an additive fashion in accordance with respective predetermined algorithms corresponding to the plural modifier data supplied by said supply means.

26. An automatic accompaniment device as defined in claim 24 wherein the combination of the plural modifier data includes a second form of combination for applying separate modifications to different sections, respectively, of the accompaniment pattern, and wherein when said modifier supply means supplies plural said modifier data corresponding to the second form of combination, said modification means applies separate modifications to predetermined different sections of the accompaniment pattern in accordance with respective predetermined algorithms corresponding to the plural modifier data supplied by said supply means.

27. An automatic accompaniment device as defined in claim 24 wherein said modifier supply means includes:

data storage means for storing plural said modifier data;

combination instruction means for instructing a combination of specific ones of the plural modifier data; and means for reading out a plurality of the modifier data that correspond to the combination instructed by said combination instruction means.

28. An automatic accompaniment device as defined in claim 27 wherein said data storage means includes a table storing data indicative of combinations each comprising specific ones of the plural modifier data, and said combination instruction means includes operating members which are smaller in number than the combinations stored in said table, and wherein said read-out means, when any of said operating members is operated, reading out the specific plural modifier data corresponding to one of the combinations which is allocated to the operated operating member.

29. An automatic accompaniment device comprising:

accompaniment pattern storage means storing an accompaniment pattern;

read-out means for reading out the accompaniment pattern from said accompaniment pattern storage means;

modifier data storage means for storing modifier data each describing a manner of modifying the accompaniment pattern;

modifier supply means for selectively supplying the modifier data from said modifier data storage means;

modification means for modifying the accompaniment pattern read out by said read-out means, in accordance with a predetermined algorithm corresponding to the modifier data supplied by said modifier supply means; and editing means for editing the modifier data stored in said modifier data storage means.

30. An automatic accompaniment device as defined in claim 29 wherein said modifier data comprises plural modification elements each including element kind data indicative of a pattern processing algorithm and parameter to be used in the processing algorithm, and wherein said editing means edits the element kind data and parameter for each of the modification elements constituting said modifier data.

31. An automatic accompaniment device as defined in claim 29 wherein said editing means includes an editing process for revising or modifying the contents of the modifier data already stored in said modifier data storage means, and another editing process for creating and storing new modifier data into said said modifier data storage means.

32. An automatic accompaniment device comprising:

storage means storing accompaniment pattern data;

designation means for designating a modifier indicative of a modification to be applied to the accompaniment pattern;

modification means for executing a modifying algorithm corresponding to the modifier designated by said designation means, so as to modify the accompaniment pattern data;

display means for displaying the contents of the accompaniment pattern;

display control means for controlling the contents of the accompaniment pattern to be displayed on said display means, in such a manner to indicate how the accompaniment pattern is changed by being modified by said modification means; and accompaniment means for performing an automatic accompaniment performance in accordance with the accompaniment pattern modified by said modification means.

33. An automatic accompaniment device as defined in claim 32 wherein said display means displays tone generation event present in the accompaniment pattern, and said display control means makes a comparison between the accompaniment pattern before modification by said modification means and the accompaniment pattern after modification by said modification means so as to display event present in both the accompaniment pattern before and after the modification, event present only in the accompaniment pattern before the modification and event present only in the accompaniment pattern after the modification in respective distinguishable forms.

34. An automatic accompaniment device comprising:

storage means storing accompaniment pattern data;

designation means for designating a modifier indicative of a modification to be applied to the accompaniment pattern;

modification means for executing a modifying algorithm corresponding to the modifier designated by said designation means, so as to modify the accompaniment pattern data, said modifying algorithm comprising plural modification elements;

display means for displaying the modification elements of the modifying algorithm corresponding to the designated modifier; and accompaniment means for performing an automatic accompaniment performance in accordance with the accompaniment pattern modified by said modification means.

35. An automatic accompaniment device as defined in claim 34 wherein said plural modification elements constituting the modifying algorithm includes a specific element that functions to extract a predetermined pattern prototype from within the accompaniment pattern before modification by said modification means and replace the predetermined prototype with another pattern, and wherein said display means displays a name representing said specific modification element.

36. An automatic accompaniment device as defined in claim 34 wherein said plural modification elements includes a specific element that functions to add an accompaniment pattern of predetermined musical instrument tone to the accompaniment pattern before modification by said modification means, and wherein said display means displays a name representing said specific modification element.

37. An automatic accompaniment device as defined in claim 34 wherein said plural modification elements includes a specific element that functions to remove an accompaniment pattern of predetermined musical instrument tone from the accompaniment pattern before modification by said modification means, and wherein said display means displays a name representing said specific modification element.

38. An automatic accompaniment device as defined in claim 34 wherein said plural modification elements includes a specific element that function to vary tone generating intensity information of the accompaniment pattern before modification by said modification means, and wherein said display means displays a name representing said specific modification element.

39. An automatic accompaniment device as defined in claim 34 wherein said plural modification elements includes a specific element that functions to replace predetermined musical instrument tone within the accompaniment pattern before modification by said modification means with another musical instrument tone, and wherein said display means displays a name representing said specific modification element.

40. An automatic accompaniment device as defined in claim 34 wherein said plural modification elements includes a specific element that functions to normalize, into predetermined beat timing, tone generation timing of a musical instrument within the accompaniment pattern before modification by said modification means with another musical instrument tone, and wherein said display means displays a name representing said specific modification element.

41. An automatic accompaniment device comprising:

storage means storing accompaniment pattern data;

plural designating operating members provided in correspondence to modifiers indicative of modifications to be applied to the accompaniment pattern;

designation means for designating any of the modifiers in response to operation of any of the operating members, wherein when one of the operating members is operated singly, said designation means designates any of the modifiers which corresponds to the operated operating member, but when two or more said operating members are operated substantially simultaneously, said designation means designate any of the modifiers other than the modifiers corresponding to the operated operating members;

modification means for executing a modifying algorithm corresponding to the modifier designated by said designation means; and accompaniment means for performing an automatic accompaniment performance in accordance with the accompaniment pattern modified by said modification means.

42. An automatic accompaniment device comprising:

storage means storing accompaniment pattern data;

designation means for designating any of plural modifiers indicative of modifications to be applied to the accompaniment pattern, each said modifier being set in pair with another said modifier which is opposite in nature thereto;

modification means for executing a modifying algorithm corresponding to the modifier designated by said designation means, so as to modify the accompaniment pattern;

determination means for determining whether the currently-designated modifier is musically opposite in nature to the last-designated modifier;

undo means for, when said determination means determines that the currently-designated modifier is opposite in nature to the last-designated modifier, restoring the accompaniment pattern before modification based on the last-designated modifier; and accompaniment means for performing an automatic accompaniment performance in accordance with the accompaniment pattern modified by said modification means or with the accompaniment pattern restored by said undo means.

43. An automatic accompaniment device comprising:

storage means storing accompaniment pattern data;

plural designating operating members provided in correspondence to modifiers indicative of modifications to be applied to the accompaniment pattern;

designation means for designating any of the modifiers in response to activation of any of the operating members, wherein when two or more said operating members are operated substantially simultaneously, said designation means treats operation of only one said operating member as effective;

modification means for executing a modifying algorithm corresponding to the modifier designated by said designation means, so as to modify the accompaniment pattern; and accompaniment means for performing an automatic accompaniment performance in accordance with the accompaniment pattern modified by said modification means.

44. An automatic accompaniment device comprising:

storage means storing accompaniment pattern data;

designation means for designating a modifier indicative of a modification to be applied to the accompaniment pattern;

modification means for executing a modifying algorithm corresponding to the modifier designated by said designation means;

mode setting means for setting first and second modes;

modification timing control means for controlling modification timing of said modification means in such a manner that when the first mode is set by said mode setting means, a modification process is performed within a measure where the modifier is designated by said designation means, but when the second mode is set by said mode setting means, a modification process is performed at the head of a measure next to the measure where the modifier is designated by said designation means; and accompaniment means for performing an automatic accompaniment performance in accordance with the accompaniment pattern modified by said modification means.

45. An automatic accompaniment device comprising:

storage means storing accompaniment pattern data;

designation means for designating a modifier indicative of a modification to be applied to the accompaniment pattern;

modification means for executing a modifying algorithm corresponding to the modifier designated by said designation means;

modification timing control means for controlling modification timing of said modification means in such a manner that when the modifier is designated by said designation means earlier than predetermined timing within a specific measure, a modification process is performed in the specific measure, but when the modifier is designated by said designation means later than predetermined timing within a specific measure, a modification process is performed at the head of a measure next to the specific measure; and accompaniment means for performing an automatic accompaniment performance in accordance with the accompaniment pattern modified by said modification means.

46. An automatic accompaniment device comprising:

storage means storing accompaniment pattern data;

designation means for designating a modifier indicative of a modification to be applied to the accompaniment pattern;

modification means for, in response to designation by said designation means, executing a modifying algorithm corresponding to the modifier designated by said designation means so as to modify the accompaniment pattern, wherein when it is detected that said designating operating member is in an operated state at predetermined timing, said modification means performs a modification at the predetermined timing; and accompaniment means for performing an automatic accompaniment performance in accordance with the accompaniment pattern modified by said modification means.

* * * * *